US008820554B2

(12) United States Patent
Rho

(10) Patent No.: US 8,820,554 B2
(45) Date of Patent: Sep. 2, 2014

(54) VESSEL CAP HAVING A CUTTER AND HOOK FOR REMOVING AND RETAINING A SEAL

(76) Inventor: Hee Kwon Rho, Kyeongki-do (KR)

( * ) Notice: Subject to any disclaimer, the term of this patent is extended or adjusted under 35 U.S.C. 154(b) by 1750 days.

(21) Appl. No.: 11/721,248

(22) PCT Filed: Dec. 7, 2005

(86) PCT No.: PCT/KR2005/004188

§ 371 (c)(1),
(2), (4) Date: Aug. 10, 2009

(87) PCT Pub. No.: WO2006/062357

PCT Pub. Date: Jun. 15, 2006

(65) Prior Publication Data

US 2009/0301988 A1 Dec. 10, 2009

(30) Foreign Application Priority Data

| | | |
|---|---|---|
| Dec. 9, 2004 | (KR) | 10-2004-0103652 |
| Feb. 2, 2005 | (KR) | 10-2005-0009769 |
| Mar. 15, 2005 | (KR) | 10-2005-0021246 |
| Apr. 8, 2005 | (KR) | 10-2005-0029510 |
| May 19, 2005 | (KR) | 10-2005-0041905 |
| May 24, 2005 | (KR) | 10-2005-0043522 |

(51) Int. Cl.
*B65D 51/22* (2006.01)

(52) U.S. Cl.
USPC ..... 215/297; 215/253; 215/257; 215/349; 215/350; 220/258.4; 220/278

(58) Field of Classification Search
USPC ..... 215/257, 297, 341, 349, 350, 249, 253; 220/254.1, 254.8, 254.9, 258.1, 220/258.3–258.5, 267, 277, 278; 222/81, 222/83, 85, 83.5

IPC ..... B65D 51/22
See application file for complete search history.

(56) References Cited

U.S. PATENT DOCUMENTS 1,024,403 A * 4/1912 Hill ..... 81/3.48
1,258,063 A * 3/1918 Taylor ..... 215/297

(Continued)

FOREIGN PATENT DOCUMENTS

EP 0328652 6/1988
EP 678455 A1 * 10/1995

(Continued)

OTHER PUBLICATIONS

PCT International Search Report dated Mar. 30, 2006 issued in corresponding PCT Application No. PCT/KR2005/004188.

(Continued)

*Primary Examiner* — Anthony Stashick
*Assistant Examiner* — Ned A Walker
(74) *Attorney, Agent, or Firm* — Ostrolenk Faber LLP

(57) ABSTRACT

A vessel cap is comprised of a body mounted at a vessel inlet through which a liquid material stored in a vessel is discharged outwardly and having a certain space therein. A pressing plate is disposed in the body to be movable in upper and lower directions. A cutter is formed at an edge of a lower surface of the pressing plate in a circumferential direction for penetrating a sealing member when the pressing plate is pressed and which cuts the sealing member when the body is rotated. A hooking member downwardly protrudes at the lower surface of the pressing plate for storing the sealing member cut by the cutter in the body. A connection portion is formed between an outer circumferential surface of the pressing plate and an inner circumferential surface of the body for guiding the pressing plate to be moved in upper and lower directions.

15 Claims, 58 Drawing Sheets

(56) References Cited

U.S. PATENT DOCUMENTS

| | | | | | |
|---|---|---|---|---|---|
| 1,664,047 | A | * | 3/1928 | Sacerdote | 215/226 |
| 2,066,390 | A | * | 1/1937 | Cahoon et al. | 215/253 |
| 2,152,001 | A | * | 3/1939 | Temple | 222/81 |
| 2,631,521 | A | * | 3/1953 | Atkins, Jr. | 99/275 |
| 3,172,478 | A | * | 3/1965 | Giclas | 169/89 |
| 3,402,855 | A | * | 9/1968 | Schroeder et al. | 222/83 |
| 3,406,872 | A | * | 10/1968 | Fiquet et al. | 222/83 |
| 3,581,605 | A | * | 6/1971 | Taylor | 81/3.49 |
| 3,612,325 | A | * | 10/1971 | Williams | 215/329 |
| 4,723,687 | A | * | 2/1988 | Kutterer | 222/83 |
| 4,747,500 | A | * | 5/1988 | Gach et al. | 215/250 |
| 4,754,889 | A | * | 7/1988 | Debetencourt | 215/232 |
| 4,770,305 | A | * | 9/1988 | Su | 215/250 |
| 4,792,053 | A | * | 12/1988 | Towns et al. | 215/250 |
| 4,793,504 | A | * | 12/1988 | Towns et al. | 215/250 |
| 4,793,505 | A | * | 12/1988 | Towns et al. | 215/250 |
| 4,795,043 | A | * | 1/1989 | Odet et al. | 215/235 |
| 4,867,326 | A | * | 9/1989 | O'Meara | 215/250 |
| 4,869,399 | A | * | 9/1989 | Dubach | 222/83 |
| 5,141,133 | A | * | 8/1992 | Ninomiya et al. | 222/83 |
| 5,228,592 | A | * | 7/1993 | Pellerano | 222/83 |
| 5,255,812 | A | * | 10/1993 | Hsu | 220/277 |
| 5,255,813 | A | * | 10/1993 | Berggren et al. | 220/278 |
| 5,505,326 | A | * | 4/1996 | Junko | 220/278 |
| 5,695,084 | A | | 12/1997 | Chmela et al. | 220/212 |
| 5,853,109 | A | * | 12/1998 | Elliott | 222/83 |
| 6,089,391 | A | * | 7/2000 | Abelbeck et al. | 215/303 |
| 6,098,795 | A | * | 8/2000 | Mollstam et al. | 206/222 |
| 6,105,760 | A | * | 8/2000 | Mollstam et al. | 206/222 |
| 6,230,884 | B1 | * | 5/2001 | Coory | 206/222 |
| 6,367,622 | B1 | * | 4/2002 | Hsu | 206/222 |
| 6,382,462 | B1 | * | 5/2002 | Ostergaard-Nielsen et al. | 222/1 |
| 6,386,358 | B1 | * | 5/2002 | North et al. | 206/217 |
| 6,386,385 | B1 | * | 5/2002 | Amanat et al. | 220/258.4 |
| 6,454,088 | B2 | * | 9/2002 | Mollstam et al. | 206/222 |
| 6,513,650 | B2 | | 2/2003 | Mollstam et al. | 206/222 |
| 6,571,994 | B1 | * | 6/2003 | Adams et al. | 222/521 |
| 6,609,634 | B2 | * | 8/2003 | De Laforcade et al. | 222/1 |
| 6,659,308 | B1 | * | 12/2003 | Kelder et al. | 222/83 |
| 6,766,903 | B1 | * | 7/2004 | Yehhsu | 206/222 |
| 6,786,330 | B2 | * | 9/2004 | Mollstam et al. | 206/222 |
| 7,207,465 | B2 | * | 4/2007 | Weist | 222/83 |
| 7,261,226 | B2 | * | 8/2007 | Adams et al. | 222/521 |
| 7,427,005 | B1 | * | 9/2008 | Lohrman | 222/541.2 |
| 7,458,486 | B2 | * | 12/2008 | Weist et al. | 222/83 |
| 7,896,155 | B2 | * | 3/2011 | Seelhofer | 206/222 |
| 7,942,284 | B2 | * | 5/2011 | Amanat et al. | 220/258.4 |
| 2002/0040856 | A1 | * | 4/2002 | Mollstam et al. | 206/222 |
| 2004/0026422 | A1 | * | 2/2004 | Westphal | 220/277 |
| 2004/0065977 | A1 | * | 4/2004 | Bron et al. | 264/268 |
| 2004/0099686 | A1 | * | 5/2004 | Rho | 222/83 |
| 2005/0173436 | A1 | * | 8/2005 | Amanat et al. | 220/258.4 |
| 2005/0242113 | A1 | * | 11/2005 | Weist | 222/83.5 |
| 2006/0071000 | A1 | * | 4/2006 | Weist et al. | 220/278 |
| 2006/0081646 | A1 | * | 4/2006 | Rho | 222/80 |
| 2006/0151421 | A1 | * | 7/2006 | Rho | 215/297 |
| 2007/0007231 | A1 | * | 1/2007 | Naesje | 215/311 |
| 2008/0290061 | A1 | * | 11/2008 | Seelhofer | 215/249 |

FOREIGN PATENT DOCUMENTS

| | | | | |
|---|---|---|---|---|
| EP | 1234778 | A1 | * | 8/2002 |
| GB | 2305655 | A | * | 4/1997 |
| JP | 64020467 | U | * | 2/1989 |
| JP | 02-1627 | | | 1/1990 |
| JP | 08-133324 | | | 5/1996 |
| KR | 1999-0040589 | | | 12/1999 |
| WO | WO 03045811 | A1 | * | 6/2003 |
| WO | WO 2004050498 | A1 | * | 6/2004 |
| WO | WO 2004085278 | A1 | * | 10/2004 |

OTHER PUBLICATIONS

PCT International Written Opinion dated Mar. 30, 2006 issued in corresponding PCT Application No. PCT/KR2005/004188.

* cited by examiner

VESSEL CAP HAVING A CUTTER AND HOOK FOR REMOVING AND RETAINING A SEAL

FIELD OF THE INVENTION

The present invention relates to a vessel cap for opening and closing a vessel inlet and a system for manufacturing the same, and more particularly, to a vessel cap capable of detaching a sealing member formed at a vessel inlet from the vessel inlet together with an opened vessel cap by cutting the sealing member, and a system for manufacturing the same.

BACKGROUND

FIG. 1 is a sectional view showing a vessel cap in accordance with the conventional art.

Generally, a beverage vessel containing liquid such as a lactobacillus drink is provided with a vessel inlet 102, a sealing member 114 attached to the vessel inlet 102 for sealing a liquid material stored in a vessel 104 and thus preventing the liquid material from being discharged outwardly, and a vessel cap 100 for preventing the sealing member 114 from being damaged by an external impact or by a contact with an object.

The vessel cap 100 has a cylindrical shape of which upper side is closed. A hooking jaw 110 locked by a locking rib 108 formed at an outer circumferential surface of the vessel inlet 102 is formed at an inner circumferential surface of the vessel cap 100. A handgrip 112 held by a user in order to detach the vessel cap 100 from the vessel inlet 102 is formed at one side of the vessel cap 100.

In the conventional art, the vessel cap 100 is detached from the vessel inlet 102 by pulling the handgrip 112 held by the user. Then, the sealing member 114 is removed from the vessel inlet 102, and the liquid material stored in the vessel is discharged out through the vessel inlet 102.

However, in the conventional vessel cap, the sealing member attached to the vessel inlet has to be removed by the user's hand or by an additional tool such as a knife, etc. after detaching the vessel cap from the vessel inlet, thereby causing a user's inconvenience.

Especially, when the sealing member is removed by the user's hand, the sealing member is not smoothly detached from an edge of the vessel inlet due to a strong adhesion force therebetween. Therefore, the user has to remove the sealing member again by his hand, which causes a sanitary problem.

SUMMARY OF THE INVENTION

Therefore, an object of the present invention is to provide a vessel cap capable of enhancing a user's convenience by automatically removing a sealing member by opening the vessel cap by integrally forming a sealing member removing unit at the vessel cap without additionally removing the sealing member.

Another object of the present invention is to provide a vessel cap capable of preventing environment pollution due to a discarded sealing member by storing a sealing member removed by opening the vessel cap in the vessel cap.

Still another object of the present invention is to provide a vessel cap capable of solving a sanitary problem that a user's hand comes in contact with a vessel inlet at the time of removing a sealing member by automatically removing the sealing member by a sealing member removing unit.

Still another object of the present invention is to provide a vessel cap capable of reducing a production cost by manufacturing the vessel cap with one molding.

Still another object of the present invention is to provide a vessel cap capable of enhancing a user's convenience, shortening a manufacturing process, and reducing a production cost by constructing a handgrip of a spoon stored in the vessel cap to serve as a cover for protecting the spoon without an additional cover.

Still another object of the present invention is to provide a vessel cap capable of preventing a pressing plate from being pressed during a non-usage due to an external force by fixing the pressing plate of a sealing member removing unit to an inner circumferential surface of a body.

To achieve these and other advantages and in accordance with the purpose of the present invention, as embodied and broadly described herein, there is provided a vessel cap, comprising: a body mounted at a vessel inlet through which a liquid material stored in a vessel is discharged outwardly, and having a certain space therein; a pressing plate disposed in the body to be movable in upper and lower directions; a cutter formed at an edge of a lower surface of the pressing plate in a circumferential direction with the same gap for penetrating a sealing member when the pressing plate is pressed and cutting the sealing member when the body is rotated; a hooking member downwardly protruding at the lower surface of the pressing plate for storing the sealing member cut by the cutter in the body; and a connection portion formed between an outer circumferential surface of the pressing plate and an inner circumferential surface of the body for guiding the pressing plate to be moved in upper and lower directions.

The cutter comprises a plurality of supporting portions formed at an edge of a lower surface of the pressing plate with the same gap, a first cutting portion sharply formed at a lower end of the supporting portion for penetrating the sealing member when the pressing plate is pressed, and a second cutting portion formed on at least one side surface of both side surfaces of the supporting portion for cutting the sealing member as a circular shape when the body is rotated.

The hooking member comprises a rod downwardly extending from a center of a lower surface of the pressing plate, and a hooking portion formed at an end of the rod for hooking the sealing member so that the cut sealing member can be stored in the body when the body is detached from the vessel inlet and penetrating the sealing member when the pressing plate is pressed.

The vessel cap according to the present invention comprises: a body mounted at a vessel inlet through which a liquid material stored in a vessel is discharged outwardly; a pressing plate disposed in the body to be movable in upper and lower directions; at least one cutter formed at an edge of a lower surface of the pressing plate in a circumferential direction for penetrating a sealing member when the pressing plate is pressed and cutting the sealing member when the body is rotated; a hooking member downwardly protruding at the lower surface of the pressing plate for storing the sealing member cut by the cutter in the body; and a connection portion formed between an outer circumferential surface of the pressing plate and an inner circumferential surface of the body and elastically transformed so that the pressing plate can be moved in upper and lower directions.

The hooking member comprises a supporting rod downwardly extending from the lower surface of the pressing plate for penetrating the sealing member when the pressing plate is pressed, and at least one hooking protrusion formed at an outer circumferential surface of the supporting rod and elastically transformed to be bent for hooking the sealing member.

To achieve these and other advantages and in accordance with the purpose of the present invention, as embodied and broadly described herein, there is also provided a system for manufacturing a vessel cap, comprising: a first core having an inlet through which a molding material is injected and positioned at an upper side; a second core disposed at a lower side of the first core and having a cavity for forming a vessel cap between the first core; a third core inserted into a center of the second core for forming a hooking protrusion of a vessel cap; and a stripper plate disposed between the first core and the second core for separating a molded vessel cap from the first and second cores.

The vessel cap having a straw according to the present invention has the following advantages in that the sealing member removing unit is installed in the vessel cap. Accordingly, if the pressing plate of the sealing member removing unit is pressed before opening the vessel cap and then the vessel cap is opened, the sealing member is automatically removed from the vessel inlet thereby to enhance the user's convenience.

Also, the sealing member removed from the vessel inlet by opening the vessel cap is stored in the receiving portion inside the vessel cap. Therefore, environment pollution due to discard the sealing member out is prevented.

Also, since the sealing member is automatically removed by the sealing member removing unit, a sanitary problem caused as the user's hand comes in contact with the vessel inlet at the time of removing the sealing member can be solved.

Also, since the spoon handgrip covers the spoon receiving portion of the body, an additional cover for protecting the spoon head is not required thereby to simplify a manufacturing process and to reduce a production cost.

BRIEF DESCRIPTION OF THE DRAWINGS

FIG. 32 is a perspective view showing a state that a spoon is detached from

DETAILED DESCRIPTION

Hereinafter, preferred embodiments of the present invention will be explained in more detail with reference to the attached drawings.

Figure 1:
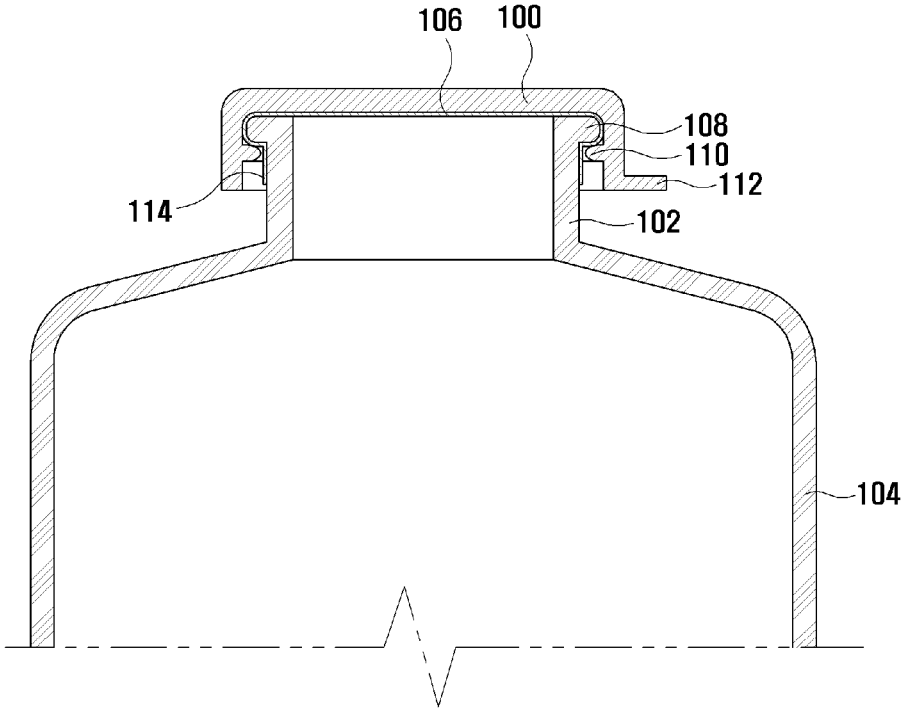
FIG. 1 PRIOR ART
FIG. 1 is a sectional view showing a vessel cap in accordance with the conventional art.
Figure 2:
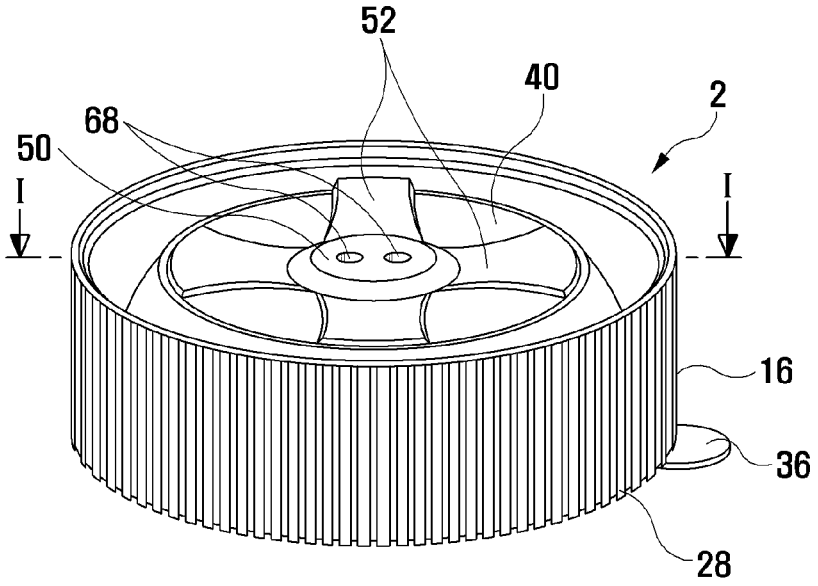
FIG. 2 is a perspective view showing a vessel cap according to the first embodiment of the present invention.
Figure 3:
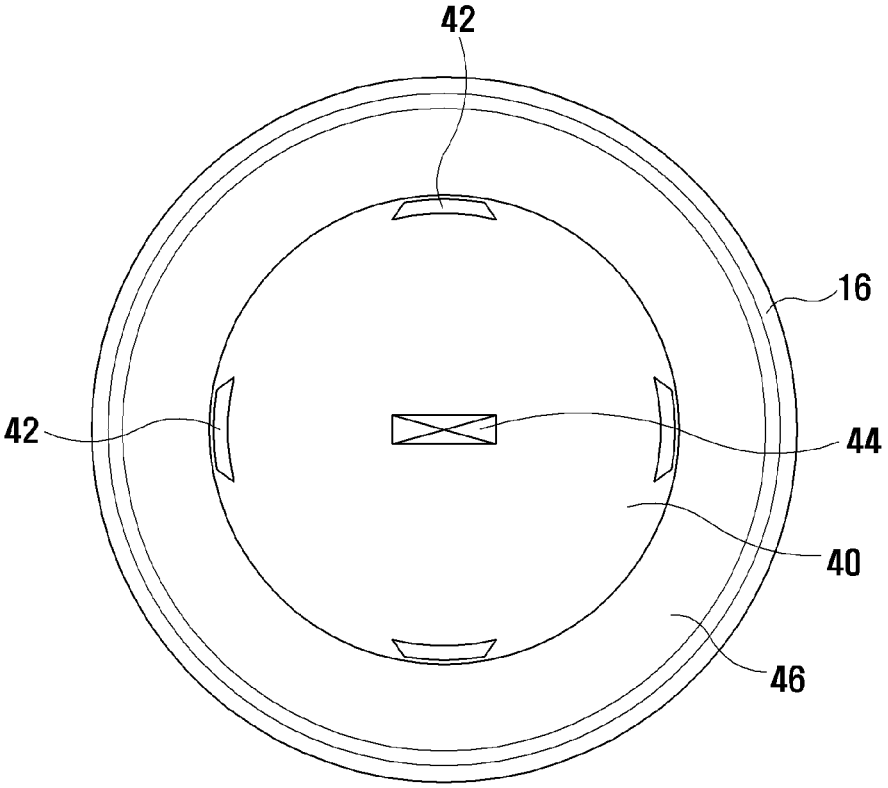
FIG. 3 is a bottom view showing the vessel cap according to the first embodiment of the present invention.
Figure 4:
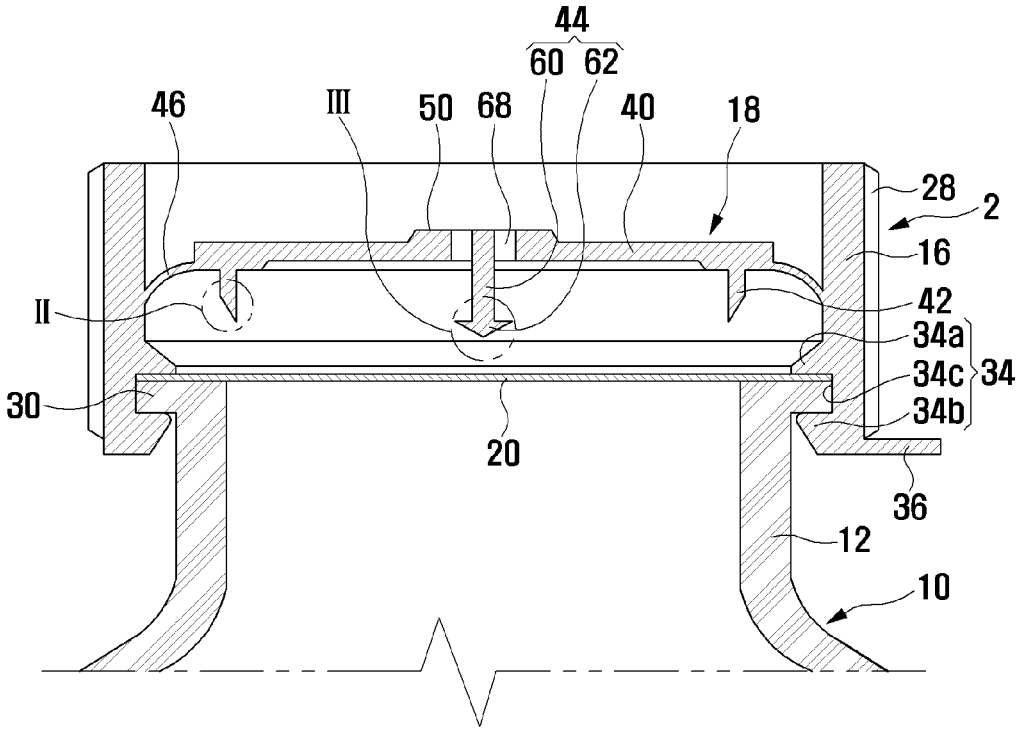
FIG. 4 is a sectional view taken along line I-I of FIG. 2 showing a state that the vessel cap is mounted at a vessel according to the first embodiment of the present invention.

FIG. 2 is a perspective view showing a vessel cap according to the first embodiment of the present invention, FIG. 3 is a bottom view showing the vessel cap according to the first embodiment of the present invention, and FIG. 4 is a sectional view showing a state that the vessel cap is mounted at a vessel according to the first embodiment of the present invention.

A vessel cap 2 according to the first embodiment of the present invention comprises a body 16 mounted at a vessel inlet 12 through which a liquid material stored in a vessel 10 is discharged outwardly and having a certain space therein, and a sealing member removing unit 18 formed in the body 16 for removing a sealing member 20 attached to the vessel inlet 12 when the vessel cap 2 is detached from the vessel inlet 12 and storing the removed sealing member 20 in the vessel cap 2.

The vessel 10 stores a liquid material therein, and the sealing member 20 for sealing the vessel inlet 12 and thus protecting the liquid material is attached to the vessel inlet 12 through which the liquid material is discharged outwardly. Preferably, the sealing member 20 is formed of a material that can be easily removed by a knife, etc. such as paper, an aluminum thin plate, etc.

The body 16 has a cylindrical shape, and a plurality of concave-convex protrusions 28 for facilitating to rotate the vessel cap 2 by a user's hand are formed at an outer circumferential surface of the body 16. A mounting portion 34 detachably mounted at the vessel inlet 12 is formed at a lower portion of the body 16.

The mounting portion 34 comprises two protrusions 34*a* and 34*b* protruding from an inner circumferential surface of a lower end of the body 16 with a certain gap as a belt shape, and a hooking groove 34*c* formed between the two protrusions 34*a* and 34*b* for hooking a hooking jaw 30 formed at an outer circumferential surface of the vessel inlet 12 and thus maintaining a mounted state of the vessel cap 2 to the vessel inlet 12.

A handgrip 36 held by a user and pulled for detaching the body 16 from the vessel inlet 12 is formed at a lower end of the body 16.

Besides the aforementioned structure, a female screw portion is formed at an inner circumferential surface of the body 16 and a male screw portion is formed at the vessel inlet 12, so that the female screw portion is coupled to the male screw portion.

The sealing member removing unit 18 comprises a pressing plate 40 disposed in the body 16 to be movable in upper and lower directions and pressed by a user, a cutter 42 formed at an edge of a lower surface of the pressing plate 40 in a circumferential direction with the same gap for penetrating a sealing member 20 when the pressing plate 40 is pressed and cutting the sealing member 20 when the body 16 is rotated, a hooking member 44 downwardly protruding at the lower surface of the pressing plate 40 for storing the sealing member cut by the cutter 42 in the body 16, and a connection portion 46 formed between an outer circumferential surface of the pressing plate 40 and an inner circumferential surface of the body 16 for guiding the pressing plate 40 to be moved in upper and lower directions.

The pressing plate 40 is formed as a disc shape having a diameter smaller than an inner diameter of the body 16, and a pressing portion 50 pressed by the user's hand is protruding from a center of an upper surface of the pressing plate 40. A plurality of reinforcing ribs 52 are radially formed at an outer circumferential surface of the pressing portion 50.

The reinforcing rib 52 reinforces an intensity of the pressing plate 40 thereby to evenly distribute a force applied to press the pressing portion 50 onto the pressing plate 40. That is, the reinforcing rib 52 allows the pressing plate 49 pressed by the user to be entirely lowered so that the plural cutters 42 can penetrate the sealing member 20. Preferably, the number of the reinforcing ribs 52 is equal to the number of the cutters 42.

Figure 5:
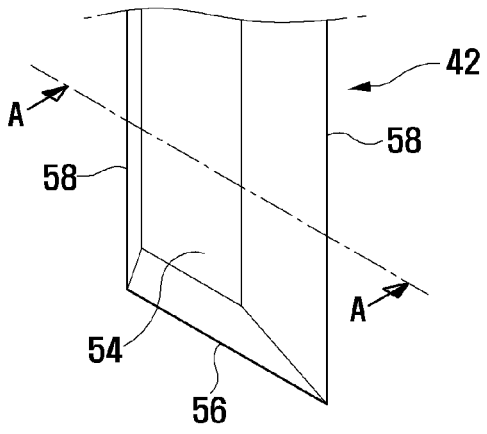
FIG. 5 is a perspective view of 'II' part of FIG. 2 showing a cutter according to the first embodiment of the present invention.
Figure 6:
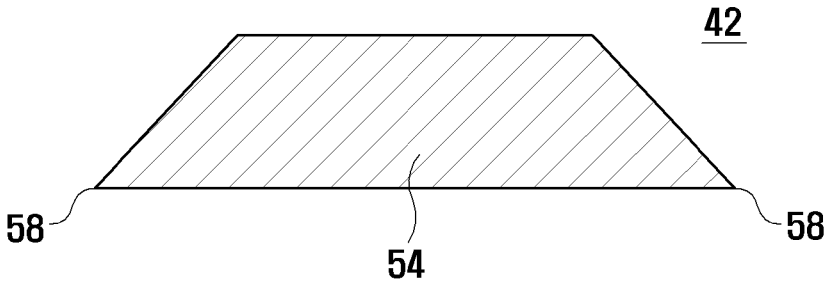
FIG. 6 is a sectional view taken along line A-A of FIG. 5.

As shown in FIGS. 5 and 6, the cutter 42 comprises a plurality of supporting portions 54 formed at an edge of a lower surface of the pressing plate 40 with the same gap, a first cutting portion 56 sharply formed at a lower end of the supporting portion 54 and downwardly moved when the pressing plate 40 is pressed for penetrating the sealing member 20, and a second cutting portion 58 formed on at least one side surface of both side surfaces of the supporting portion 54 and contacting an inner circumferential surface of the vessel inlet 12 when the body is rotated for cutting the sealing member 20 as a circular shape.

The supporting portion 54 has a sectional surface of a trapezoid shape, and protrusions sharply protruding from both sides of the sectional surface form the second cutting portion 58. The supporting portion 54 is more inclined towards a center of the body 16 as it is closer to a lower end thereof. Accordingly, when the pressing portion 50 is pressed, the cutter 42 is prevented from coming in contact with the vessel inlet 12.

The first cutting portion 56 is inclined towards an inner surface of the supporting portion 54 from an outer surface of the supporting portion 54, thereby preventing the cutter 42 from being hooked at the vessel inlet 12 when the cutter 42 is lowered.

Figure 7:
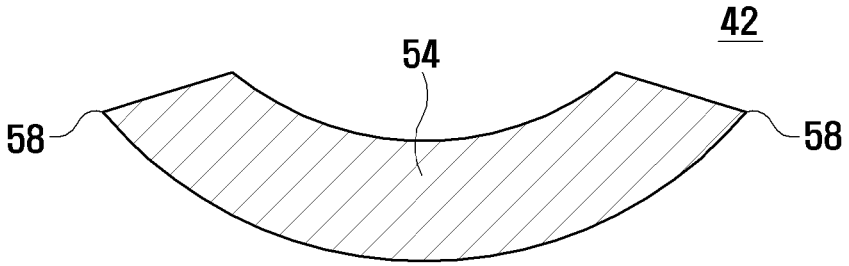
FIGS. 7 and 8 are sectional views showing the cutter according to other embodiments of the present invention.
Figure 8:
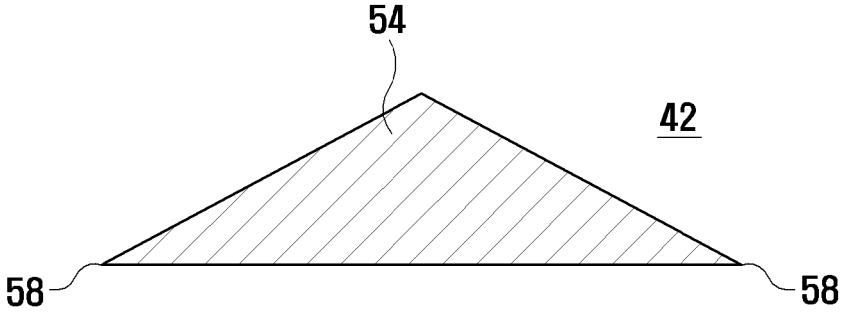

Referring to FIG. 7, the cutter 42 can be formed as a curve shape having the same curvature radius as that of an inner circumferential surface of the vessel inlet 12. Referring to FIG. 8, the cutter 42 can have a sectional surface of a triangular shape.

It is also possible that the first cutting portion 56 is formed at a lower surface of the cutter 42 and the second cutting portion 58 is formed on at least one side surface of both side surfaces.

Figure 9:
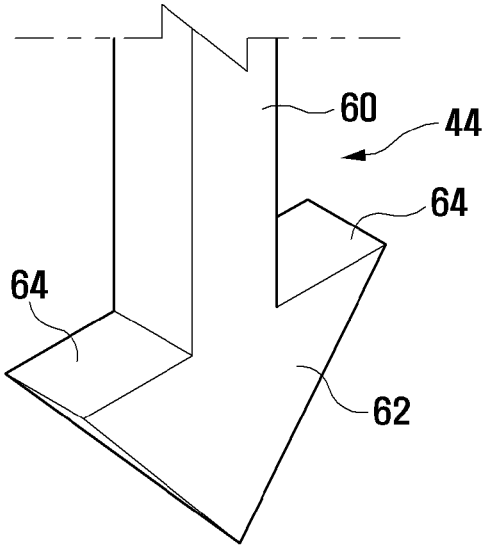
FIG. 9 is a perspective view of 'III' part of FIG. 2 showing a hooking member according to the first embodiment of the present invention.

As shown in FIG. 9, the hooking member comprises a rod 60 downwardly extending from a center of a lower surface of the pressing plate 40, and a hooking portion 62 formed at an end of the rod 60 for penetrating the sealing member 20 when the pressing plate 40 is pressed and for hooking the sealing member 20 so that the cut sealing member 20 can be stored in the body 16 when the body 16 is detached from the vessel inlet 12.

The hooking portion 62 has a triangular shape and a sharp end for penetrating the sealing member 20. An upper surface 64 of the hooking portion 62 is perpendicularly extending from an end of the rod towards both sides, thereby hooking a lower surface of the sealing member 20.

A pin hole 68 for passing a molding tool to mold the hooking portion 62 at the time of molding the vessel inlet 2 is formed at the pressing plate 40.

When the pressing plate 40 is lowered, the hooking member 44 is together lowered and thus the hooking portion 62 penetrates the sealing member 20. When the body 16 is rotated by an angle of 90° or 270° the sealing member 20 is hooked at an upper surface 64 of the hooking portion 62.

Figure 10:
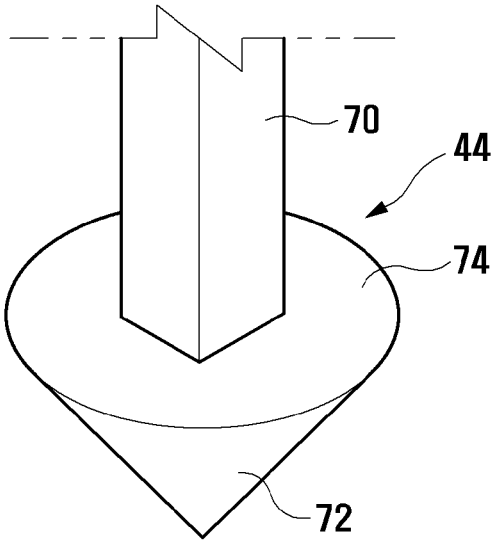
FIG. 10 is a perspective view showing the hooking member according to other embodiments of the present invention.

Referring to FIG. 10, the hooking member 44 is formed as a conical shape, and a sharp end thereof penetrates the sealing member 20. The sealing member 20 is hooked at a circular upper surface 74 of the hooking member 44.

The connection portion 46 is formed between an outer circumferential surface of the pressing plate 40 and an inner circumferential surface of the body 16 as a thin film having a dome shape. Also, the connection portion 46 is elastically transformed when the pressing plate 40 is pressed by a force more than a certain degree, thereby guiding the pressing plate 40 to be moved in a lower direction.

The connection portion 46 elastically maintains a current position of the pressing plate 40. That is, when the pressing plate 40 is upwardly protruding, the connection portion 46 has a convex dome shape and maintains the current state of the pressing plate 40. However, when the pressing plate 40 is pressed by a force more than a certain degree, the connection portion 46 is elastically transformed into a concave shape and maintains the pressed state of the pressing plate 40.

An operation of the vessel cap according to the present invention will be explained.

Figure 11:
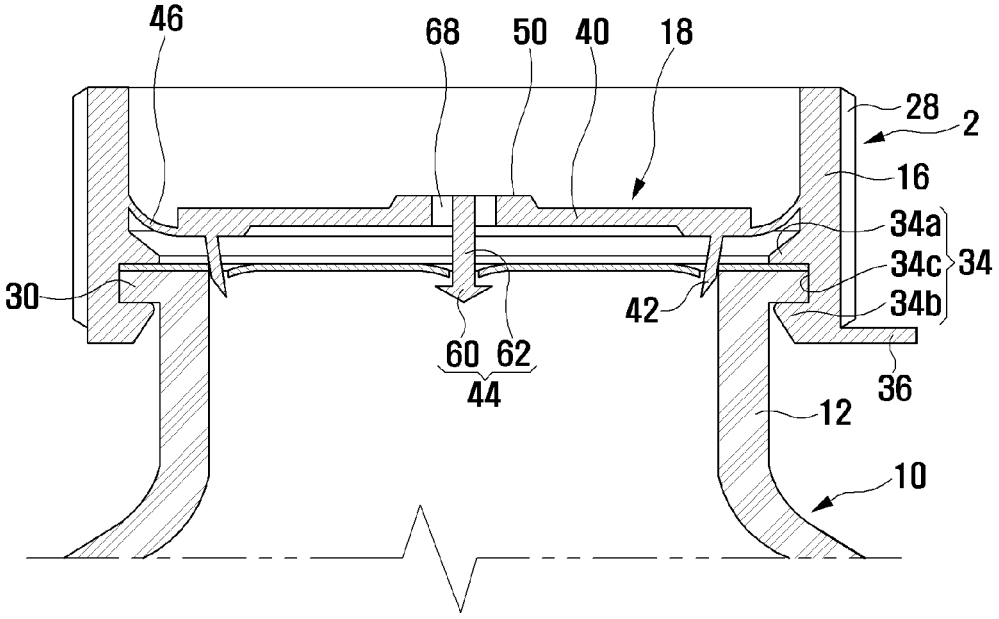
FIGS. 11 and 12 are sectional views taken along line I-I of FIG. 2 showing an operation of a vessel cap according to the present invention.
Figure 12:
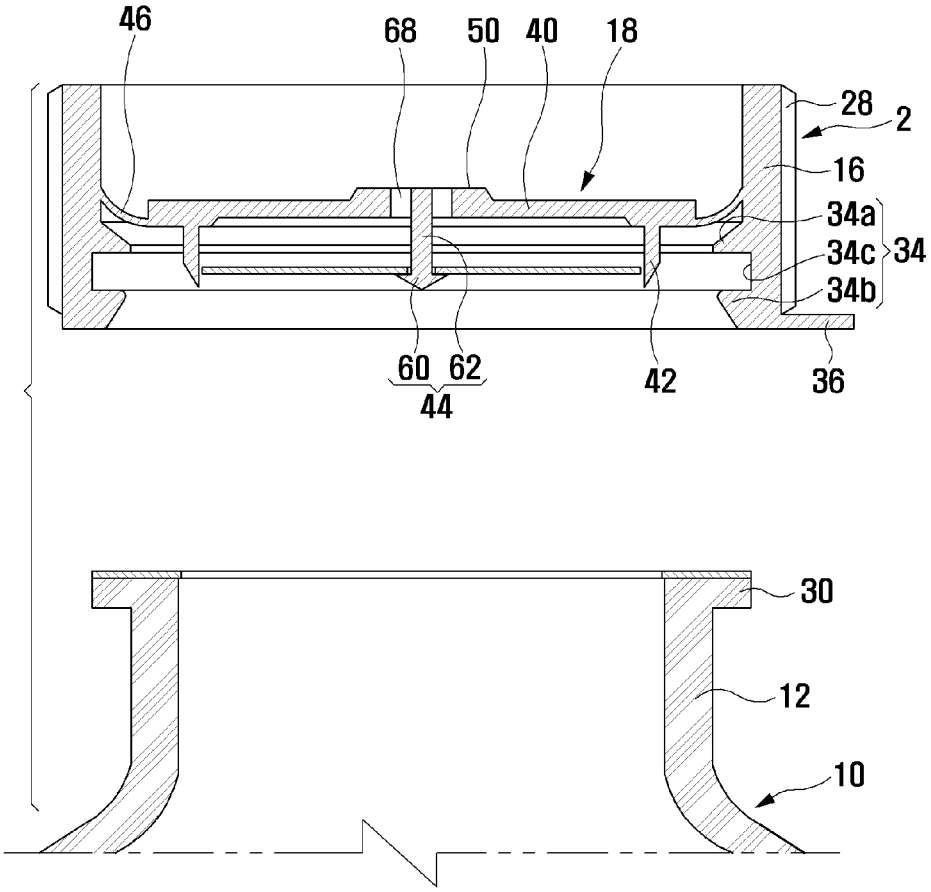

FIGS. 11 and 12 are views showing an operation of the vessel cap according to the present invention.

When the pressing plate 40 is downwardly pressed in order to discharge the liquid material stored in the vessel 10 outwardly, the connection portion 42 is elastically transformed and the pressing plate 40 is downwardly moved. Then, the first cutting portion 56 of the cutter 42 formed at a lower surface of the pressing plate 44 penetrates an edge of the sealing member 20, and the hooking member 44 penetrates a center of the sealing member 20.

Then, if the body 16 is rotated by the user's hand, the cutter 42 is rotated under a contact state to an inner circumferential surface of the vessel inlet 12. Accordingly, the second cutting portion 58 formed at both side surfaces of the supporting portion 54 cuts the sealing member 20 as a circular shape. Herein, the hooking member 44 is together rotated, so that the upper surface 64 of the hooking portion 62 is positioned at a lower surface of the sealing member 20.

When the handgrip 36 formed at the body 16 is upwardly pulled, the hooking jaw 30 formed at an upper surface of the vessel inlet 12 is detached from the hooking groove 32 formed at an inner circumferential surface of the body 16. Accordingly, the vessel cap 2 is detached from the vessel inlet 12.

Since the sealing member 20 that has been removed from the vessel inlet 12 is hooked at the hooking member 44, it is detached from the vessel inlet 12 together with the body 16 thus to be stored in the body 16.

Figure 13:
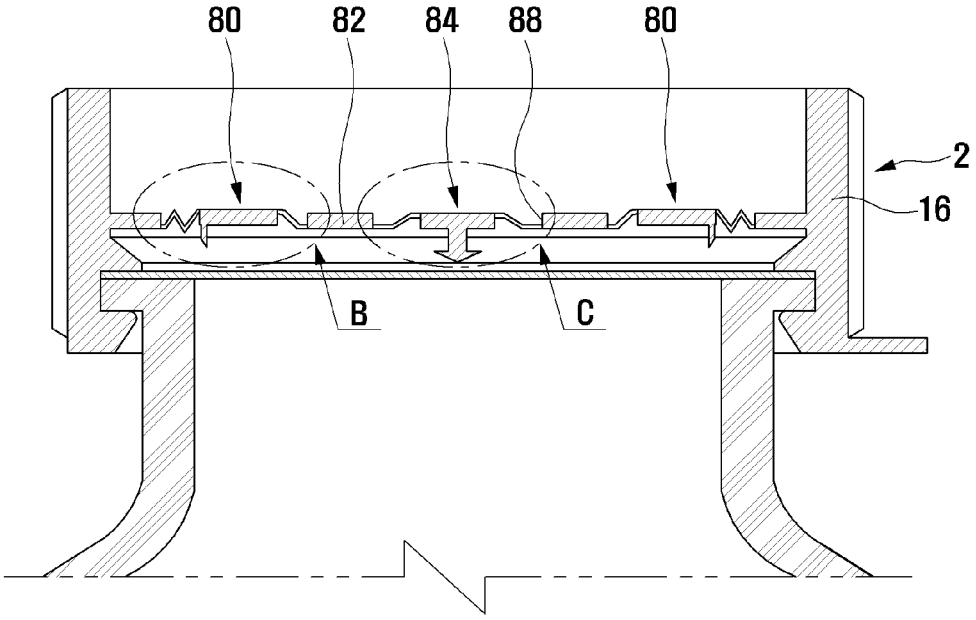
FIG. 13 is a sectional view showing a vessel cap according to the second embodiment of the present invention.

FIG. 13 is a sectional view showing a vessel cap according to the second embodiment of the present invention.

The vessel cap according to the second embodiment is applied to a vessel having a vessel inlet 12 of a comparatively large size. A plurality of sealing member removing units 80 are disposed in the body 16 in a circumferential direction. Also, a hooking unit 84 for storing the removed sealing member in the body is installed at the center of the body 16.

That is, in the vessel cap 2 of the second embodiment, a partition plate 82 is formed at an inner circumferential surface of the body 16, and at least two mounting holes 86 are formed at the partition plate 82 in a circumferential direction. The sealing member removing unit 80 is formed at each mounting hole 86.

A mounting hole 88 is formed at a center of the partition plate 82, and the hooking unit 84 is installed at the mounting hole 88.

Figure 14:
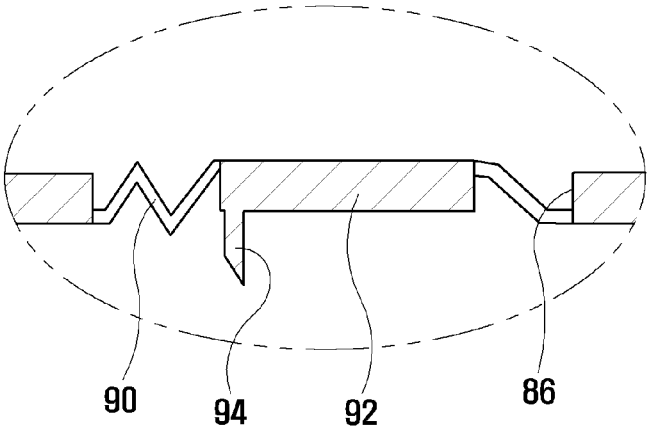
FIG. 14 is an enlarged view showing a part of 'B' of FIG. 13.

As shown in FIG. 14, the sealing member removing unit 80 comprises a connection portion 90 formed at an inner circumferential surface of the mounting hole 86 as a flexible bellows type, a pressing plate 92 mounted at an inner circumferential surface of the connection portion 90 and pressed by the user, and a cutter 94 formed at a lower surface of the pressing plate 92 for cutting the sealing member 20.

A width T1 of the connection portion 90 positioned at an edge of the partition plate 82 is wider than a width T2 of the connection portion 90 positioned at an inner side of the partition plate 82, so that the pressing plate 82 is pressed with an inclined state.

The pressing plate 92 is formed as a flat plate of a triangular shape so as to be easily pressed with an inclined state.

One cutter 94 is formed at a lower surface of the pressing plate 92, and has the same shape as that of the aforementioned cutting portion.

Figure 15:
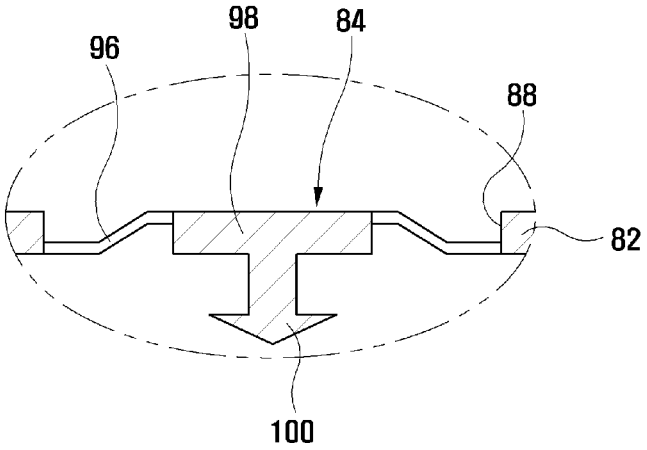
FIG. 15 is an enlarged view showing a part of 'C' of FIG. 13.

As shown in FIG. 15, the hooking unit 84 comprises a connection portion 96 formed at an inner circumferential surface of the mounting hole 88, a pressing plate 98 mounted at an inner circumferential surface of the connection portion 96 and pressed by the user, and a hooking member 100 formed at a lower surface of the pressing plate 98 for penetrating the sealing member 20 and hooking the sealing member 20.

The connection portion 96 and the hooking member 100 have the same structure and operation as those of the aforementioned connection portion and the hooking member, and thus a detail explanation thereof will be omitted.

Figure 16:
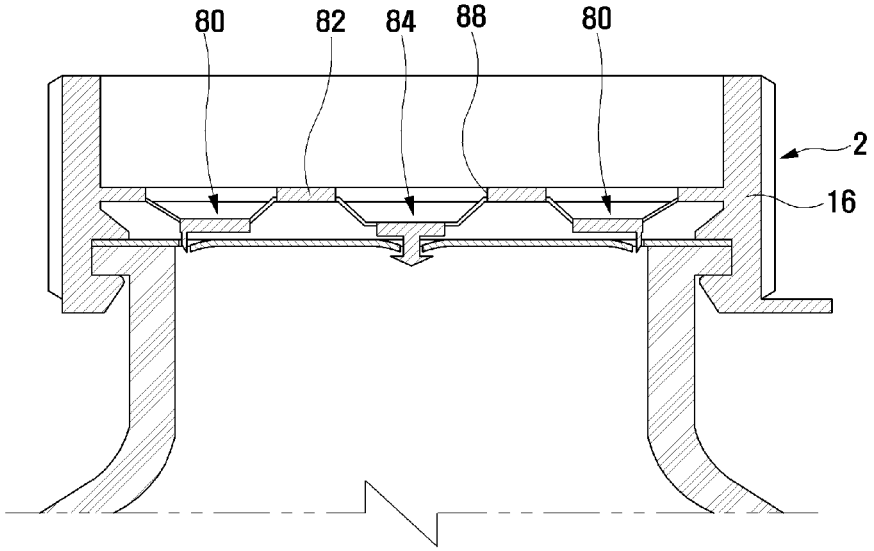
FIG. 16 is a view showing an operation of the vessel cap according to the second embodiment of the present invention.

FIG. 16 is a view showing an operation of a vessel cap according to the second embodiment of the present invention.

An operation of the vessel cap according to the second embodiment of the present invention will be explained. When the user downwardly presses the pressing plate 92 of each sealing member removing unit 80 mounted at the partition plate 82 in a circumferential direction, the connection portion 90 is elastically transformed and the pressing plate 92 is downwardly moved. Accordingly, the cutter 94 formed at a lower surface of the pressing plate 92 penetrates the edge of the sealing member 20.

When the user presses the pressing plate 98 of the hooking unit 84 disposed at the center of the partition plate 82, the hooking member 100 mounted at a lower surface of the pressing plate 98 penetrates the center of the sealing member 20.

Under the state, if the vessel cap is rotated, the cutter 90 cuts the edge of the sealing member 20, and the hooking member 100 is rotated thereby to hook the lower surface of the sealing member 20.

When the body 16 is detached from the vessel inlet 12, the sealing member 20 is stored in the body 15 under a hooked state by the hooking member 20.

Figure 17:
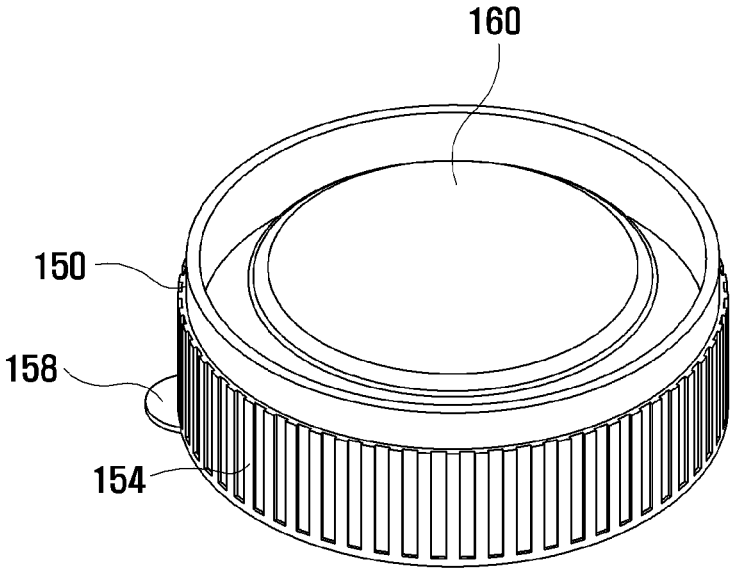
FIG. 17 is a perspective view showing a vessel cap according to the third embodiment of the present invention.
Figure 18:
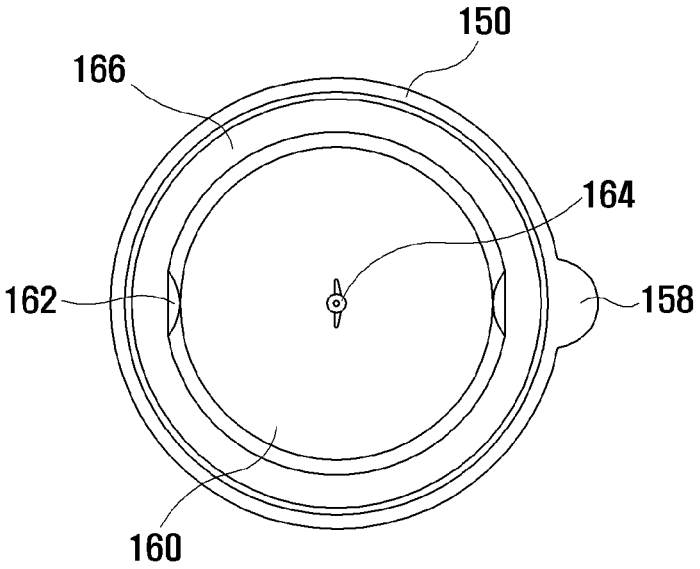
FIG. 18 is a bottom view showing the vessel cap according to the third embodiment of the present invention.
Figure 19:
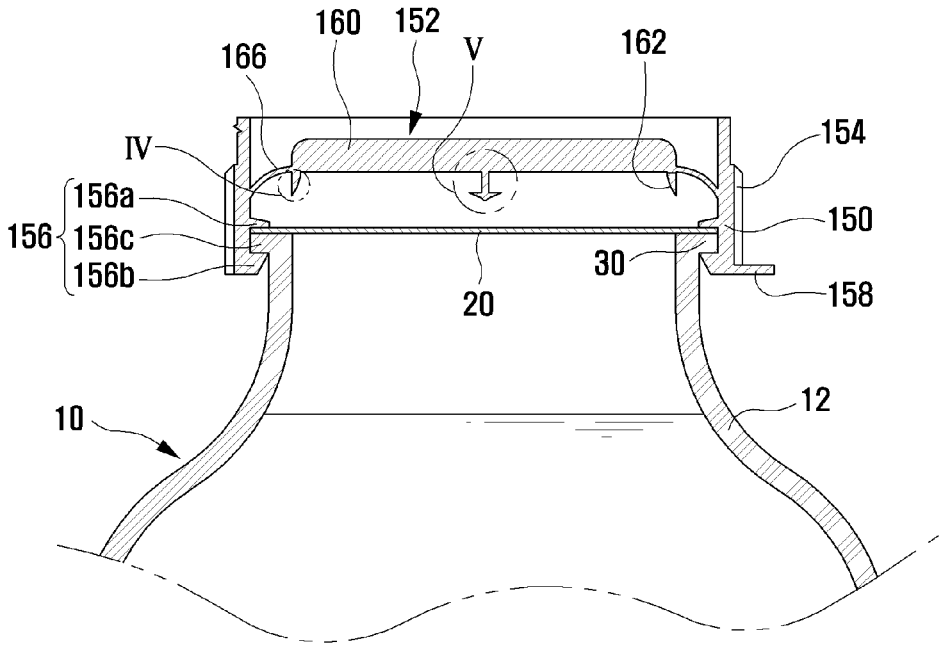
FIG. 19 is a sectional view showing a state that the vessel cap is mounted at a vessel according to the third embodiment of the present invention.
Figure 19B:
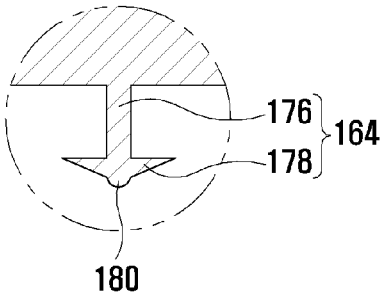
FIG. 19B is an enlarged sectional view of 'V' part of FIG. 19.

FIG. 17 is a perspective view showing a vessel cap according to the third embodiment of the present invention, FIG. 18 is a bottom view showing the vessel cap according to the third embodiment of the present invention, and FIG. 19 is a sectional view showing a state that the vessel cap is mounted at a vessel according to the third embodiment of the present invention.

The vessel cap according to the third embodiment of the present invention comprises a body 150 mounted at a vessel inlet 12 through which a liquid material stored in a vessel 10 is discharged outwardly and having a certain space therein, and a sealing member removing unit 152 formed in the body 150 for removing a sealing member 20 attached to the vessel inlet 12 when the vessel cap is detached from the vessel inlet 12 and storing the removed sealing member 20 in the vessel cap.

The body 150 has a cylindrical shape, and a plurality of concave-convex protrusions 154 for facilitating to rotate the vessel cap by a user's hand are formed at an outer circumferential surface of the body 150. A mounting portion 156 detachably mounted at the vessel inlet 12 is formed at a lower portion of the body 150.

The mounting portion 156 comprises two protrusions 156*a* and 156*b* protruding from an inner circumferential surface of a lower end of the body 150 with a certain gap as a belt shape, and a hooking groove 156*c* formed between the two protrusions 156*a* and 156*b* for hooking a hooking jaw 30 formed at an outer circumferential surface of the vessel inlet 12 and thus maintaining a mounted state of the vessel cap to the vessel inlet 12.

A handgrip 158 held by a user and pulled for detaching the body 150 from the vessel inlet 12 is formed at a lower end of the body 150.

Besides the above structure of the mounting portion 156, a female screw portion is formed at an inner circumferential surface of the body 150 and a male screw portion is formed at the vessel inlet 12, so that the female screw portion is coupled to the male screw portion. That is, if the body 150 is rotated by the user's hand, the vessel cap is detached from the vessel inlet 12. The mounting portion 156 can have any structure only if it can be detachably mounted at the vessel inlet.

The sealing member removing unit 152 comprises a pressing plate 160 disposed in the body 150 to be movable in upper and lower directions and pressed by the user, a cutter 162 formed at an edge of a lower surface of the pressing plate 160 in a circumferential direction with the same gap for penetrating a sealing member 20 when the pressing plate 160 is pressed and cutting the sealing member 20 when the body 150 is rotated, a hooking portion 164 downwardly protruding at the lower surface of the pressing plate 160 for hooking the sealing member and storing the sealing member cut by the cutter 162 in the body 150, and a connection portion 166 formed between an outer circumferential surface of the pressing plate 160 and an inner circumferential surface of the body 150 for guiding the pressing plate 160 to be moved in upper and lower directions and supporting a moved position of the pressing plate 160 by its elastic force.

The pressing plate 160 is formed as a disc shape having a diameter smaller than an inner diameter of the body 150, and is disposed at a position lower than an upper surface of the body 150. A cover (not shown) for protecting the pressing plate 160 can be mounted at the upper surface of the body 150.

Figure 20:
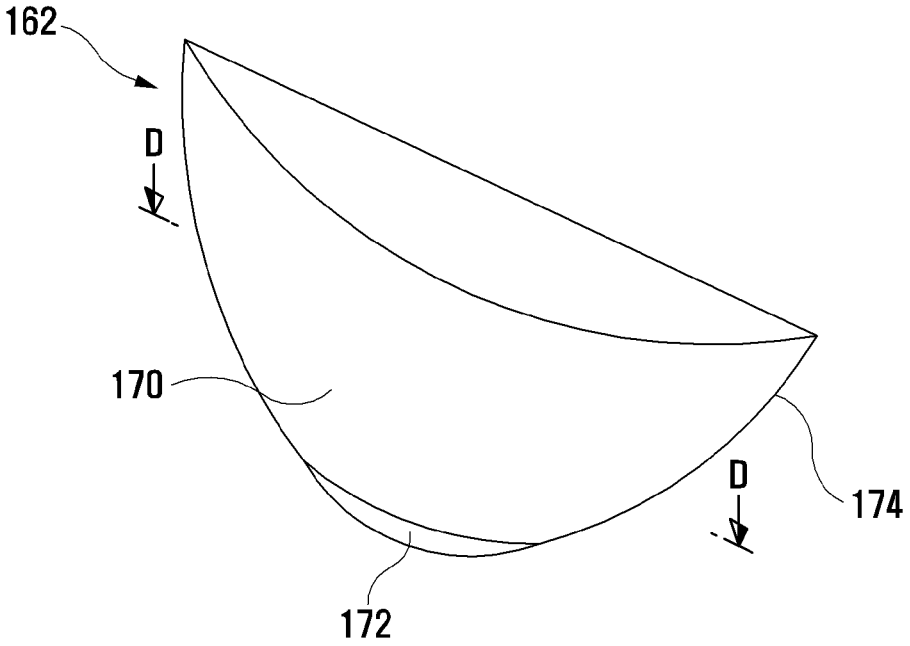
FIG. 20 is a perspective view of 'IV' part of FIG. 19 showing a part of the cutter according to the third embodiment of the present invention.
Figure 21:
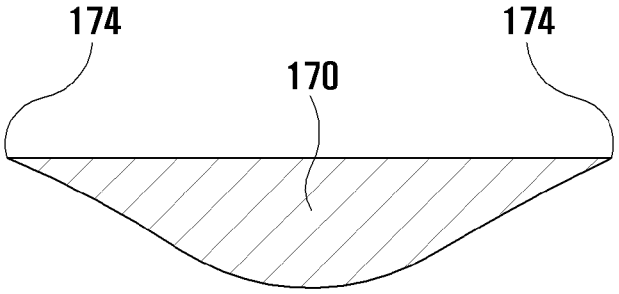
FIG. 21 is a sectional view taken along line D-D of FIG. 20.

As shown in FIGS. 20 and 21, the cutter 162 comprises a plurality of supporting portions 170 formed at an edge of a lower surface of the pressing plate 160 with the same gap, a first cutting portion 172 sharply formed at a lower end of the supporting portion 170 and downwardly moved for penetrating the sealing member 20 when the pressing plate 160 is pressed, and a second cutting portion 174 formed on at least one side surface of both side surfaces of the supporting portion 170 and rotated under a contact state to an inner circumferential surface of the vessel inlet 12 for cutting the sealing member 20 as a circular shape when the body 150 is rotated.

The supporting portion 170 has a sectional surface of a trapezoid shape, and protrusions sharply protruding from both sides of the sectional surface form the second cutting portion 174. The supporting portion 170 is more inclined towards a center of the body 150 as it is closer to a lower end thereof. Accordingly, when the pressing portion 160 is downwardly pressed, the cutter 162 is prevented from coming in contact with the vessel inlet 12.

The first cutting portion 172 is inclined towards an inner surface of the supporting portion 170 from an outer surface of the supporting portion 170, thereby preventing the cutter 162 from being hooked at the vessel inlet 12 when the cutter 162 is lowered.

The connection portion 166 is formed between an outer circumferential surface of the pressing plate 160 and an inner circumferential surface of the body 150 as a thin film having a dome shape. Also, the connection portion 166 is elastically transformed when the pressing plate 160 is pressed by a force more than a certain degree, thereby guiding the pressing plate 160 to be moved in a lower direction.

The connection portion 166 elastically maintains a current position of the pressing plate 160. That is, when the pressing plate 160 is upwardly protruding, the connection portion 166 has a convex dome shape and maintains the current state of the pressing plate 160. However, when the pressing plate 160 is pressed by a force more than a certain degree, the connection portion 166 is elastically transformed into a concave shape and maintains the pressed state of the pressing plate 160.

Figure 22:
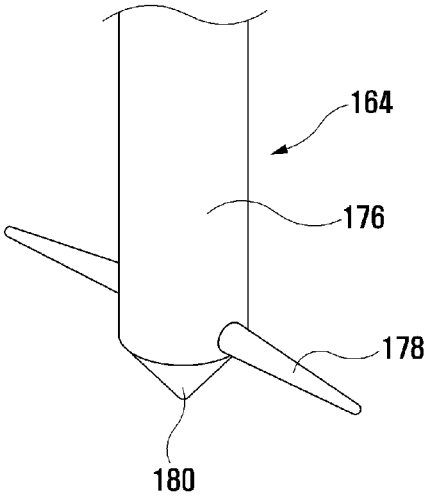
FIG. 22 is a perspective view of 'V' part of FIG. 2 showing a part of the hooking portion according to the third embodiment of the present invention.

As shown in FIG. 22, the hooking member 44 comprises a supporting rod 176 downwardly extending from the center of the lower surface of the pressing plate 160 for penetrating the sealing member 20 when the pressing plate 160 is pressed, and at least one hooking protrusion 178 formed at an outer circumferential surface of the end of the supporting rod 176 for hooking the sealing member 20 so as to store the sealing member cut by the cutter 162 in the body 150.

The supporting rod 176 is formed as a bar shape perpendicularly extending from the center of the pressing plate 160 downwardly, and a punch portion 180 having a sharp shape to penetrate the sealing member 20 is formed at the end of the supporting rod 176.

The supporting protrusion 178 formed to be elastically transformed is upwardly bent at the time of penetrating the sealing member 20. Then, the supporting protrusion 178 passes through a hole formed by the punch portion 180 thus to penetrate the sealing member 20. After the supporting protrusion 178 is positioned at an inner side of the sealing member 20, it is extended into the original state thereby to be hooked at an inner surface of the sealing member 20.

At least one hooking protrusion 178 is perpendicularly extending from an outer circumferential surface of the supporting rod 176 with a certain length. Preferably, a pair of hooking protrusions 178 are formed at the outer circumferential surface of the supporting rod 176 with an angle of 180°.

An operation of the vessel cap according to the present invention will be explained.

Figure 23:
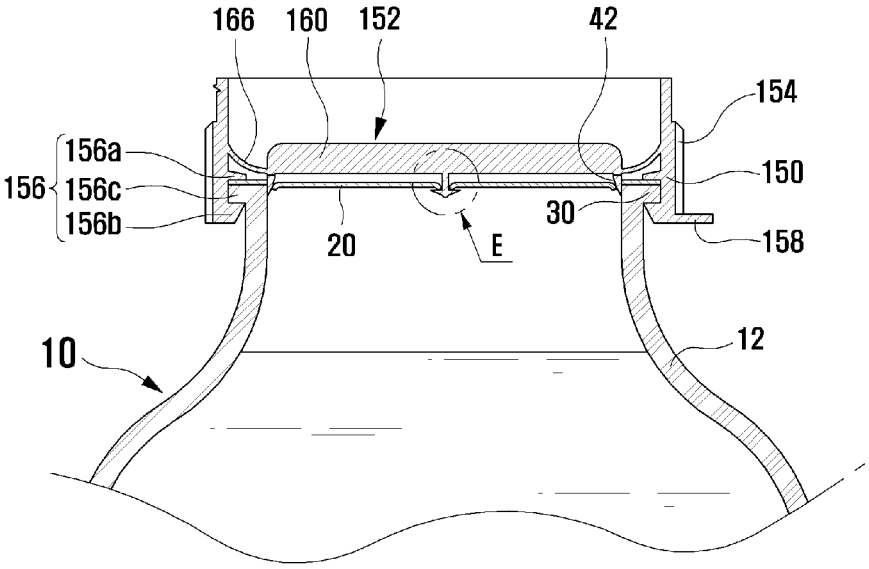
FIG. 23 is a view showing an operation of the vessel cap according to the third embodiment of the present invention.
Figure 24:
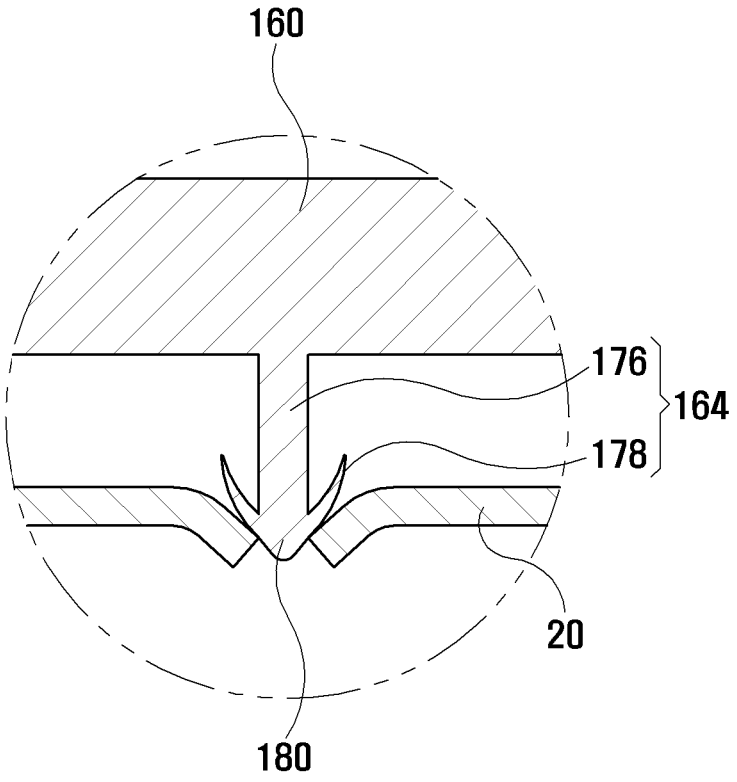
FIG. 24 is an enlarged view showing a part of 'E' of FIG. 23.
Figure 25:
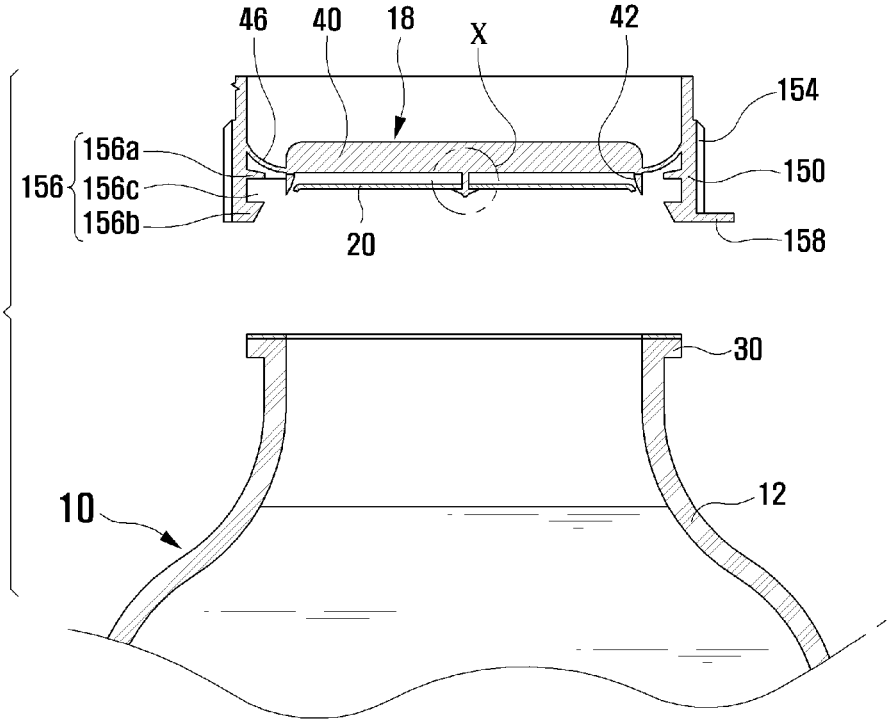
FIG. 25 is a view showing an operation that the vessel cap is detached from a vessel according to the third embodiment of the present invention.
Figure 25B:
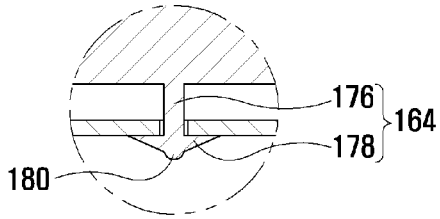
FIG. 25B is an enlarged sectional view of 'X' part of FIG. 25.

FIGS. 23 to 25 are views showing an operation of the vessel cap according to the third embodiment of the present invention.

When the pressing plate 160 is downwardly pressed in order to discharge the liquid material stored in the vessel 10 outwardly, the connection portion 166 is elastically transformed and the pressing plate 160 is downwardly moved. Then, the first cutting portion 172 of the cutter 162 formed at a lower surface of the pressing plate 160 penetrates an edge of the sealing member 20, and the supporting rod 176 of the hooking portion 164 penetrates a center of the sealing member 20.

The hooking protrusion 178 of the hooking member 164 is upwardly bent at the time of penetrating the sealing member 20, and passes through a hole formed by the punch portion 180 of the supporting rod 176. After the supporting protrusion 178 is positioned at an inner side of the sealing member 20, it is extended into the original state thereby to be hooked at an inner surface of the sealing member 20.

Then, if the body 150 is rotated by the user's hand, the cutter 162 is rotated under a contact state to an inner circumferential surface of the vessel inlet 12. Accordingly, the second cutting portion 174 formed at both side surfaces of the supporting portion 170 cuts the sealing member 20 as a circular shape.

When the handgrip 158 formed at the body 150 is upwardly pulled, the hooking jaw 30 formed at an upper surface of the vessel inlet 12 is detached from the hooking groove 156*c* formed at an inner circumferential surface of the body 150. Accordingly, the vessel cap is detached from the vessel inlet 12.

Since the sealing member 20 that has been removed from the vessel inlet 12 is hooked at the hooking protrusion 178 of the hooking member 164, it is detached from the vessel inlet 12 together with the body 150 thus to be stored in the body 150.

Figure 26:
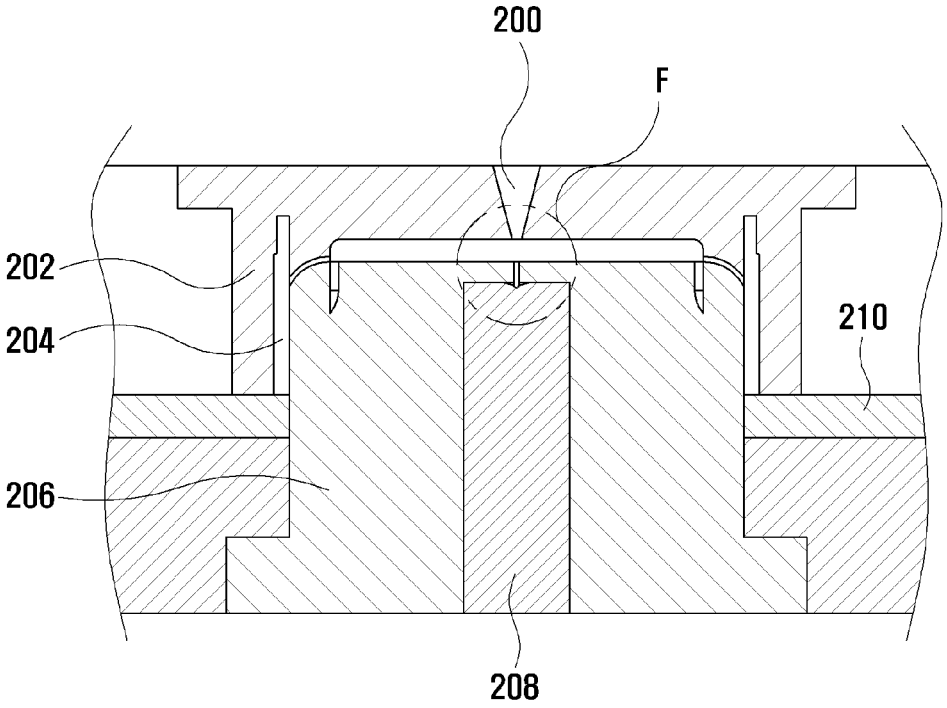
FIG. 26 is a sectional view showing a part of the system for manufacturing the vessel cap according to the third embodiment of the present invention.
Figure 27:
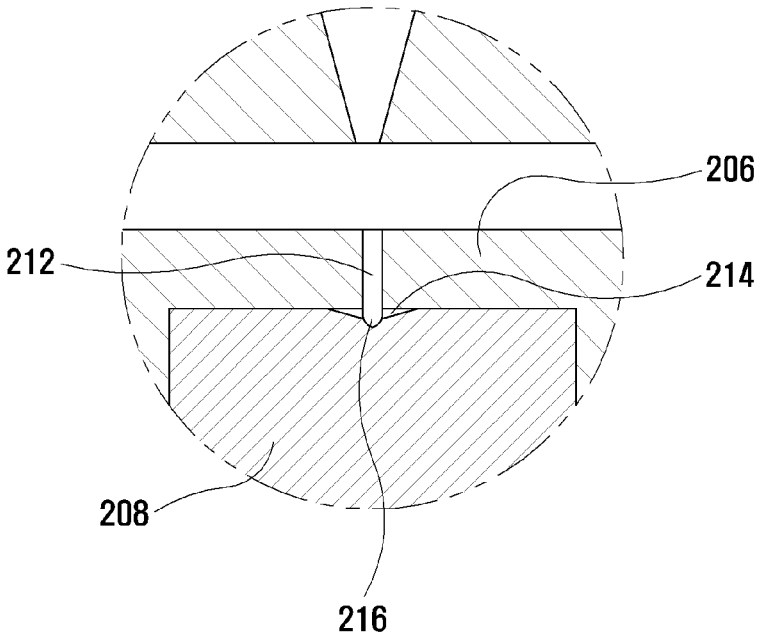
FIG. 27 is an enlarged view showing a part of 'F' of FIG. 26.
Figure 28:
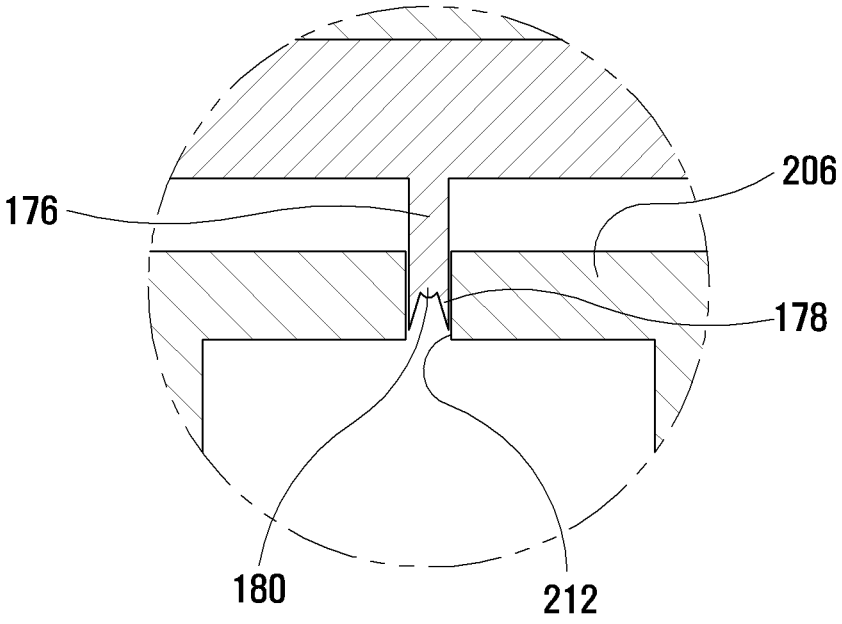
FIG. 28 is an enlarged view showing an operation of the system for manufacturing the vessel cap according to the third embodiment of the present invention.

FIG. 26 is a sectional view showing a system for manufacturing the vessel cap according to the third embodiment of the present invention, FIG. 27 is an enlarged view showing a part of 'F' of FIG. 26, and FIG. 28 is an enlarged view showing an operation of the system for manufacturing the vessel cap according to the third embodiment of the present invention.

A system for manufacturing a vessel cap according to the third embodiment of the present invention serves to mold a vessel cap. The system comprises a first core 202 having an inlet 200 through which a molding material is injected and positioned at an upper side, a second core 206 disposed at a lower side of the first core 202 and having a cavity 204 for forming a vessel cap between the first core 202, a third core 208 inserted into a center of the second core 206 for forming a hooking protrusion 178 of a vessel cap, and a stripper plate 210 disposed between the first core 202 and the second core 206 for separating a molded vessel cap from the first core and the second core.

The cavity 204 having a shape of the vessel cap and into which the molding material is injected is formed between the first core 202 and the second core 206.

A supporting rod molding portion 212 for molding the supporting rod 176 of the vessel cap is formed at the center of the second core 206. A hooking protrusion molding portion 214 for molding the hooking protrusion 178 extending to an outer side of the supporting rod 176, and a punch molding portion 216 for molding the punch portion 180 formed at the end of the supporting rod 178 are formed at an upper end of the third core 208.

Since the hooking protrusion 178 is horizontally extending from the supporting rod 176, it is hooked at the first core and the second core when the molding material is detached from the cores after molding the vessel cap. To solve the problem, the hooking protrusion molding portion 214 is formed at the third core 208 and the third core 208 is separated from the second core 206. As the result, a lower portion of the molded hooking protrusion 178 becomes free. Under the state, if the hooking protrusion 178 is instantaneously inserted into the supporting rod molding portion 212, the hooking protrusion 178 passes through the supporting rod molding portion 212 with being bent downwardly. Then, the hooking protrusion 212 is elastically restored into the original state.

A process for manufacturing a vessel cap by the system according to the first embodiment of the present invention will be explained.

A molding material is injected into the cavity 204 formed between each core 202, 206, and 208 through the inlet 200 formed at the first core 202.

When the vessel cap is completed, the first core 202 is upwardly pulled. Then, the third core 208 is downwardly detached from the second core 206, and the stripper plate 210 is upwardly moved, thereby detaching the vessel cap from the second core 206.

When the third core 208 is detached from the second core 206, the lower portion of the hooking protrusion 178 becomes free. Accordingly, when the hooking protrusion 178 formed to be elastically transformed is instantaneously inserted into the supporting rod molding portion 212 of the second core 206, it passes through the supporting rod molding portion 212 with being bent. After the hooking protrusion 178 passes through the supporting rod molding portion 212, it is elastically transformed thus to be restored into the original state.

Figure 29:
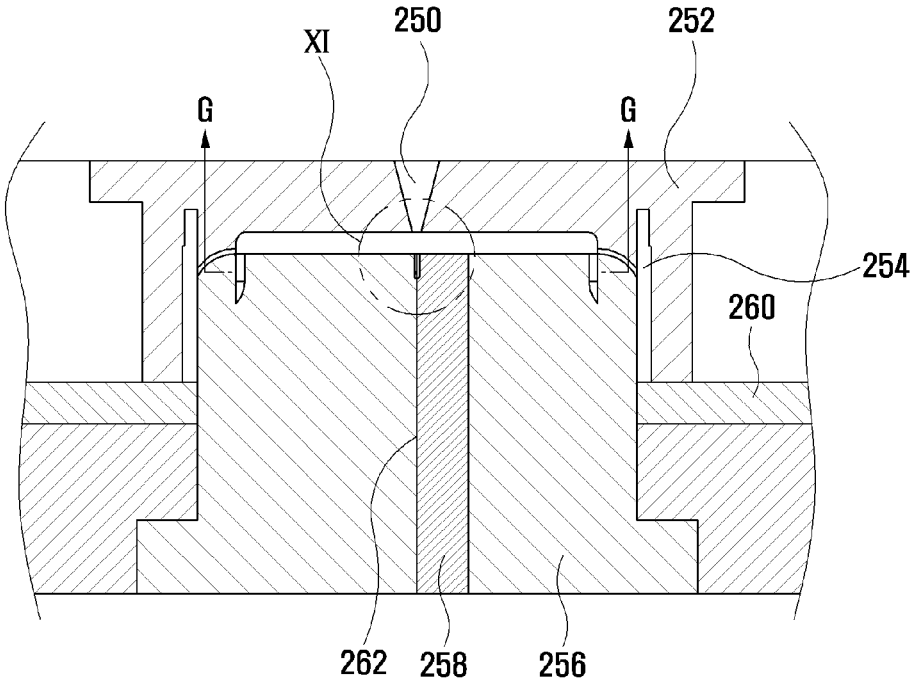
FIG. 29 is a sectional view showing the system for manufacturing the vessel cap of the third embodiment according to other embodiments of the present invention.
Figure 29B:
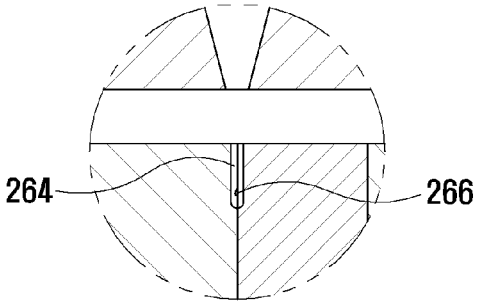
FIG. 29B is an enlarged sectional view of 'XI' part of FIG. 29.
Figure 30:
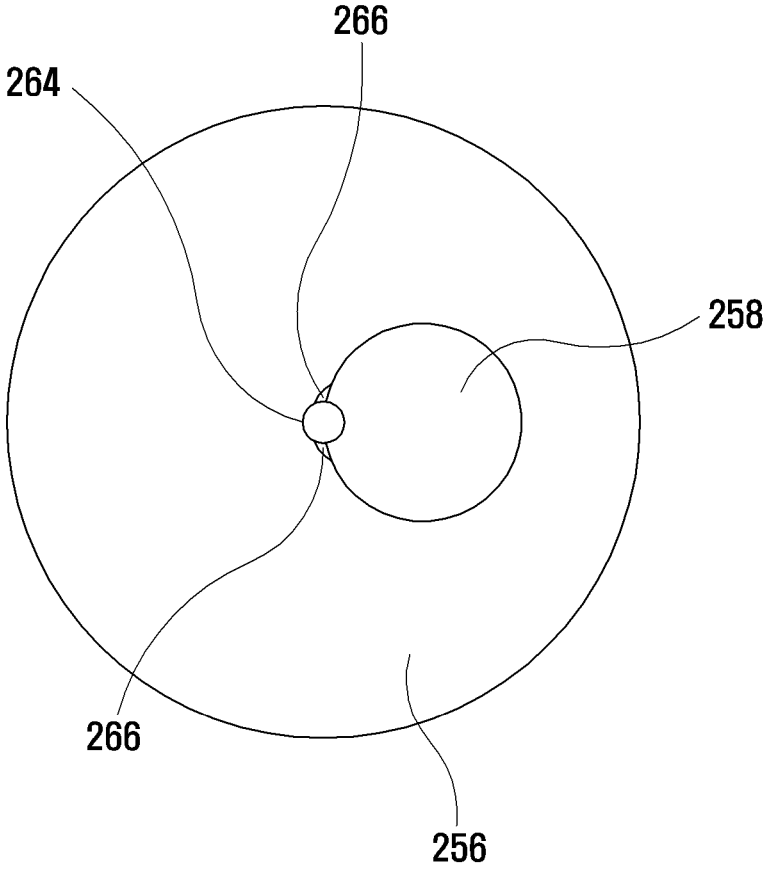
FIG. 30 is a sectional view taken along line G-G of FIG. 29.

FIG. 29 is a sectional view showing the system for manufacturing the vessel cap of the third embodiment according to other embodiments of the present invention, and FIG. 30 is a sectional view taken along line G-G of FIG. 29.

A system for manufacturing a vessel cap according to other embodiment of the present invention comprises a first core 252 having an inlet 250 through which a molding material is injected and positioned at an upper side, a second core 256 disposed at a lower side of the first core 252 and provided with a cavity 254 having a shape of the vessel cap between the first core 252, a third core 258 inserted into the second core 256 for forming the hooking protrusion 178, and a stripper plate 260 disposed between the first core 252 and the second core 256 for separating a molded vessel cap from the first core 252 and the second core 256.

An insertion hole 262 for inserting the third core 258 is formed at the second core 256. Also, a supporting rod molding portion 264 for molding the supporting rod 176 of the vessel cap is formed between an inner circumferential surface of the insertion hole 262 of the second core 256 and a lateral surface of the third core 258. A hooking protrusion molding portion 266 for molding the hooking protrusion 178 is horizontally extending from the supporting rod molding portion 264 of the second core 256.

The third core 258 is formed to have a circular shape. The supporting rod molding portion 264 for molding the supporting rod 176 is formed at an upper surface of the third core 258. Also, an outer circumferential surface of the third core 258 is disposed at the hooking protrusion molding portion 266 of the second core 256, thereby forming one side surface of the hooking protrusion 178.

Since one side surface of the hooking protrusion 178 is formed by the circular third core 258, the hooking protrusion 178 is curvedly formed at the outer circumferential surface of the supporting rod 176.

A process for manufacturing a vessel cap by the system according to another embodiment of the present invention will be explained.

A molding material is injected into the cavity 254 formed between each core 252, 256, and 258 through the inlet 250 formed at the first core 252.

When the vessel cap is completed, the first core 252 is upwardly pulled. Then, the third core 258 is detached from the second core 256.

One side surface of the hooking protrusion 178 formed at the hooking protrusion molding portion 266 becomes free. Under the state, if the stripper plate 260 is upwardly moved, the vessel cap is detached from the second core 256.

Since one side surface of the hooking protrusion 178 becomes free, the vessel cap is detached form the hooking protrusion molding portion 266 of the second core 256 with being inclined towards an empty space through which the third core 258 has passed.

The hooking protrusion 178 can be perpendicularly extending from the supporting rod 176.

Figure 31:
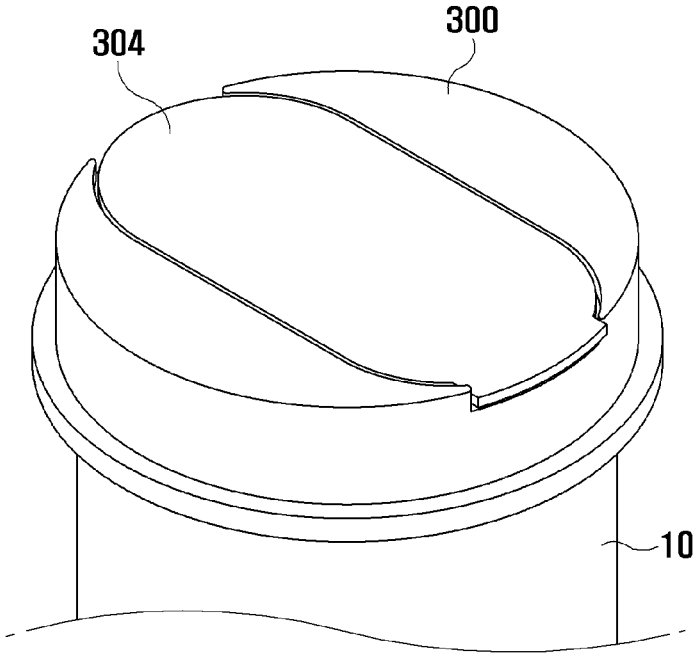
FIG. 31 is a perspective view showing a state that a vessel cap is mounted at a vessel according to the fourth embodiment of the present invention.
Figure 32:
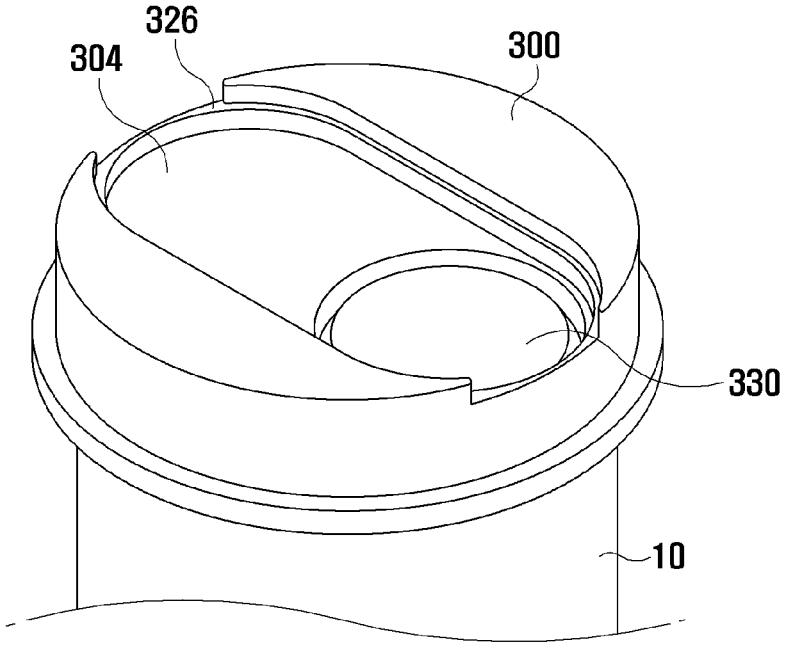
Figure 33:
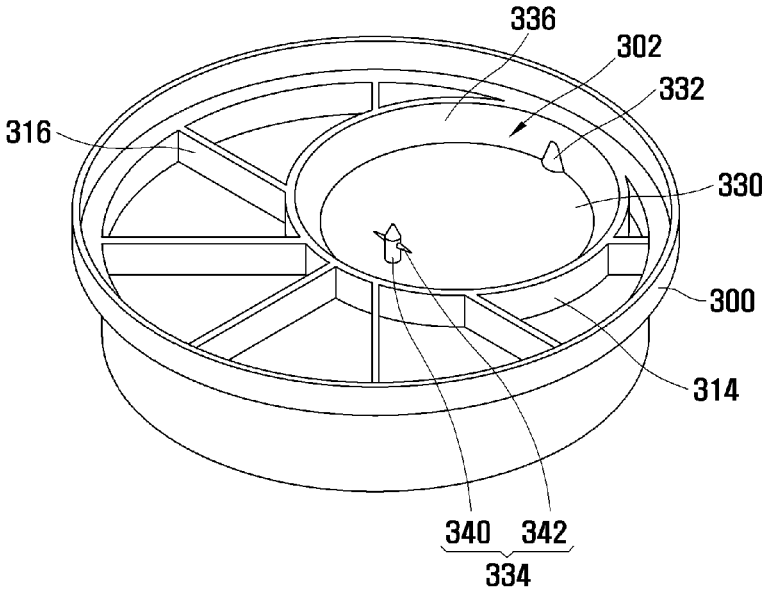
FIG. 33 is a perspective view showing an inner side of a vessel cap according to the fourth embodiment of the present invention.
Figure 34:
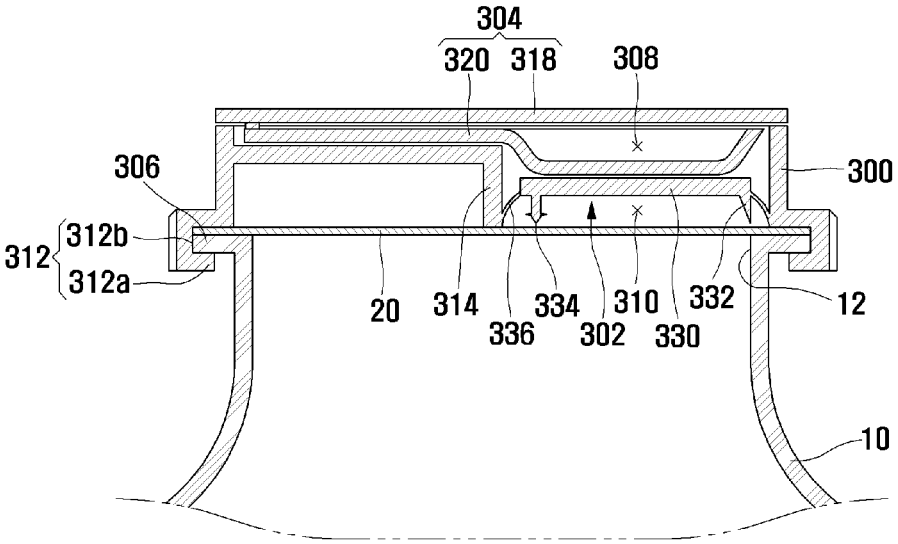
FIG. 34 is a sectional view showing a vessel cap according to the fourth embodiment of the present invention.

FIG. 31 is a perspective view showing a state that a vessel cap is mounted at a vessel according to the fourth embodiment of the present invention, FIG. 32 is a perspective view showing a state that a spoon is detached from the vessel cap according to the fourth embodiment of the present invention, FIG. 33 is a perspective view showing an inner side of the vessel cap according to the fourth embodiment of the present invention, and FIG. 34 is a sectional view showing the vessel cap according to the fourth embodiment of the present invention.

A vessel cap according to the fourth embodiment of the present invention comprises a body 300 mounted at a vessel inlet 12 through which a liquid material stored in a vessel 10 is discharged outwardly and having a certain space therein, a sealing member removing unit 302 formed in the body 300 for removing a sealing member 20 attached to the vessel inlet 12 when the vessel cap is detached from the vessel inlet 12 and storing the removed sealing member 20 in the vessel cap, and a spoon 304 detachably mounted at an upper surface of the body 300.

The vessel 10 stores a liquid material to drink or a material to eat by using a spoon therein, and the sealing member 20 for sealing the vessel inlet 12 and thus protecting the liquid material stored in the vessel 10 is attached to the vessel inlet 12 through which the liquid material is discharged outwardly. Preferably, the sealing member 20 is formed of a material that can be easily removed by a knife, etc. such as paper, an aluminum thin plate, etc.

A hooking jaw 306 for detachably mounting the vessel cap is protruding at an outer circumferential surface of the vessel inlet 12 in a circumferential direction.

A spoon receiving portion 308 for detachably mounting the spoon 304 is formed at an upper surface of the body 300. A mounting hole 310 for mounting the sealing member removing unit 302 is formed in the body 300. Also, a mounting portion 312 for detachably mounting the hooking jaw 306 formed at the outer circumferential surface of the vessel inlet 12 is formed at a lower inner circumferential surface of the body 300.

The mounting hole 310 of the body 300 is formed by an oval partition plate 314 downwardly extending from a position eccentric from the center of the body 300 with a certain length. A reinforcing rib 316 for reinforcing an intensity of the vessel cap is radially formed between an outer circumferential surface of the oval partition plate 314 and an inner circumferential surface of the body 300.

The mounting portion 312 comprises a protrusion 312*a* protruding from an inner circumferential surface of a lower end of the body 300 as a belt shape, and a hooking groove 312*b* formed at an inner surface of the protrusion 312*a* for hooking the hooking jaw 306 formed at an outer circumferential surface of the vessel inlet 12 and thus maintaining a mounted state of the vessel cap to the vessel inlet 12.

Besides the above structure of the mounting portion 312, a female screw portion is formed at an inner circumferential surface of the body 300 and a male screw portion is formed at the vessel inlet 12, so that the female screw portion is coupled to the male screw portion. That is, if the body 300 is rotated by the user's hand, the vessel cap is detached from the vessel inlet 12. The mounting portion 312 can have any structure only if it can be detachably mounted at the vessel inlet.

Figure 35:
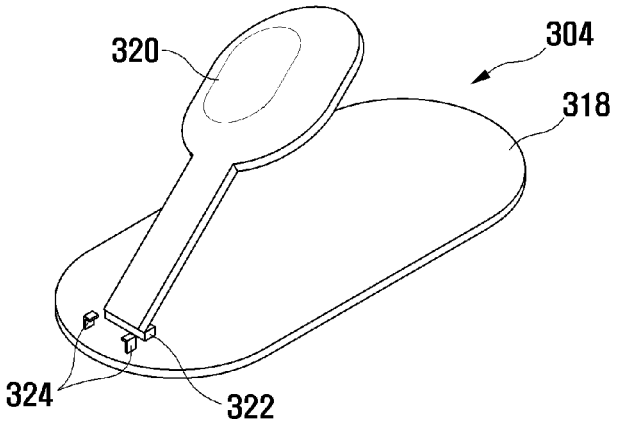
FIGS. 35 and 36 are perspective views showing the spoon inside a vessel cap according to the fourth embodiment of the present invention.
Figure 36:
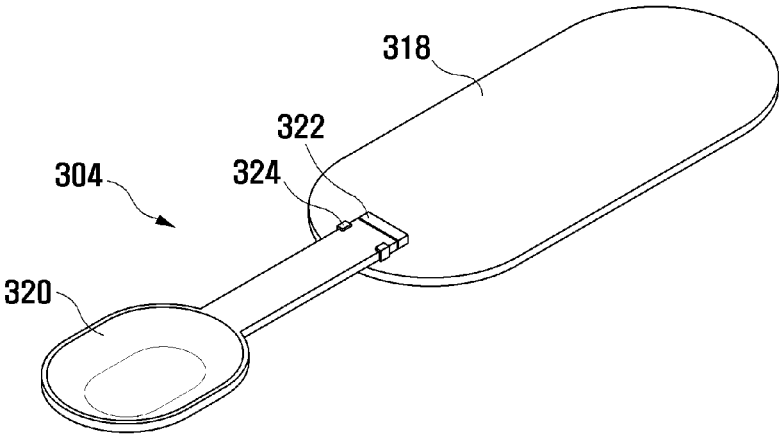

As shown in FIGS. 35 and 36, the spoon 304 comprises a spoon handgrip 318 mounted at the spoon receiving portion 308 formed at the body 300 and held by the user, a spoon head 320 connected to the end of the spoon handgrip 318 for feeding a liquid material to eat to a user's mouth, and a folding portion 322 formed between the spoon handgrip 318 and the spoon head 320 for connecting the spoon head 320 to the spoon handgrip 318.

The spoon handgrip 318 is formed as a flat plate, and covers an upper surface of the spoon receiving portion 308 formed at the body 300 thereby to prevent foreign materials or dust from being introduced into the spoon head 320. That is, the spoon handgrip 318 is formed to have the same size and shape as those of an upper inner circumferential surface of the spoon receiving portion 308. When the spoon handgrip 318 is inserted into the spoon receiving portion 308, it prevents foreign materials from being introduced into the spoon receiving portion 308 having the spoon head 320 therein.

The spoon receiving portion 308 has a stepped edge, and a fitting portion 326 for fitting the spoon handgrip 318 is formed at an upper circumferential surface of the spoon receiving portion 308.

That is, the spoon handgrip 318 is forcibly fitted into the fitting portion 326 of the spoon receiving portion 308 thereby not to be detached from the spoon receiving portion 308. A detachment preventing jaw for stably mounting the spoon handgrip 318 to the spoon receiving portion 308 can be formed at an edge of the spoon receiving portion 308.

The spoon head 320 is foldably connected to the spoon handgrip 318, and is received in the spoon receiving portion 308. The spoon head 320 is mounted at an inner upper side of the mounting hole 310 of the body 300.

The folding portion 322 is fixed to one end of the spoon handgrip 318, and is connected to the end of the spoon head 320 as a thin film, thereby folding or unfolding the spoon head 320 to/from the spoon handgrip 318.

A hooking protrusion 324 for preventing the spoon head 320 in an unfolded state from being folded is formed at the spoon handgrip 318. That is, the hooking protrusion 324 is formed at the end of the spoon handgrip 318, and the end portion thereof is curvedly formed. The hooking protrusion 324 is hooked at both side surfaces of the spoon head 320 when the spoon head 320 is unfolded thereby to prevent the spoon head 320 from being folded.

Since the spoon handgrip 318 is detachably mounted at the spoon receiving portion 308 formed at the upper surface of the body 300 thereby to cover the spoon receiving portion 308, foreign materials are prevented from being introduced into the spoon head 320 with which the material to drink or to eat comes in contact. Therefore, an additional cover for protecting the spoon head 320 is not required, thereby shortening a manufacturing process and reducing a production cost.

The sealing member removing unit 302 comprises a pressing plate 330 disposed in the mounting hole 310 of the body 300 to be movable in upper and lower directions and pressed by a user, a cutter 332 formed at an outer edge of a lower surface of the pressing plate 330 for penetrating a sealing member 20 when the pressing plate 330 is pressed and cutting the sealing member 20 when the body 300 is rotated, a hooking portion 334 formed at an inner edge of a lower surface of the pressing plate 330 for hooking the sealing member 20 so that the sealing member 20 cut by the cutter 332 can be stored in the body 300, and a connection portion 336 formed between an outer circumferential surface of the pressing plate 330 and an inner circumferential surface of the mounting hole 310 of the body 300 for guiding the pressing plate 330 to be moved in upper and lower directions and supporting a moved position of the pressing plate 330 by its elastic force.

The pressing plate 330 is formed as an oval flat plate to be disposed in the oval mounting hole 310, and is disposed at a position lower than an upper surface of the mounting hole 310. Since the spoon head 320 is mounted at the upper surface of the mounting hole 310, the pressing plate 330 is preferably disposed at an inner surface of the mounting hole 310.

The cutter 332 is formed at an outer edge of a lower surface of the pressing plate 330, and has the same shape and operation as those of the cutter of the third embodiment. Therefore, its detail explanation will be omitted.

The hooking portion 334 comprises a supporting rod 340 downwardly extending from the center of the lower surface of the pressing plate 330 for penetrating the sealing member 20 when the pressing plate 330 is pressed, and at least one hooking rod 342 formed at an outer circumferential surface of the end of the supporting rod 340 for hooking the sealing member 20 so as to store the sealing member 20 cut by the cutter 332 in the body 300.

The hooking portion 334 has the same construction and operation as those of the hooking portion of the third embodiment, and thus its detail explanation will be omitted.

The connection portion 336 is formed between an outer circumferential surface of the pressing plate 330 and an inner circumferential surface of the mounting hole 310 of the body 300 as a thin film having a dome shape. Also, the connection portion 336 is elastically transformed when the pressing plate 330 is pressed by a force more than a certain degree, thereby guiding the pressing plate 330 to be moved in a lower direction.

The connection portion 336 elastically maintains a current position of the pressing plate 330. That is, when the pressing plate 330 is upwardly protruding, the connection portion 336 has a convex dome shape and maintains the current state of the pressing plate 330. However, when the pressing plate 330 is pressed by a force more than a certain degree, the connection portion 336 is elastically transformed into a concave shape and maintains the pressed state of the pressing plate 330.

An operation of the vessel cap according to the present invention will be explained.

Figure 37:
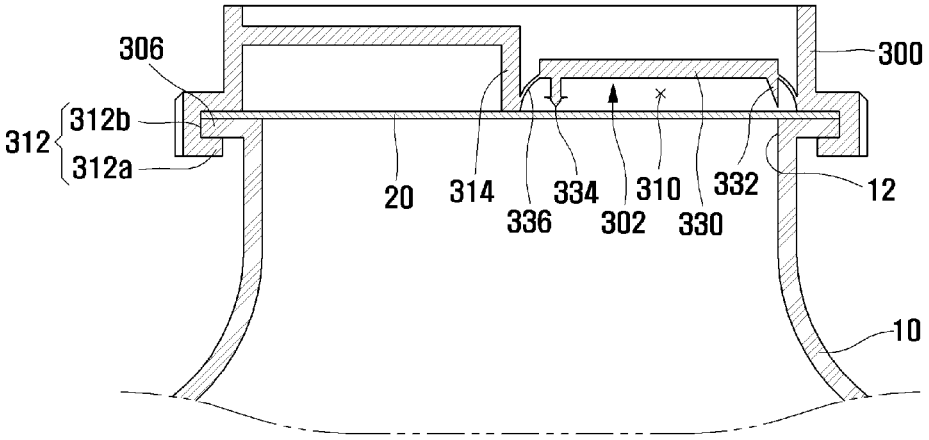
FIGS. 37, 38, and 39 are views showing an operation of a vessel cap according to the fourth embodiment of the present invention.
Figure 38:
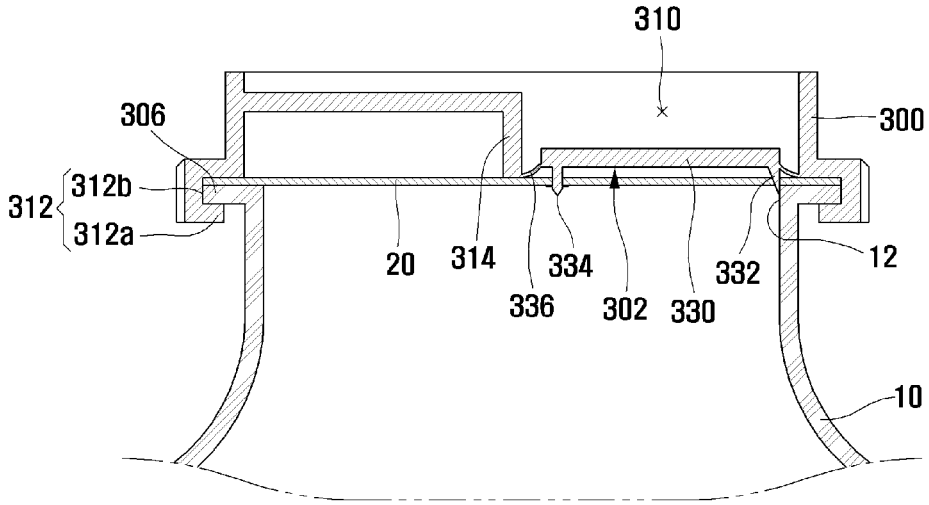
Figure 39:
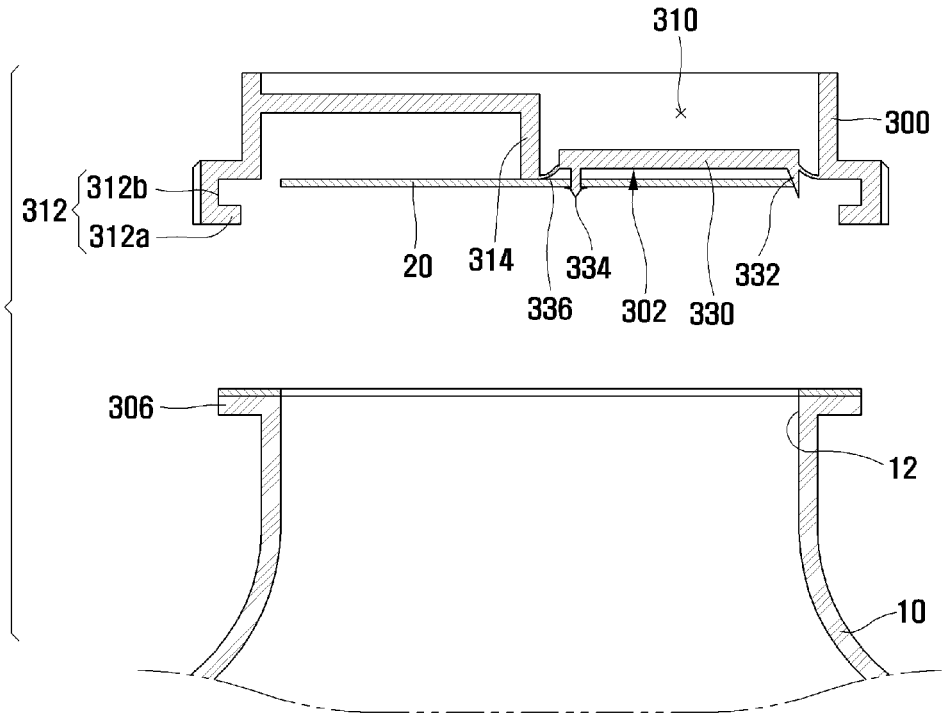

FIGS. 37, 38, and 39 are views showing an operation of the vessel cap according to the fourth embodiment of the present invention.

First, the spoon 304 stored in the vessel cap is detached from the vessel cap. That is, when the spoon 304 received in the spoon receiving portion 308 is upwardly pulled, the spoon 304 is detached from the spoon receiving portion 308. Since the spoon handgrip 318 is disposed to cover the spoon receiving portion 308, an additional cover for protecting the spoon head 320 is not required.

After detaching the spoon 304 from the body 300, the spoon head 320 is unfolded. As the result, the spoon head 320 and the spoon handgrip 318 are arranged as one straight-line thereby to complete the spoon. Since both side surfaces of the spoon head 320 are locked by the hooking protrusion 324 of the spoon handgrip 318, the spoon head 320 is prevented from being folded.

When the pressing plate 330 disposed at the mounting hole 310 of the body 300 is downwardly pressed in order to discharge the liquid material stored in the vessel 10 outwardly, the connection portion 336 is elastically transformed and the pressing plate 330 is downwardly moved. Then, the cutter 332 formed at an outer edge of a lower surface of the pressing plate 330 penetrates an edge of the sealing member 20, and the supporting rod 340 of the hooking portion 334 penetrates a center of the sealing member 20.

At the time of penetrating the sealing member 20, the hooking rod 342 of the hooking portion 334 is upwardly bent thus to pass through a hole penetrated by the supporting rod 340. Once the hooking rod 342 is positioned at an inner surface of the sealing member 20, it is elastically transformed into the original state as an extended state.

Then, if the body 300 is rotated by the user's hand, the cutter 332 is rotated under a contact state to an inner circumferential surface of the vessel inlet 12 thereby to cut the sealing member 20 as a circular shape.

When the body 300 is upwardly pulled, the hooking jaw 306 formed at an upper surface of the vessel inlet 12 is detached from the hooking groove 306 formed at an inner circumferential surface of the body 300. Accordingly, the vessel cap is detached from the vessel inlet 12.

Since the sealing member 20 that has been removed from the vessel inlet 12 is locked by the hooking rod 342 of the hooking portion 334, it is detached from the vessel inlet 12 together with the body 300 thus to be stored in the body 300.

Then, the user feeds the liquid material stored in the vessel 10 to his mouth by using the spoon 304.

Figure 40:
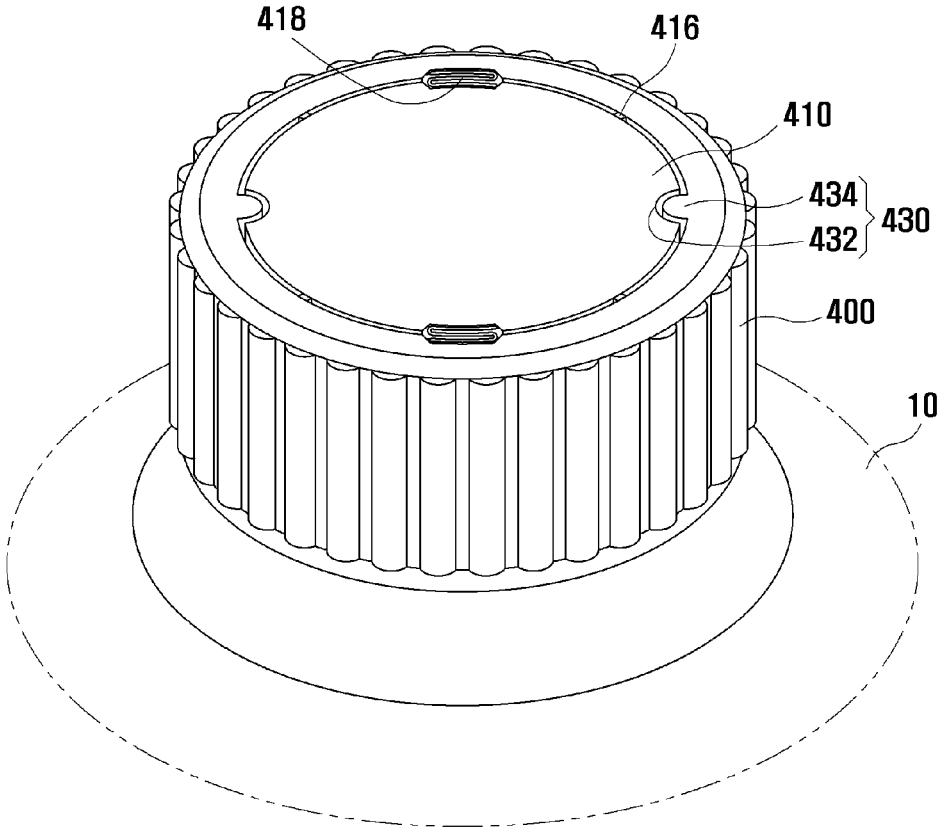
FIG. 40 is a perspective view showing a vessel cap according to the fifth embodiment of the present invention.
Figure 41:
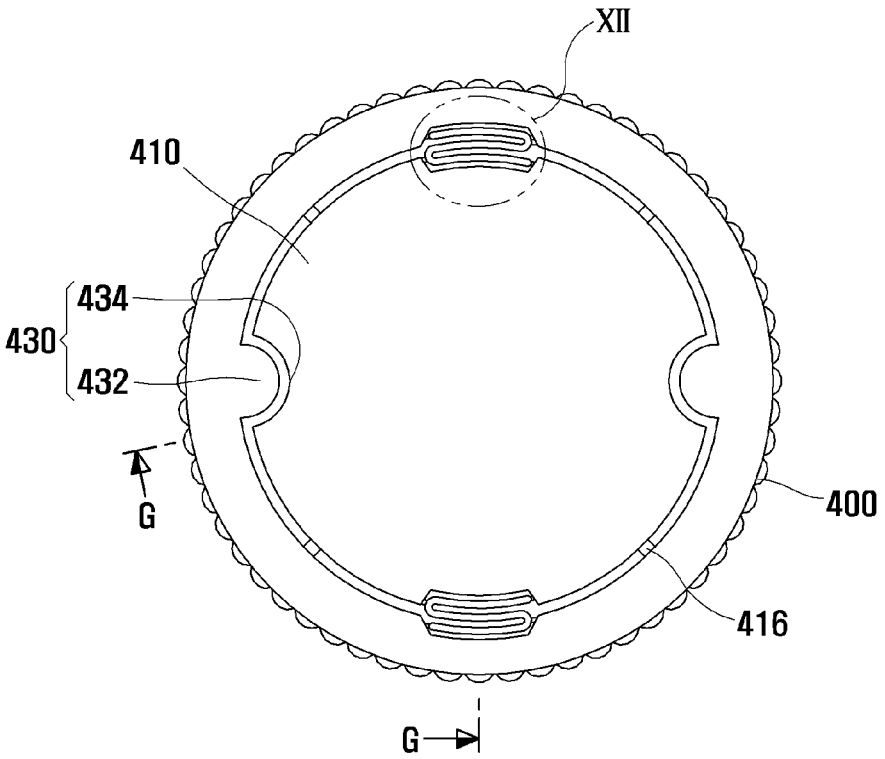
FIG. 41 is a top view showing a vessel cap according to the fifth embodiment of the present invention.
Figure 41B:
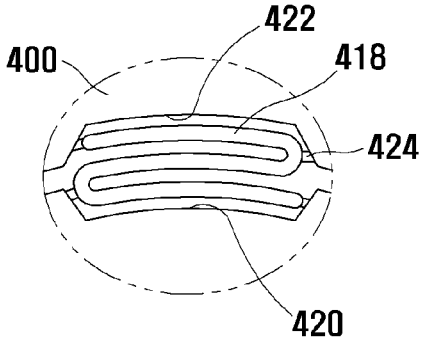
FIG. 41B is an enlarged sectional view of 'XII' part of FIG. 41.
Figure 42:
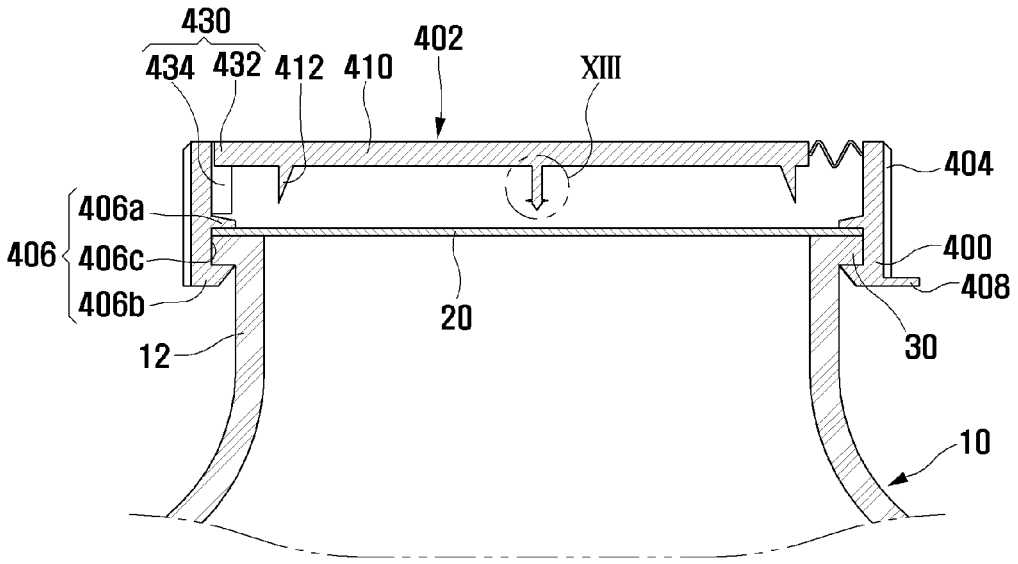
FIG. 42 is a sectional view taken along line G-G of FIG. 41 showing a state that a vessel cap is mounted at a vessel according to the fifth embodiment of the present invention.
Figure 42B:
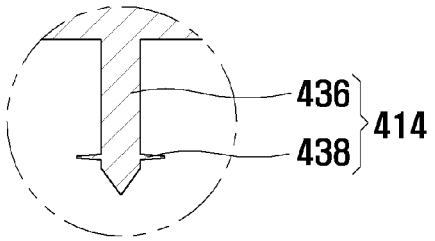
FIG. 42B is an enlarged sectional view of 'XIII' part of FIG. 41.
Figure 43:
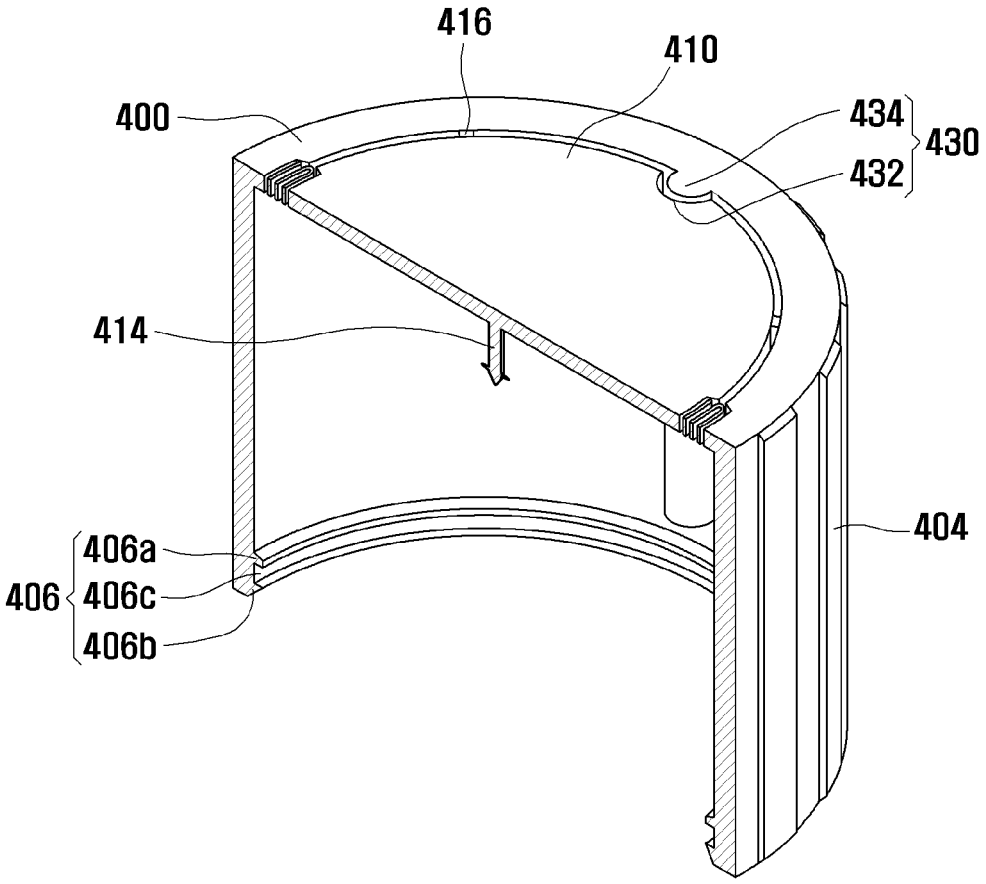
FIG. 43 is a perspective view showing a vessel cap according to the fifth embodiment of the present invention.

FIG. 40 is a perspective view showing a vessel cap according to the fifth embodiment of the present invention, FIG. 41 is a top view showing the vessel cap according to the fifth embodiment of the present invention, FIG. 42 is a sectional view showing a state that the vessel cap is mounted at a vessel according to the fifth embodiment of the present invention, and FIG. 43 is a perspective view showing the vessel cap according to the fifth embodiment of the present invention.

A vessel cap according to the fifth embodiment of the present invention comprises a body 400 mounted at a vessel inlet 12 through which a liquid material stored in a vessel 10 is discharged outwardly and having a certain space therein, and a sealing member removing unit 402 formed in the body 400 for removing a sealing member 20 attached to the vessel inlet 12 when the vessel cap is detached from the vessel inlet 12 and storing the removed sealing member 20 in the vessel cap.

The vessel 10 stores a liquid material or a solid material therein, and the sealing member 20 for sealing the vessel inlet 12 and thus protecting the liquid material or the solid material is attached to the vessel inlet 12 through which the liquid material or the solid material is discharged outwardly. Preferably, the sealing member 20 is formed of a material that can be easily removed by a knife, etc. such as paper, an aluminum thin plate, etc.

A hooking jaw 30 for mounting the vessel cap is protruding at the vessel inlet 12 in a circumferential direction.

The body 400 has a cylindrical shape, and a plurality of concave-convex protrusions 404 for facilitating to rotate the vessel cap by a user's hand are formed at an outer circumferential surface of the body 400. A mounting portion 406 detachably mounted at the vessel inlet 12 is formed at a lower portion of the body 400.

The mounting portion 406 comprises two protrusions **406*a* and 406*b* protruding from an inner circumferential surface of a lower end of the body 400 with a certain gap as a belt shape, and a hooking groove 406*c* formed between the two protrusions 406*a* and 406*b* for hooking the hooking jaw 30 formed at an outer circumferential surface of the vessel inlet 12 and thus maintaining a mounted state of the vessel cap to the vessel inlet 12**.

A handgrip 408 held by a user and pulled for detaching the body 400 from the vessel inlet 12 is formed at a lower end of the body 400.

The sealing member removing unit 402 comprises a pressing plate 410 locked in the body 400 and unlocked to be downwardly moved when a force is applied thereto by the user, a cutter 412 formed at an edge of a lower surface of the pressing plate 410 in a circumferential direction with the same gap for penetrating a sealing member 20 when the pressing plate 410 is pressed and cutting the sealing member 20 when the body 400 is rotated, and a hooking portion 414 downwardly protruding at the lower surface of the pressing plate 410 for hooking the sealing member so that the sealing member cut by the cutter 412 can be stored in the body 400.

The pressing plate 410 is formed as a disc shape having an approximately same diameter as an inner diameter of the body 400, and is movable in upper and lower directions at an inner circumferential surface of the body 400.

A plurality of connection ribs 416 for maintaining a fixed state of the pressing plate 410 to the body 400 and releasing a locked state between the pressing plate 410 and the body 400 with being cut when the pressing plate 410 is pressed by a force more than a certain degree are formed between an outer circumferential surface of the pressing plate 410 and an inner circumferential surface of the body 400.

The connection rib 416 is formed to be cut when a certain force is applied thereto, and is cut when the pressing plate 410 is pressed to be downwardly moved.

A plurality of guide ribs 418 are connected between an outer circumferential surface of the pressing plate 410 and an inner circumferential surface of the body 400 with a certain gap, thereby guiding the pressing plate 410 to be downwardly moved under a connected state to the body 400.

The guide rib 418 is formed to have an 'S' shape, and has one end connected to the inner circumferential surface of the body 400 and another end connected to the outer circumferential surface of the pressing plate 410. When the pressing plate 410 is downwardly moved, the guide rib 418 is extended thereby to guide the pressing plate 410 to be downwardly moved and to maintain the connected state of the pressing plate 410 to the body 400.

The guide rib 418 is in a state of being inserted into an insertion groove 420 formed at the outer circumferential surface of the pressing plate 410 and an insertion groove 422 formed at the inner circumferential surface of the body 400. A connection belt 424 having a thin 'S' shape is formed between the two insertion grooves 420 and 422 and a curved portion of the guide rib 418. The connection belt 424 is cut when the pressing plate 410 is downwardly moved.

A rotation force transmitting portion 430 for guiding the pressing plate 410 to be moved in the body 400 in upper and lower directions and rotating the pressing plate 410 with the body 400 when the body 400 is rotated is formed between the pressing plate 410 and the body 400.

The rotation force transmitting portion 430 comprises a guide protrusion 432 protruding at the inner circumferential surface of the body 400 in upper and lower directions, and a groove 434 formed at the outer circumferential surface of the pressing plate 410 for inserting the guide protrusion 432. The guide protrusion 432 and the groove 434 have a sectional surface of a semi-circle shape, respectively. Preferably, at least one rotation force transmitting portion 430 is formed between the body 400 and the pressing plate 410.

The rotation force transmitting portion 430 can have any structure such as a spline structure in which the pressing plate 410 can be rotated together with the body 400 when the body 400 is rotated.

The pressing plate 410 is fixed to the body 400 by the connection rib 416, and thus is prevented from being pressed by an external force. When the user presses the pressing plate 410 with a force more than a certain degree, the connection rib 416 is cut to release the locked state of the pressing plate 410 and thus the pressing plate 410 is downwardly moved.

However, since the pressing plate 410 and the body 400 are connected to each other by the guide rib 418, the pressing plate 410 is prevented from being detached from the body 400. When the body 400 is rotated, the pressing plate 410 is rotated together with the body 400 by the rotation force transmitting portion 430.

A plurality of the cutters 412 are formed at an edge of a lower surface of the pressing plate 410 with the same gap, and are downwardly moved when the pressing plate 410 is pressed thus to penetrate the sealing member 20. When the body 400 is rotated, the cutters 412 are rotated under a contact state to an inner circumferential surface of the vessel inlet 12 thereby to cut the sealing member 20 as a circular shape.

The cutter 412 has the same structure as that of the aforementioned cutter of the third embodiment.

The hooking portion 414 comprises a supporting rod 436 downwardly extending from the center of a lower surface of the pressing plate 410 for penetrating the sealing member 20 when the pressing plate 410 is pressed, and at least one hooking protrusion 438 formed at an outer circumferential surface of the supporting rod 436 for hooking the sealing member 20 so as to store the sealing member 20 cut by the cutter 412 in the body 400.

The supporting rod 436 is formed as a bar shape perpendicularly extending from the center of the pressing plate 410 downwardly, and an end thereof has a sharp shape to penetrate the sealing member 20.

The supporting protrusion 438 formed to be elastically transformed is upwardly bent at the time of penetrating the sealing member 20. After the supporting protrusion 438 is positioned at an inner side of the sealing member 20, it is extended into the original state thereby to be hooked at an inner surface of the sealing member 20.

An operation of the vessel cap according to the present invention will be explained as follows.

Figure 44:
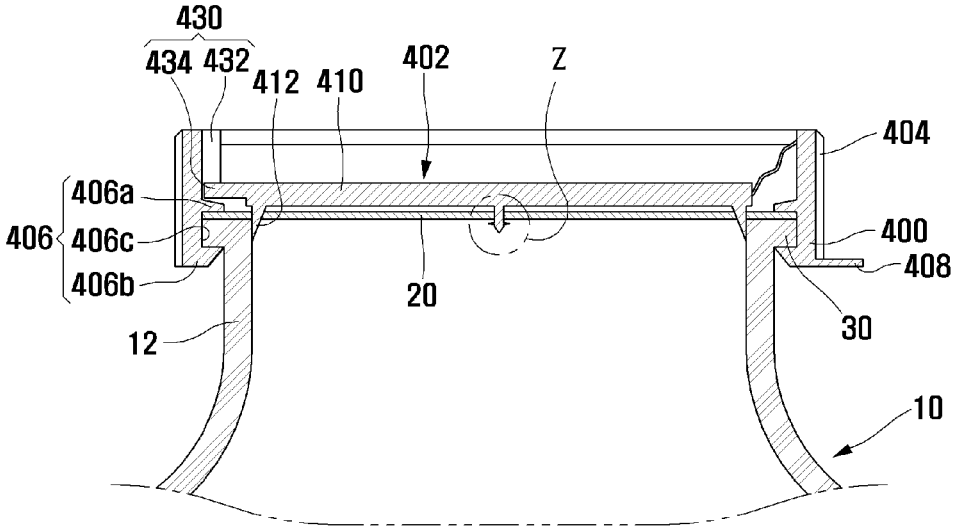
FIGS. 44 and 45 are views showing an operation of a vessel cap according to the fifth embodiment of the present invention.
Figure 44B:
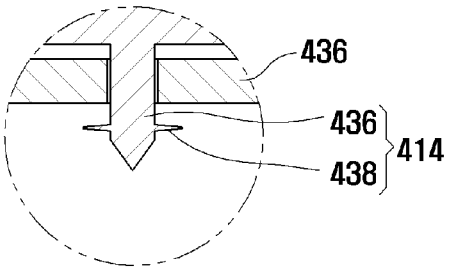
FIG. 44B is an enlarged sectional view of 'Z' part of FIG. 44.
Figure 45:
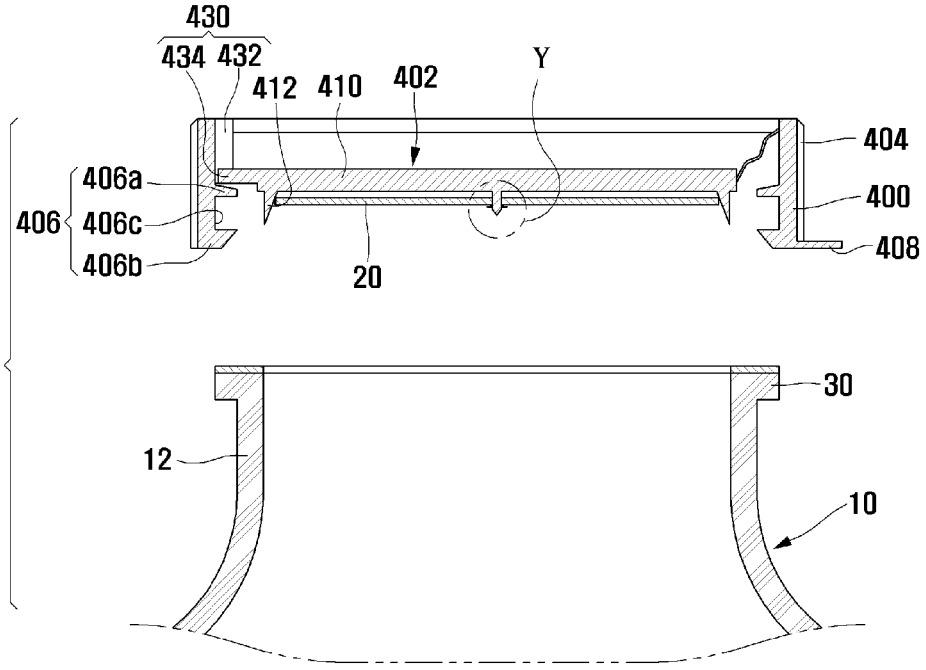
Figure 45B:
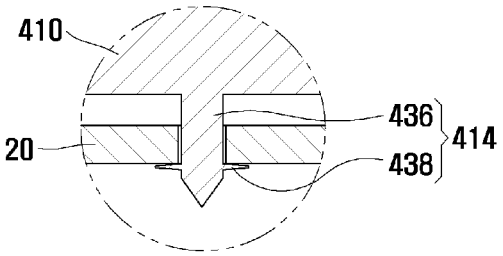
FIG. 45B is an enlarged sectional view of 'Y' part of FIG. 45.

FIGS. 44 and 45 are views showing an operation of the vessel cap according to the fifth embodiment of the present invention.

When the vessel cap is not opened, the pressing plate 410 is hooked at the body 400 by the connection rib 416. Therefore, the pressing plate 410 is not pressed even if an external force is applied thereto.

When the pressing plate 410 is downwardly pressed in order to discharge the liquid material stored in the vessel 10 outwardly, the connection rib 416 is cut and the locked state of the pressing plate 410 is released. As the result, the pressing plate 410 is downwardly moved in the body 400. Then, the guide rib 418 having an 'S' shape and connected between the pressing plate 410 and the body 400 is extended, thereby guiding the pressing plate 410 to be downwardly moved under a connected state to the body 400.

When the pressing plate 410 is pressed, the cutters 412 formed at a lower surface of the pressing plate 410 penetrates an edge of the sealing member 20 and the supporting rod 436 of the hooking portion 414 penetrates a center of the sealing member 20.

At the time of penetrating the sealing member 20, the hooking protrusion 438 of the hooking portion 414 is upwardly bent thus to pass through a hole penetrated by the supporting rod 436. Once the hooking protrusion 438 is positioned at an inner surface of the sealing member 20, it is elastically transformed into the original state as an extended state.

Then, if the body 400 is rotated by the user's hand, the rotation force of the body 400 is transmitted to the pressing plate 410 and thus the pressing plate 410 is rotated together with the body 400 since the groove 432 formed at the edge of the pressing plate 410 is in a state of being inserted into the guide protrusion 434 formed at the inner circumferential surface of the body 400.

When the pressing plate 410 is rotated, the cutter 412 is rotated under a contact state to an inner circumferential surface of the vessel inlet 12 thereby to cut the sealing member 20 as a circular shape.

When the handgrip 408 formed at the body 400 is upwardly pulled, the hooking jaw 30 formed at an upper surface of the vessel inlet 12 is detached from the hooking groove 406*c* formed at an inner circumferential surface of the body 400. Accordingly, the vessel cap is detached from the vessel inlet 12.

Since the sealing member 20 that has been removed from the vessel inlet 12 is locked by the hooking protrusion 438 of the hooking portion 414, it is detached from the vessel inlet 12 together with the body 400 thus to be stored in the body 400.

Figure 46:
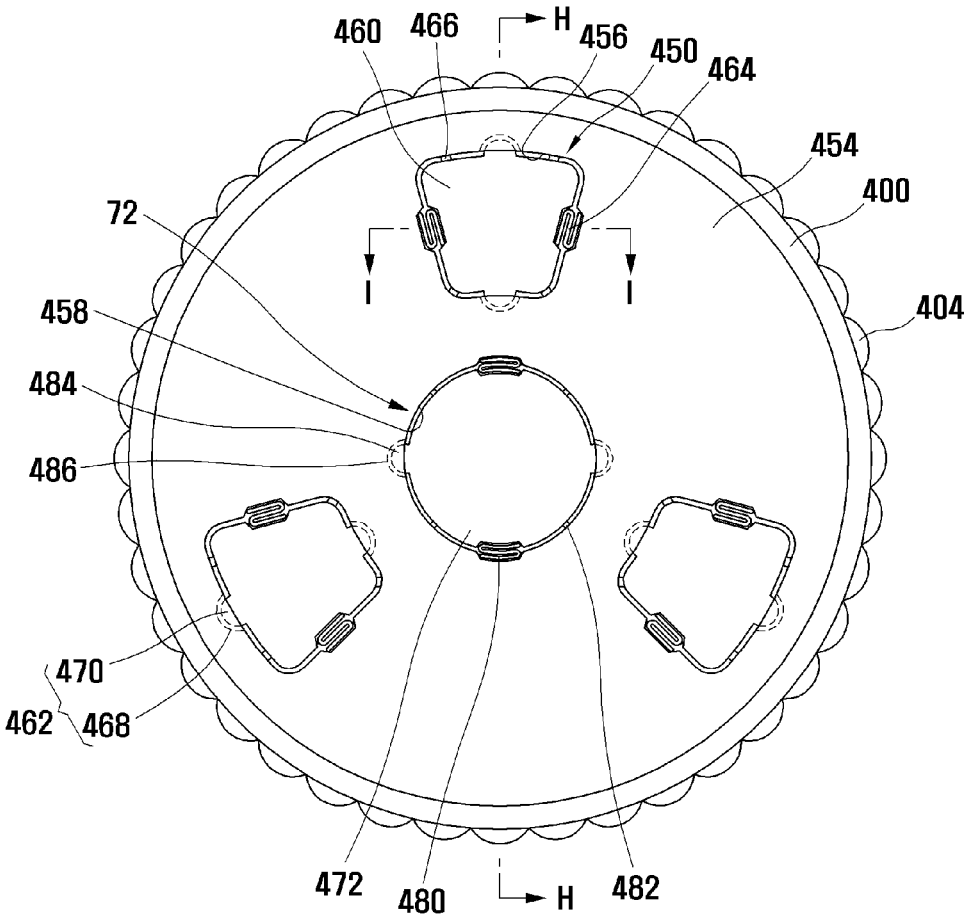
FIG. 46 is a top view showing a vessel cap according to the sixth embodiment of the present invention.
Figure 47:
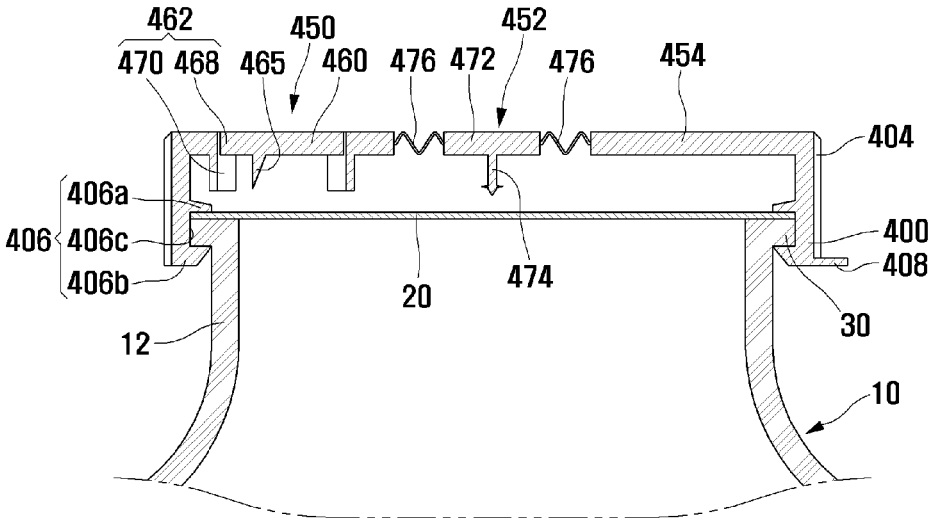
FIG. 47 is a sectional view taken along line H-H of FIG. 46.

FIG. 46 is a top view showing a vessel cap according to the sixth embodiment of the present invention, and FIG. 47 is a sectional view taken along line H-H of FIG. 46.

The vessel cap according to the seventh embodiment is applied to a vessel having a vessel inlet 12 of a comparatively large size. A plurality of sealing member removing units 450 are disposed in the body 400 in a circumferential direction. Also, a hooking unit 452 for storing the removed sealing member 20 in the body 400 is installed at the center of the body 400.

That is, in the vessel cap of the seventh embodiment, a partition plate 454 is formed at an inner circumferential surface of the body 400, and at least one mounting hole 456 is formed at the partition plate 454 in a circumferential direction. The sealing member removing unit 450 is formed at each mounting hole 456.

A mounting hole 458 is formed at a center of the partition plate 456, and the hooking unit 452 is installed at the mounting hole 458.

Figure 48:
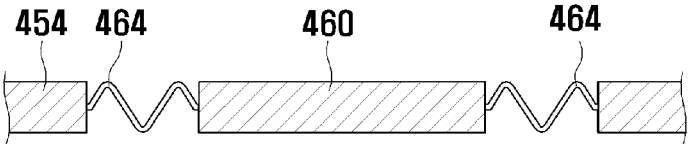
FIG. 48 is a sectional view taken along line I-I of FIG. 46.
Figure 49:
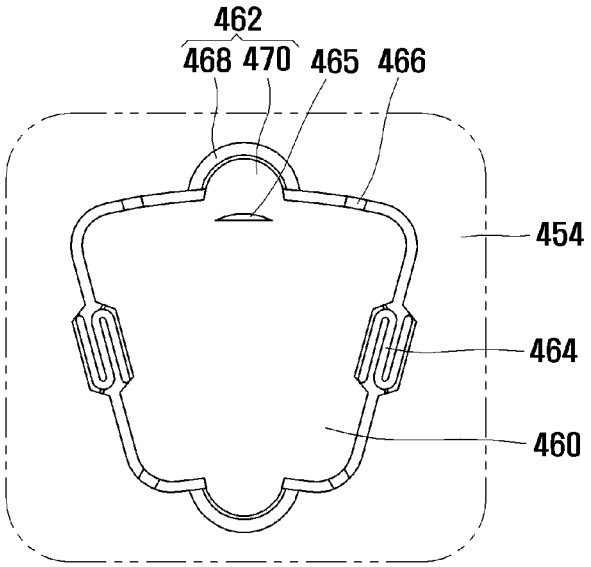
FIG. 49 is a bottom view showing a rotation force transmitting portion of a vessel cap according to the sixth embodiment of the present invention.

As shown in FIGS. 48 and 49, the sealing member removing unit 450 comprises a pressing plate 460 mounted at an inner circumferential surface of the mounting hole 456 and moved in upper and lower directions, a rotation force transmitting portion 462 formed between the partition plate 454 and the pressing plate 460 for guiding the pressing plate 460 to be moved in the body 400 in upper and lower directions and rotating the pressing plate 460 with the body 400 when the body 400 is rotated, and a cutter 464 formed at a lower surface of the pressing plate for cutting the sealing member 20.

The pressing plate 460 is formed as a flat plate having a triangular shape. A plurality of 'S'-shaped guide ribs 464 are connected between an outer circumferential surface of the pressing plate 460 and an inner circumferential surface of the mounting hole 456 of the partition plate 454, thereby guiding the pressing plate 460 to be downwardly moved under a connected state to the partition plate 454. A plurality of connection ribs 466 for maintaining a fixed state of the pressing plate 460 to the mounting hole 458 of the partition plate 454 and releasing a locked state therebetween when the pressing plate 460 is pressed are formed between an outer circumferential surface of the pressing plate 460 and an inner circumferential surface of the mounting hole 456 of the partition plate 454.

The guide rib 464 and the connection rib 466 have the same construction as the guide rib 418 and the connection rib 416 of the fifth embodiment, and thus their detail explanation will be omitted.

The rotation force transmitting portion 462 comprises a guide rail 468 perpendicularly formed at a lower surface of the partition plate 454 with a certain length, and a guide protrusion 470 protruding at an edge of the pressing plate 460 and inserted into the guide rail 468 thus to be moved.

The guide rail 468 has a sectional surface of a semi-circle shape or a 'C' shape, and guides the guide protrusion 470 to be inserted thereinto to be moved in upper and lower directions. Also, when the body 400 is rotated, the guide rail 468 supports the pressing plate 460 to be rotated.

One cutter 464 is formed at an edge of a lower surface of the pressing plate 460, and has the same shape as that of the aforementioned cutter 412 of the fifth embodiment.

The hooking unit 452 comprises a pressing plate 472 mounted at an inner circumferential surface of the mounting hole 458 and pressed by the user, and a hooking portion 474 formed at a lower surface of the pressing plate 472 for penetrating the sealing member 20 and hooking the sealing member 20.

A guide rib 480 and a connection rib 482 are respectively formed between an outer circumferential surface of the pressing plate 472 and an inner circumferential surface of the mounting hole 458 of the partition plate 454. The guide rib 480 and the connection rib 482 have the same operation and construction as those of the guide rib 464 and the connection rib 466 formed between the pressing plate 460 of the sealing member removing unit 450 and the mounting hole 456, and thus their detail explanation will be omitted.

A guide protrusion 484 is formed at an outer circumferential surface of the pressing plate 472. Also, a guide rail 486 for inserting the guide protrusion 484 is movably formed at a lower surface of the partition plate 454, thereby guiding the pressing plate 472 to be downwardly moved.

The hooking portion 474 has the same structure and operation as those of the aforementioned hooking portion 414 of the fifth embodiment, and thus its detail explanation will be omitted.

Figure 50:
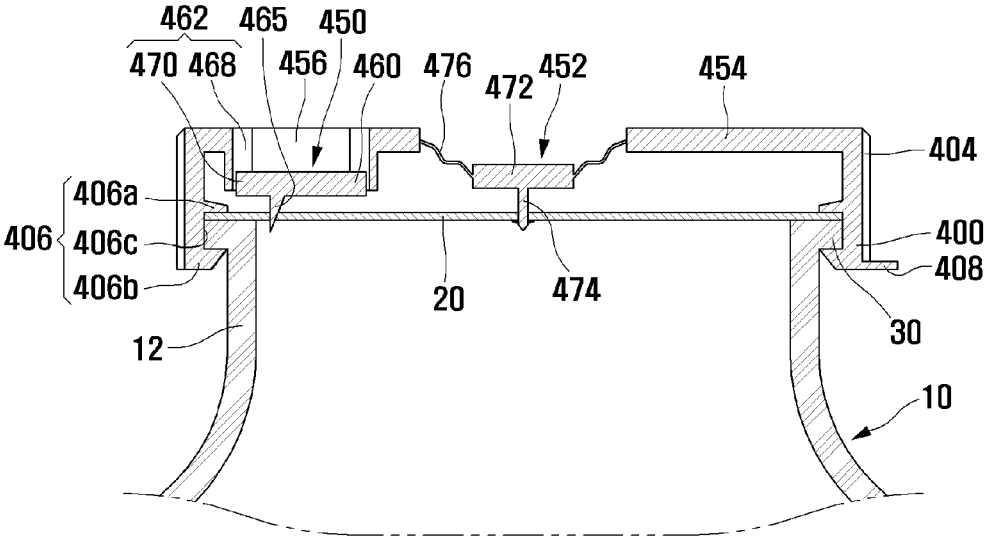
FIG. 50 is a view showing an operation of a vessel cap according to the sixth embodiment of the present invention.

FIG. 50 is a view showing an operation of the vessel cap according to the sixth embodiment of the present invention.

When the user downwardly presses the pressing plate 460 of each sealing member removing unit 450 mounted at the partition plate 454 in a circumferential direction, the connection rib 466 formed between the pressing plate 460 and the mounting hole 456 of the partition plate 454 is cut to release the locked state of the pressing plate 460 and thus the pressing plate 460 is downwardly moved. While the guide rib 464 connected between the pressing plate 460 and the mounting hole 456 becomes unfolded, the connected state between the pressing plate 460 and the partition plate 454 is maintained. The guide protrusion 470 formed at the edge of the pressing plate 460 is moved along the guide rail 468 formed at the lower surface of the partition plate 454, thereby guiding the pressing plate 460 to be perpendicularly moved.

When the pressing plate 460 is downwardly moved, the cutter 464 penetrates the sealing member 20.

When the pressing plate 472 of the hooking unit 452 is pressed, the hooking portion 474 formed at the lower surface of the pressing plate 472 penetrates the center of the sealing member 20.

Under the state, if the body 400 is rotated, the guide protrusion 470 formed at the pressing plate 460 of each sealing member removing unit 450 is hooked by the guide rail 468 formed at the partition plate 454. Therefore, if the body 400 is rotated, the pressing plate 460 is together rotated. Then, the cutter 464 cuts the edge of the sealing member 20, and the hooking portion 474 is hooked at the lower surface of the sealing member 20.

When the body 400 is detached from the vessel inlet 12, the sealing member 20 is received in the body 400 under a hooked state to the hooking portion 474.

Figure 51:
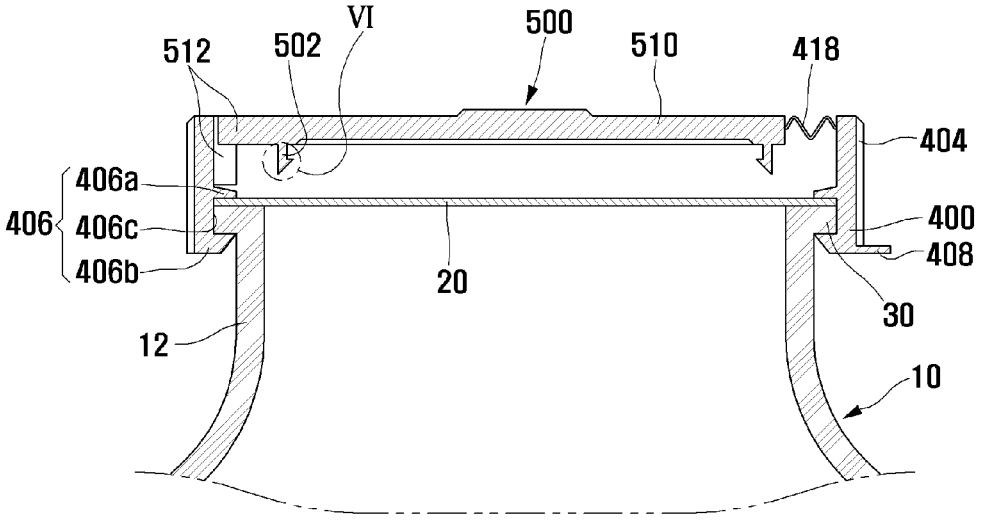
FIG. 51 is a sectional view showing a vessel cap according to the seventh embodiment of the present invention.
Figure 52:
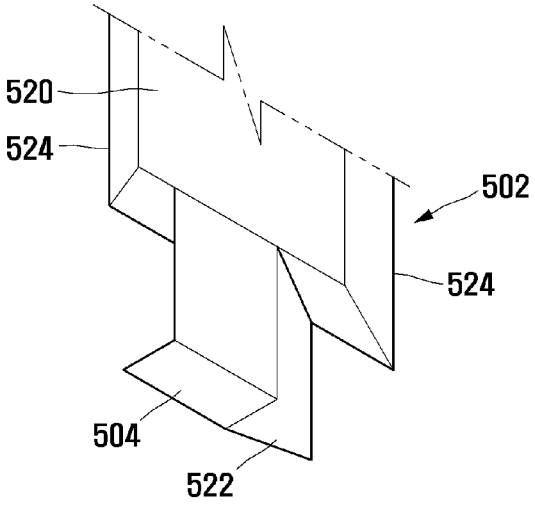
FIG. 52 is a perspective view of 'VI' part of FIG. 51 showing a cutter according to the seventh embodiment of the present invention.

FIG. 51 is a sectional view showing a vessel cap according to the seventh embodiment of the present invention, and FIG. 52 is a perspective view showing a cutter according to the seventh embodiment of the present invention.

The vessel cap according to the seventh embodiment is the same as the vessel cap according to the fifth embodiment except that a sealing member receiving portion 504 for storing the sealing member 20 is formed at a cutter 502 of the sealing member removing unit 500.

The sealing member removing unit 500 according to the seventh embodiment comprises a pressing plate 510 locked in the body 400 and unlocked at the time of being pressed by the user thus to be downwardly moved, a rotation force transmitting portion 512 formed between an outer circumferential surface of the pressing plate 510 and an inner circumferential surface of the body 400 for guiding the pressing plate 510 to be moved in the body 400 in upper and lower directions and transmitting a rotation force of the body 400 to the pressing plate 510 when the body 400 is rotated, a cutter 502 formed at an edge of a lower surface of the pressing plate 510 with the same gap for penetrating the sealing member 20 when the pressing plate 510 is pressed and cutting the sealing member 20 when the body 400 is rotated, and a sealing member receiving portion 504 for storing the sealing member 20 cut by the cutter 502 in the body 400.

A connection rib (not shown) for maintaining a fixed state of the pressing plate 510 to an inner circumferential surface of the body 400 and releasing a locked state of the pressing plate 510 to the body 400 with being cut when the pressing plate 510 is pressed by a force more than a certain degree are formed between the pressing plate 510 and the body 400. Also, the guide rib 418 for maintaining a connected state of the pressing plate 510 to the inner circumferential surface of the body 400 is formed between the pressing plate 510 and the body 400.

The guide rib 418 and the connection rib have the same construction and operation as those of the guide rib 418 and the connection rib 416 of the fifth embodiment, and thus their detail explanation will be omitted.

The rotation force transmitting portion 512 has the same construction and operation as those of the aforementioned rotation force transmitting portion 430 of the fifth embodiment, and thus their detail explanation will be omitted.

As shown in FIG. 52, the cutter 502 comprises a plurality of supporting portions 520 formed at an edge of a lower surface of the pressing plate 510 with the same gap, a first cutting portion 522 sharply formed at a lower end of the supporting portion 520 and downwardly moved when the pressing plate 510 is pressed for penetrating the sealing member, and a second cutting portion 524 formed on at least one side surface of both side surfaces of the supporting portion 520 for cutting the sealing member 20 as a circular shape with being rotated under a contact state to the inner circumferential surface of the vessel inlet 12 when the body 400 is rotated.

The sealing member receiving portion 504 is protruding from an inner side surface of the supporting portion 520, and locks the edge of the sealing member 20 cut by the cutter 502 thereby to store the sealing member 20 in the body 400 when the body 400 is detached from the vessel inlet 12.

Figure 53:
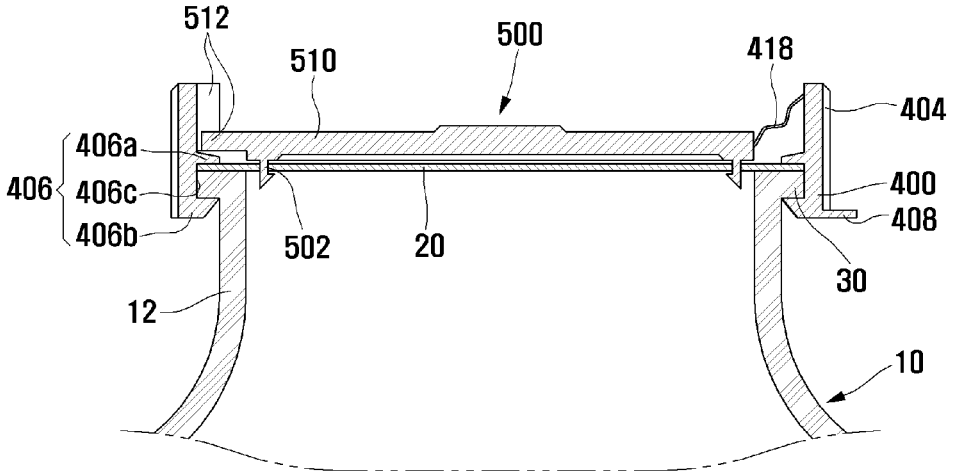
FIG. 53 is a view showing an operation of a vessel cap according to the seventh embodiment of the present invention.

As shown in FIG. 53, the vessel cap according to the seventh embodiment has the same operation as that of the vessel cap according to the fifth embodiment except that the sealing member 20 cut by the cutter is stored in the sealing member receiving portion 504 formed at an inner side surface of the cutter 502.

Figure 54:
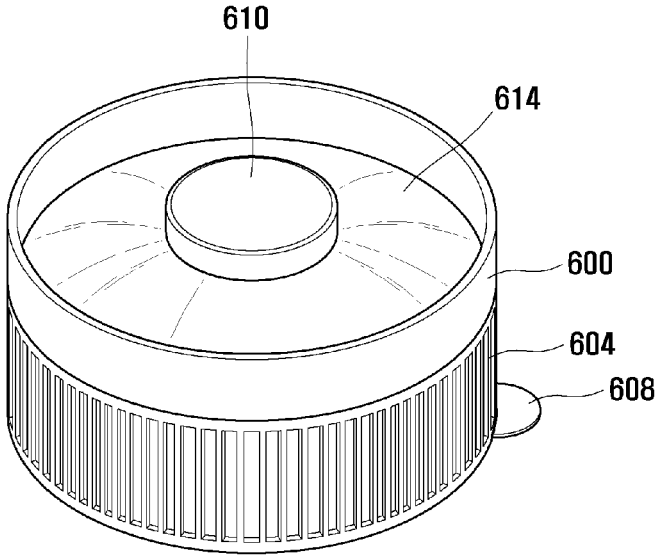
FIG. 54 a perspective view showing a vessel cap according to the eighth embodiment of the present invention.
Figure 55:
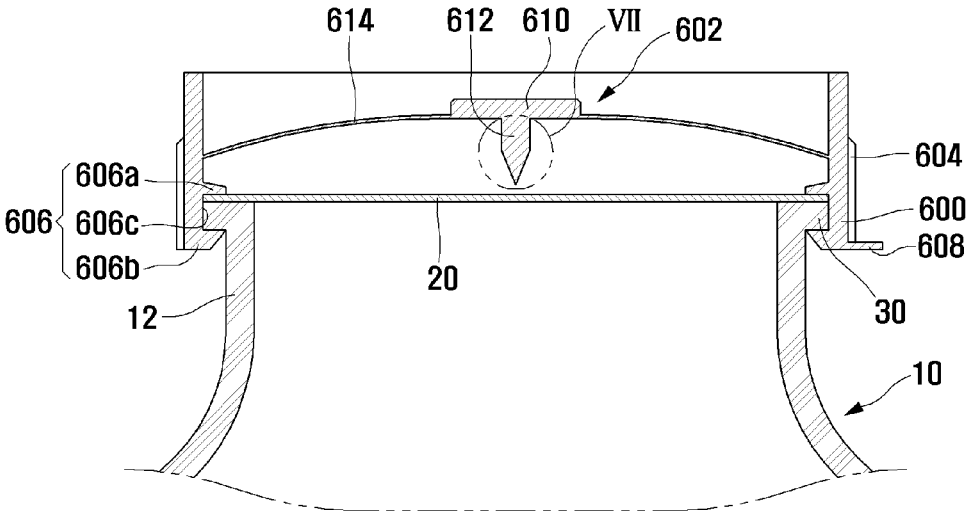
FIG. 55 is a sectional view showing a state that the vessel cap is mounted at a vessel according to the eighth embodiment of the present invention.

FIG. 54 a perspective view showing a vessel cap according to the eighth embodiment of the present invention, and FIG. 55 is a sectional view showing a state that the vessel cap is mounted at a vessel according to the eighth embodiment of the present invention.

The vessel cap according to the eighth embodiment of the present invention comprises a body 600 mounted at a vessel inlet 12 through which a liquid material stored in a vessel 10 is discharged outwardly and having a certain space therein, and a sealing member punching unit 604 for penetrating the sealing member 20 attached to the vessel inlet 12 so that the liquid material stored in the vessel can be discharged.

A hooking jaw 30 for mounting the vessel cap is protruding at the vessel inlet 12 in a circumferential direction.

The body 600 has a cylindrical shape, and a plurality of concave-convex protrusions 604 for facilitating to rotate the vessel cap by a user's hand are formed at an outer circumferential surface of the body 600. A mounting portion 606 detachably mounted at the vessel inlet 12 is formed at a lower portion of the body 600.

The mounting portion 606 comprises two protrusions 606*a* and 606*b* protruding from an inner circumferential surface of a lower end of the body 600 with a certain gap as a belt shape, and a hooking groove 606*c* formed between the two protrusions 606*a* and 606*b* for hooking the hooking jaw 30 formed at an outer circumferential surface of the vessel inlet 12 and thus maintaining a mounted state of the vessel cap to the vessel inlet 12.

A handgrip 608 held by a user and pulled for detaching the body 600 from the vessel inlet 12 is formed at a lower end of the body 600.

Besides the aforementioned structure of the mounting portion 606, a female screw portion is formed at an inner circumferential surface of the body 600 and a male screw portion is formed at the vessel inlet 12, so that the female screw portion is coupled to the male screw portion. That is, if the body 600 is rotated by the user's hand, the vessel cap is detached from the vessel inlet 12. The mounting portion 606 can have any structure only if it can be detachably mounted at the vessel inlet.

The sealing member punching unit 602 comprises a pressing plate 610 disposed in the body 600 to be movable in upper and lower directions and downwardly moved at the time of being pressed by a user, a punch 612 formed at a lower surface of the pressing plate 610 for forming a hole of a certain shape at the sealing member 20 when the pressing plate 610 is pressed, and a connection portion 614 connected between an outer circumferential surface of the pressing plate 610 and an inner circumferential surface of the body 600 for guiding the pressing plate 610 to be moved in upper and lower directions and supporting a moved position of the pressing plate 610 by its elastic force.

The pressing plate 610 is formed as a disc shape having a diameter smaller than an inner diameter of the body 600.

Figure 56:
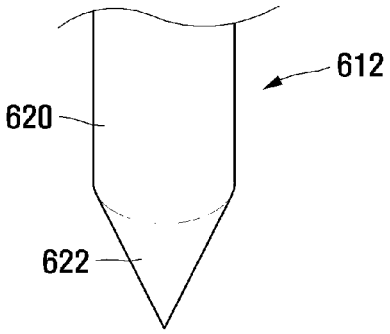
FIG. 56 is a perspective view of 'VII' part of FIG. 55 showing a punch according to the eighth embodiment of the present invention.

As shown in FIG. 56, the punch 612 comprises a supporting rod 620 perpendicularly extending from the lower surface of the pressing plate 610 so as to have a certain diameter, and a punching portion 622 having a conical shape and formed at the end of the supporting rod 620 for penetrating the sealing member 20 and punching a circular hole 626.

The punch 612 is downwardly moved when the pressing plate 610 is pressed thus to penetrate the sealing member 20 and to form the hole 626. Accordingly, the liquid material stored in the vessel 10 is discharged outwardly through the hole 626.

The reason why the hole 626 is formed at the sealing member 20 is in order to prevent the liquid material stored in the vessel 10 from being discharged out at one time by discharging the liquid material little by little through the hole 626.

The punch 612 can have various forms according to a kind of the liquid material stored in the vessel 10.

That is, the first punch 612 has a conical shape at an end thereof, and is preferably applied when the material stored in the vessel 10 is a liquid material such as edible oil, shampoo, etc. or a liquid material having a certain concentration.

Figure 57:
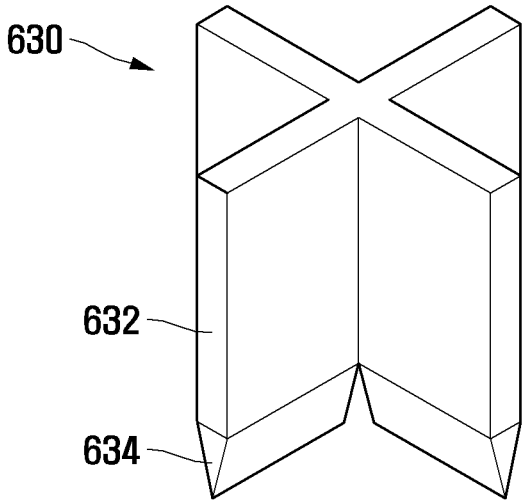
FIG. 57 is a perspective view showing the punch of the eighth embodiment according to another embodiment of the present invention corresponding to FIG. 56.

When the material stored in the vessel 10 is a solid material having a certain size, a hole having a cross shape is formed at the sealing member 20 in order to discharge the material stored in the vessel 10 out one by one. That is, as shown in FIG. 57, a second punch 630 comprises a rod portion 632 perpendicularly extending from the lower surface of the pressing plate 610 and having a sectional surface of a cross shape, and a punching portion 634 sharply formed at the end of the rod portion 632 for penetrating the sealing member 20.

The second punch 630 forms a hole of a cross shape at the sealing member 20. Therefore, the solid material stored in the vessel 10 such as a pill, etc. is hooked at the hole thus to be discharged out one by one.

Figure 58:
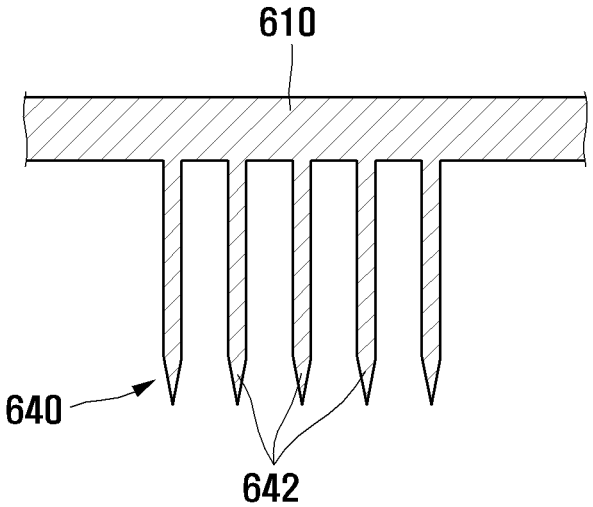
FIG. 58 is a sectional view showing the punch of the eighth embodiment of the present invention according still to another embodiment of the present invention corresponding to FIG. 56.

As shown in FIG. 58, a third punch 640 is applied when the material stored in the vessel 10 is a powder-type material, and has a plurality of pins 642 at the lower surface of the pressing plate 610. That is, the third punch 640 is constructed so that the powder stored in the vessel 10 can be slowly discharged out through a plurality of minute holes formed at the sealing member 20 when the vessel 10 is shaken.

The punch can have various forms according to a kind of the material stored in the vessel besides the aforementioned forms.

The connection portion 614 is formed between an outer circumferential surface of the pressing plate 610 and an inner circumferential surface of the body 600 as a thin film having a dome shape. Also, the connection portion 614 is elastically transformed when the pressing plate 610 is pressed by a force more than a certain degree, thereby guiding the pressing plate 610 to be moved in a lower direction.

The connection portion 614 elastically maintains a current position of the pressing plate 610. That is, when the pressing plate 610 is upwardly protruding, the connection portion 614 has a convex dome shape and maintains the current state of the pressing plate 610. However, when the pressing plate 610 is pressed by a force more than a certain degree, the connection portion 614 is elastically transformed into a concave shape and maintains the pressed state of the pressing plate 610.

An operation of the vessel cap according to the present invention will be explained.

Figure 59:
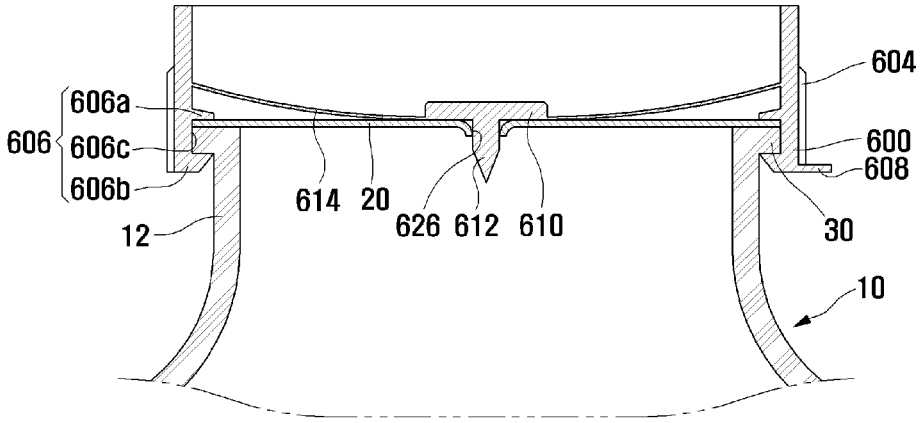
FIGS. 59 and 60 are views showing an operation of the vessel cap according to the eighth embodiment of the present invention.
Figure 60:
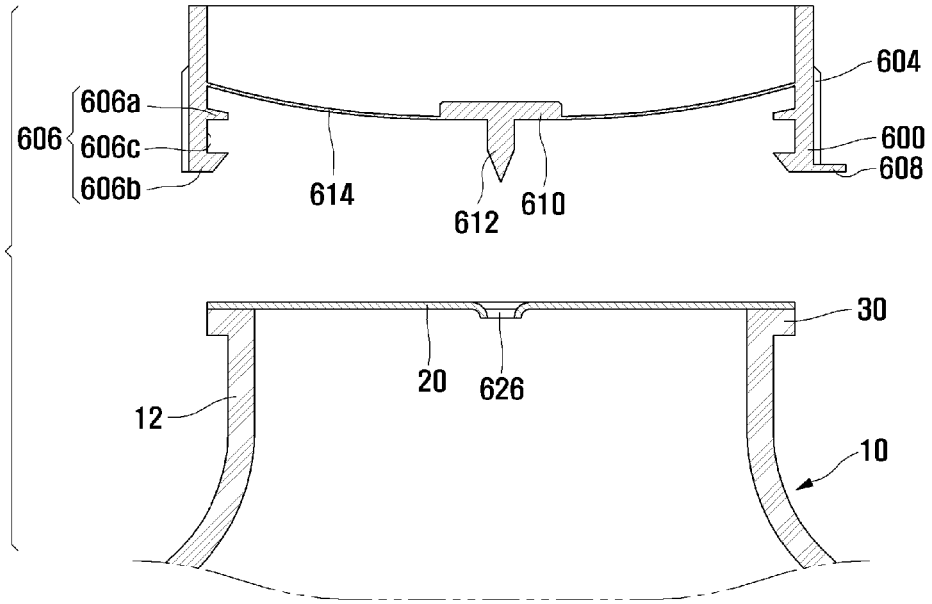

FIGS. 59 and 60 are views showing an operation of the vessel cap according to the eighth embodiment of the present invention.

When the pressing plate 610 is downwardly pressed in order to discharge the liquid material stored in the vessel 10 outwardly, the connection portion 614 is elastically transformed and the pressing plate 610 is downwardly moved. Then, the punch 612 formed at the lower surface of the pressing plate 610 penetrates the sealing member 20 thus to form the hole 626 at the sealing member 20.

The hole 626 can have various sizes and forms according to a kind of the material stored in the vessel 10.

When the handgrip 608 formed at the body 600 is upwardly pulled, the hooking jaw 30 formed at an upper surface of the vessel inlet 12 is detached from the hooking groove 606*c* formed at an inner circumferential surface of the body 600. Accordingly, the vessel cap is detached from the vessel inlet 12.

As the result, the punch 612 is detached from the sealing member 20, and the hole 626 through which the material stored in the vessel 10 is discharged out is formed at the sealing member 20.

Figure 61:
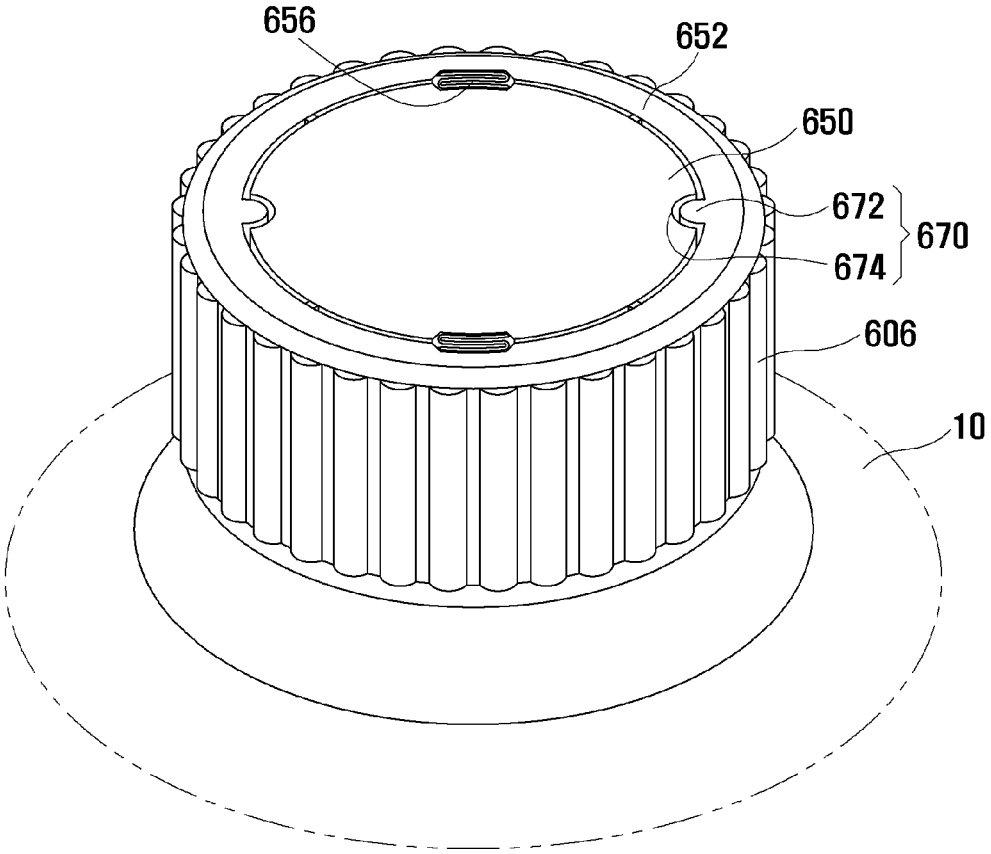
FIG. 61 is a perspective view showing a vessel cap according to the ninth embodiment of the present invention.
Figure 62:
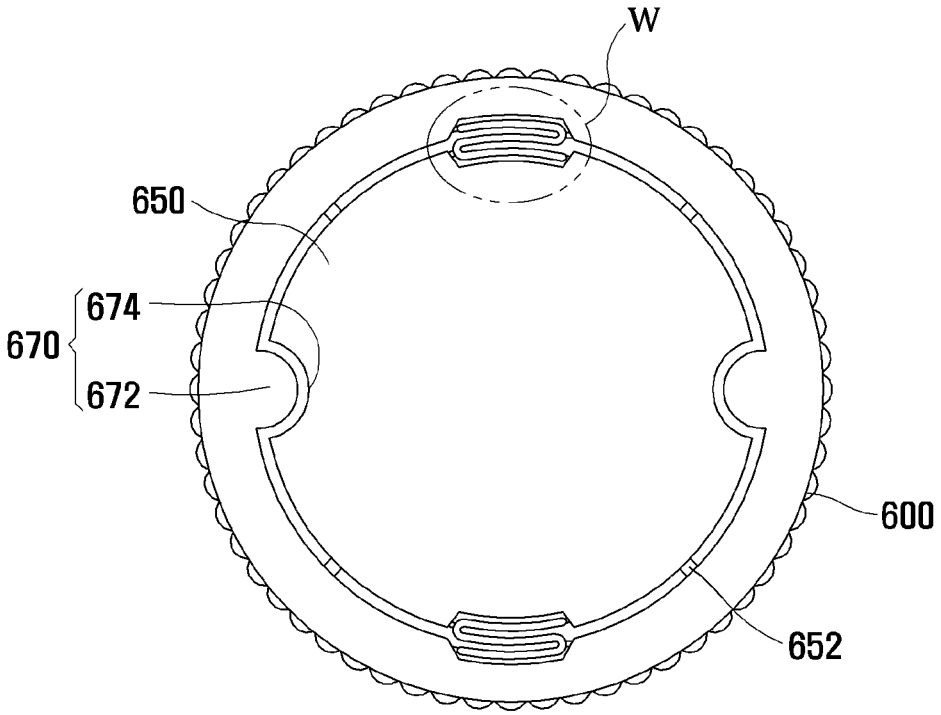
FIG. 62 is a top view showing the vessel cap according to the ninth embodiment of the present invention.
Figure 62B:
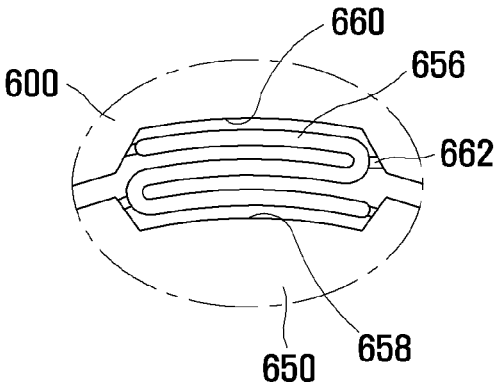
FIG. 62B is an enlarged sectional view of 'W' part of FIG. 62.
Figure 63:
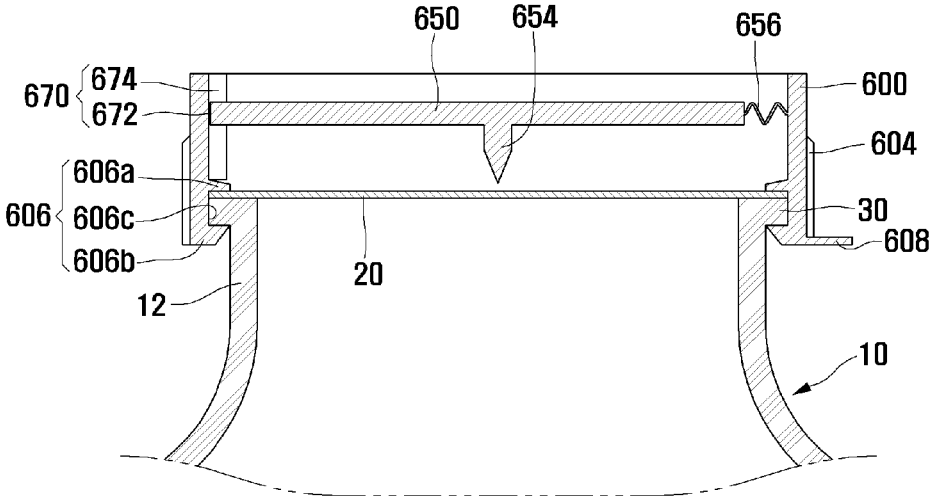
FIG. 63 is a sectional view showing the vessel cap according to the ninth embodiment of the present invention.

FIG. 61 is a perspective view showing a vessel cap according to the ninth embodiment of the present invention, FIG. 62 is a top view showing the vessel cap according to the ninth embodiment of the present invention, and FIG. 63 is a sectional view showing the vessel cap according to the ninth embodiment of the present invention.

The vessel cap according to the ninth embodiment of the present invention comprises a body 600 mounted at a vessel inlet 12 through which a liquid material stored in a vessel 10 is discharged outwardly and having a certain space therein, a pressing plate 650 disposed in the body 600 to be movable in upper and lower directions and pressed by a user, a locking rib 652 formed between the pressing plate 650 and an inner circumferential surface of the body 600 for locking the pressing plate 650 to the inner circumferential surface of the body 600 and releasing the locked state only when the pressing plate 650 is pressed by a force more than a certain degree, and a punch 654 formed at the lower surface of the pressing plate 650 for punching the sealing member 20 attached to the vessel inlet 12 when the pressing plate 650 is downwardly moved and thus discharging the material stored in the vessel outwardly.

The pressing plate 650 is formed as a disc shape having an approximately same diameter as an inner diameter of the body 600, and is movable in upper and lower directions at an inner circumferential surface of the body 600.

The locking rib 652 is connected between an outer circumferential surface of the pressing plate 650 and an inner circumferential surface of the body 600, and maintains a fixed state of the pressing plate 650 to the body 600. The locking rib 652 releases the locked state between the pressing plate 650 and the body 600 with being cut when the pressing plate 650 is pressed by a force more than a certain degree.

The locking rib 652 is formed as a thin film to be cut when the pressing plate 650 is pressed by a force more than a certain degree, thereby guiding the pressing plate 650 to be downwardly moved.

A plurality of guide ribs 656 are connected between an outer circumferential surface of the pressing plate 650 and an inner circumferential surface of the body 600 with a certain gap, thereby guiding the pressing plate 650 to be downwardly moved under a connected state to the body 600.

The guide rib 656 is formed to have an 'S' shape, and has one end connected to the inner circumferential surface of the body 600 and another end connected to the outer circumferential surface of the pressing plate 650. When the pressing plate 650 is downwardly moved, the guide rib 656 is extended thereby to guide the pressing plate 650 to be downwardly moved and to maintain the connected state of the pressing plate 650 to the body 600.

The guide rib 656 is in a state of being inserted into an insertion groove 658 formed at the outer circumferential surface of the pressing plate 650 and an insertion groove 660 formed at the inner circumferential surface of the body 600. A connection belt 662 having a thin 'S' shape is formed between the two insertion grooves 658 and 660 and a curved portion of the guide rib 656. The connection belt 662 is cut when the pressing plate 650 is downwardly moved.

A lift supporting portion 670 for guiding the pressing plate 650 to be perpendicularly moved when the pressing plate 650 is downwardly moved is formed between the outer circumferential surface of the pressing plate 650 and the inner circumferential surface of the body 600.

The lift supporting portion 670 comprises at least one guide protrusion 672 perpendicularly formed at the inner circumferential surface of the body 600, and at least one guide groove 674 formed at the outer circumferential surface of the pressing plate 650 and moved in upper and lower directions along the guide protrusion 672 for inserting the guide protrusion 672.

When the pressing plate 650 is downwardly moved, the guide groove 674 formed at the outer circumferential surface of the pressing plate 650 is moved along the guide protrusion 672 formed at the inner circumferential surface of the body 600. Therefore, the lift supporting portion 670 guides the pressing plate 650 to be downwardly moved in a perpendicular direction, and guides the punch 654 to penetrate the sealing member 20 at a precise position.

Since the pressing plate 650 is fixed to the body 600 by the locking rib 652, the pressing plate 650 is prevented from being pressed even if an external force is applied thereto. When the user presses the pressing plate 650 with a force more than a certain degree, the locking rib 652 is cut thus to release the locked state of the pressing plate 650 and thereby the pressing plate 650 is downwardly moved.

Since the pressing plate 650 and the body 600 are connected to each other by the guide rib 656, the pressing plate 650 is prevented from being detached from the body 600. The lift supporting portion 670 guides the pressing plate 650 to be perpendicularly moved. The punch 654 has the same construction and operation as those of the aforementioned punch 612 of the eighth embodiment, and thus its detail explanation will be omitted.

An operation of the vessel cap according to the ninth embodiment of the present invention will be explained.

Figure 64:
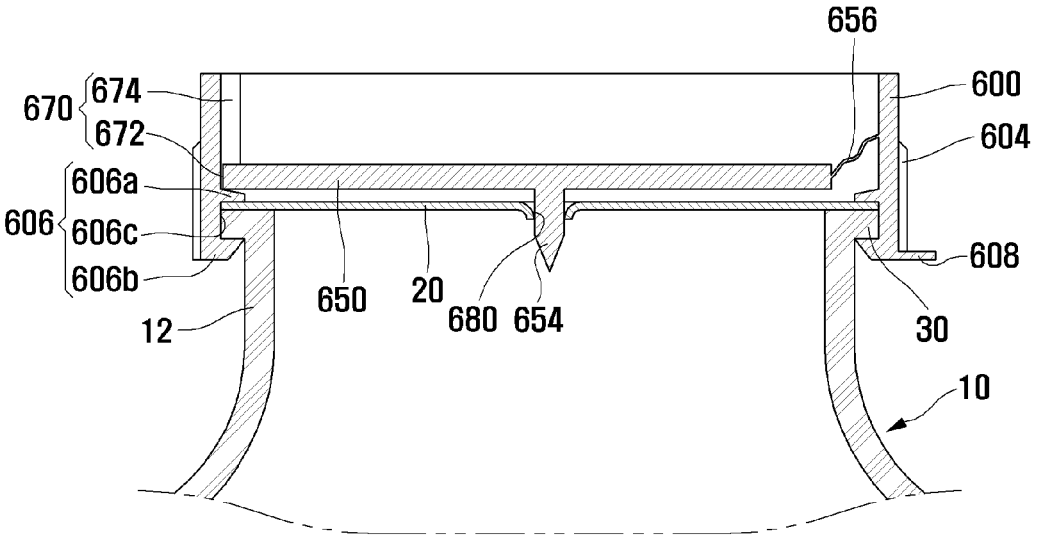
FIGS. 64 and 65 are views showing an operation of the vessel cap according to the ninth embodiment of the present invention.
Figure 65:
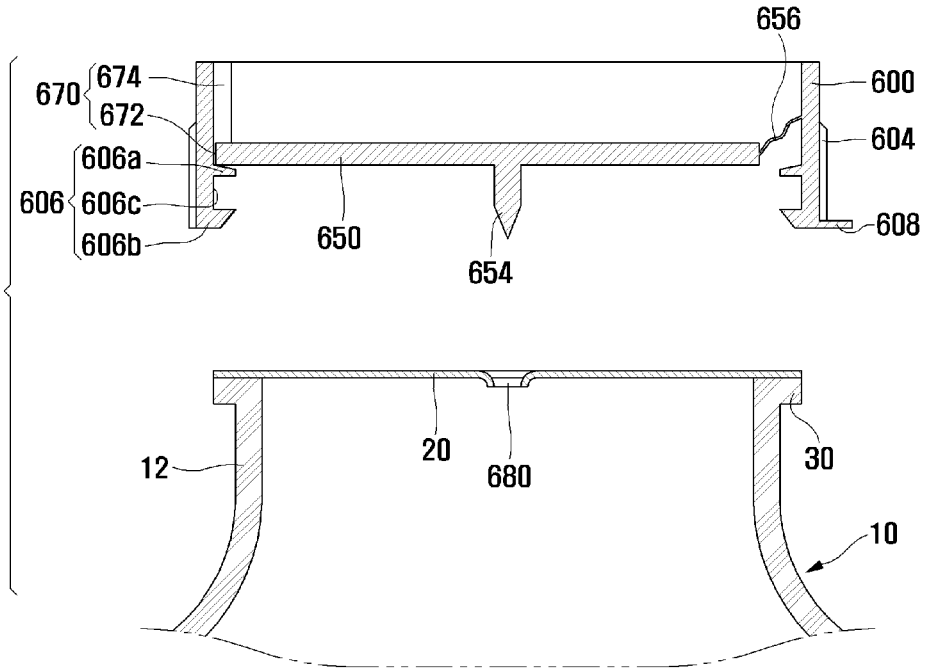

FIGS. 64 and 65 are views showing an operation of the vessel cap according to the ninth embodiment of the present invention.

When the vessel cap is not opened, the pressing plate 650 is in a locked state at the body 600 by the locking rib 652. Therefore, the pressing plate 650 is not pressed even if an external force is applied thereto.

When the pressing plate 650 is downwardly pressed in order to discharge the liquid material stored in the vessel 10 outwardly, the locking rib 652 is cut and the locked state of the pressing plate 650 is released. As the result, the pressing plate 650 is downwardly moved in the body 600. Then, the guide rib 656 having an 'S' shape and connected between the pressing plate 650 and the body 600 is extended, thereby guiding the pressing plate 650 to be downwardly moved under a connected state to the body 600.

When the pressing plate 650 is pressed, the punch 654 formed at a lower surface of the pressing plate 650 is downwardly moved to penetrates the sealing member 20 and to form a hole 680 at the sealing member 20.

When the pressing plate 650 is downwardly moved, the guide groove 674 formed at the outer circumferential surface of the pressing plate 650 is perpendicularly moved under an inserted state to the guide protrusion 672 formed at the inner circumferential surface of the body 600. Therefore, the hole 680 can be precisely formed at a desired position of the sealing member 20 by the punch 654.

When the handgrip 608 formed at the body 600 is upwardly pulled, the hooking jaw 30 formed at an upper surface of the vessel inlet 12 is detached from the hooking groove 606*c* formed at an inner circumferential surface of the body 600. Accordingly, the vessel cap is detached from the vessel inlet 12.

Then, the punch 654 is detached from the sealing member 20, and thus the hole 680 through which the liquid material stored in the vessel 10 is discharged out, is formed at the sealing member 20.

Therefore, the material stored in the vessel 10 is discharged out through the hole 680.

Figure 66:
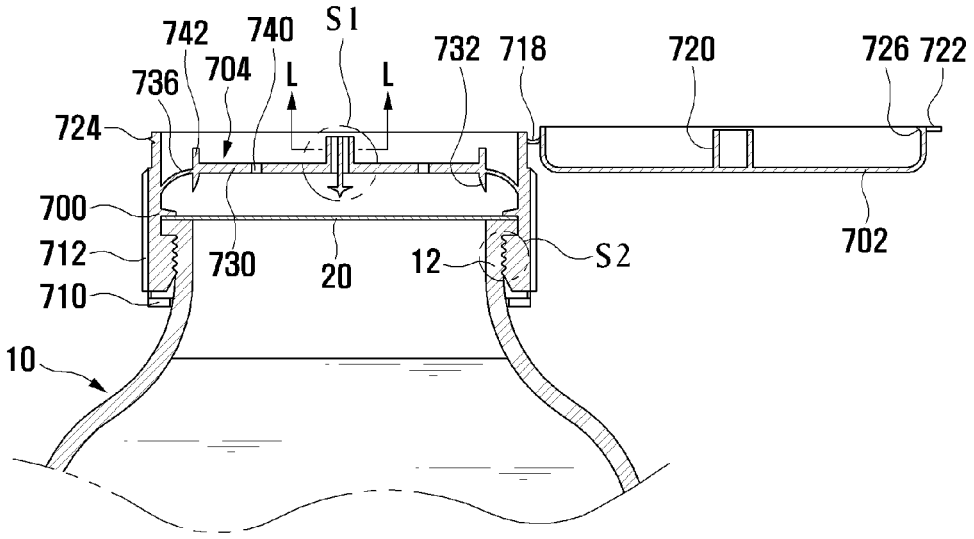
FIG. 66 is a sectional view showing a vessel cap according to the tenth embodiment of the present invention.
Figure 66B:
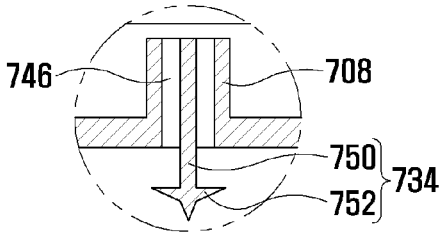
FIG. 66B is an enlarged sectional view of 'S1' part of FIG. 66.
Figure 66C:
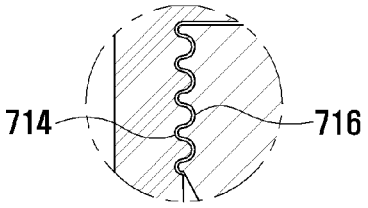
FIG. 66C is an enlarged sectional view of 'S2' part of FIG. 66.

FIG. 66 is a sectional view showing a vessel cap according to the tenth embodiment of the present invention.

A vessel cap according to the tenth embodiment of the present invention comprises a body 700 mounted at a vessel inlet 12 of a vessel 10 and having a certain space therein, a cover 702 openably/closably mounted at an upper end of the body 700 for opening and closing the body 700, a sealing member removing unit 704 formed in the body 700 for removing a sealing member 20 attached to the vessel inlet 12 when the vessel cap is detached from the vessel inlet 12 and storing the removed sealing member 20 in the body 700, and a discharge pipe 708 formed in the body 700 for discharging the material stored in the vessel 10 outwardly.

The vessel 10 stores a liquid material or a solid material therein, and the sealing member 20 for sealing the vessel inlet 12 and thus protecting the liquid material or the solid material is attached to the vessel inlet 12 through which the liquid material or the solid material is discharged outwardly. Preferably, the sealing member 20 is formed of a material that can be easily removed by a knife, etc. such as paper, an aluminum thin plate, etc.

The body 700 has a cylindrical shape, and a plurality of concave-convex protrusions 712 for facilitating to rotate the vessel cap by a user's hand are formed at an outer circumferential surface of the body 700. A female screw portion 716 is formed at a lower inner circumferential surface of the body 700, and is coupled to a male screw portion 714 formed at an outer circumferential surface of the vessel inlet 12.

A skirt portion 710 for fixing the vessel cap to the vessel inlet 12 is formed at a lower end of the body 700. When the vessel cap is opened, the skirt portion 710 is removed thus to be detached from the vessel inlet 12.

The cover 702 is hinge-connected to one side of the body 700 by a connection film 718, and is openably mounted at an upper end of the body 700. A discharge pipe closing portion 720 for closing the discharge pipe 708 upwardly protruding from the center of the body 700 is formed in the cover 702 with a cylindrical shape. A handgrip 722 held by the user to open and close the cover 702 is formed at one side of the cover 702. A hooking protrusion 726 locked by a hooking jaw 724 protruding from an upper end of the body 700 is formed at an inner side surface of the cover 702.

The sealing member removing unit 704 comprises a pressing plate 730 disposed in the body 700 to be movable in upper and lower directions and pressed by a user, a cutter 44 formed at an edge of a lower surface of the pressing plate 730 in a circumferential direction with the same gap for penetrating a sealing member 20 when the pressing plate 730 is pressed and cutting the sealing member 20 when the body 700 is rotated, a hooking portion 734 downwardly extending from the pressing plate 730 for hooking the sealing member 20 so that the sealing member 20 cut by a cutter 732 can be stored in the body 16, and a connection portion 736 formed between an outer circumferential surface of the pressing plate 730 and an inner circumferential surface of the body 700 for guiding the pressing plate 730 to be moved in upper and lower directions and supporting a moved position of the pressing plate 730 by its elastic force.

The pressing plate 730 is formed as a disc shape having a diameter smaller than an inner diameter of the body 700, and is disposed at a position lower than an upper surface of the body 700. The discharge pipe 708 is formed at the center of the pressing plate 730.

An inlet 740 for returning the liquid material flowing on an outer circumferential surface of the discharge pipe 708 after being discharged through the discharge pipe 708 into the vessel 10 is formed at the pressing plate 730. Also, a leakage preventing wall 742 for preventing the material flowing through the discharge pipe 708 from being discharged out is upwardly extending from an edge of the pressing plate 730.

That is, when the liquid material remaining after being discharged through the discharge pipe 708 flows down along the outer circumferential surface of the discharge pipe 708, the liquid material is collected at an upper surface of the pressing plate 730 by the leakage preventing wall 742. Then, the collected liquid material is introduced into the vessel through the inlet 740.

The discharge pipe 708 is protruding from the upper surface of the pressing plate 730, and has a discharge passage 746 through which the liquid material stored in the vessel is discharged out. The hooking portion 734 is formed at the discharge passage 746 in a longitudinal direction.

Figure 67:
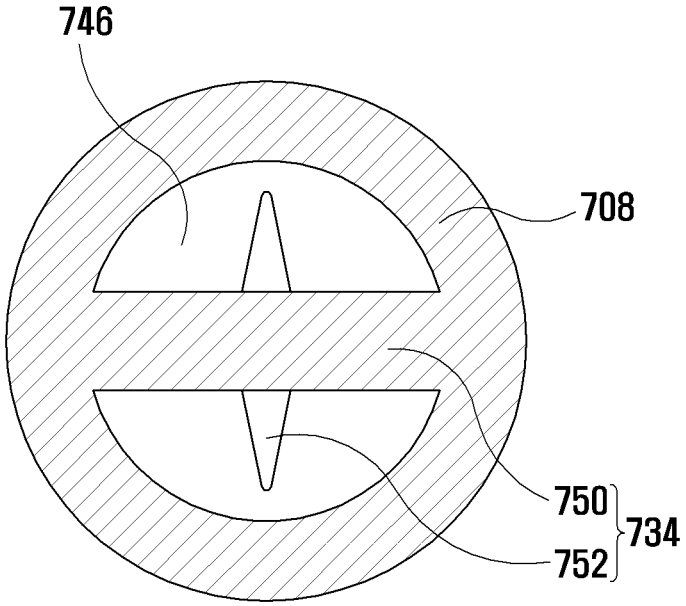
FIG. 67 is a partial sectional view taken along line L-L of FIG. 66.
Figure 68:
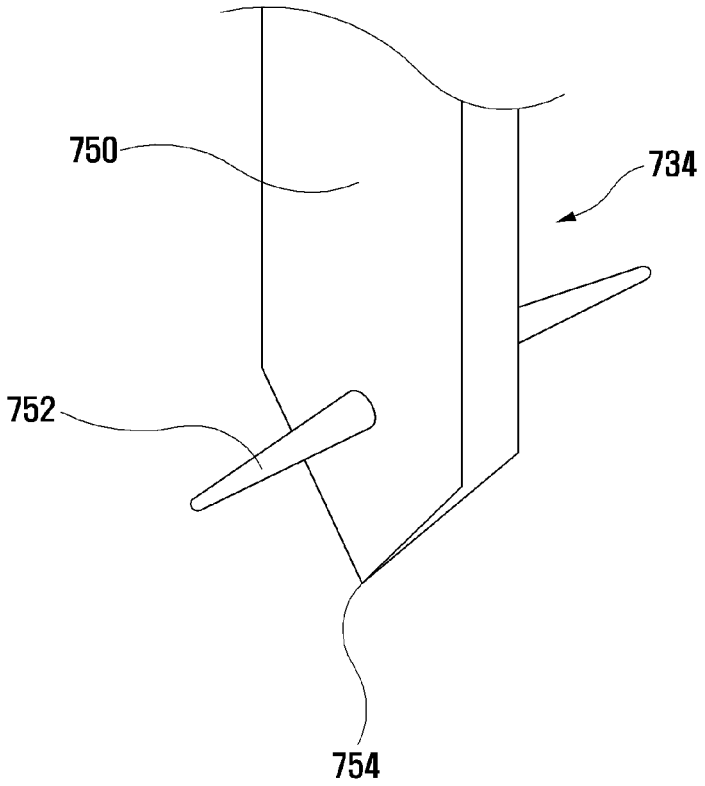
FIG. 68 is a perspective view of 'VIII' part of FIG. 66 showing a part of the hooking portion of the vessel cap according to the tenth embodiment of the present invention.

As shown in FIGS. 67 and 68, the hooking portion 734 comprises a supporting rod 750 integrally formed at an inner circumferential surface of the discharge passage 746 and downwardly extending from the pressing plate 730 for penetrating the sealing member 20, and at least one hooking protrusion 752 formed at a side surface of the supporting rod 750 for hooking the sealing member 20 so as to store the sealing member 20 cut by the cutter 732 in the body 700.

The supporting rod 750 is formed as a square bar shape downwardly extending from an inner circumferential surface of the discharge passage 746, and a punch portion 754 having a sharp shape to penetrate the sealing member 20 is formed at the end of the supporting rod 750.

The hooking protrusion 752 formed to be elastically transformed is upwardly bent at the time of penetrating the sealing member 20. Then, the hooking protrusion 752 passes through a hole formed by the punch portion 754 thus to penetrate the sealing member 20. After the hooking protrusion 752 is positioned at an inner side of the sealing member 20, it is extended into the original state thereby to be hooked at an inner surface of the sealing member 20.

At least one hooking protrusion 752 is perpendicularly extending from both side surfaces of the supporting rod 176 with a certain length.

Figure 69:
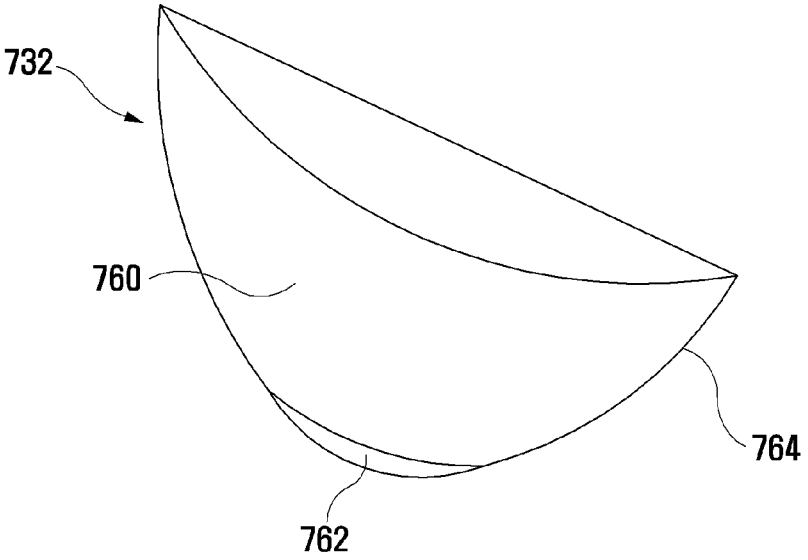
FIG. 69 is a perspective view of 'IX' part of FIG. 66 showing a part of the cutter according to the tenth embodiment of the present invention.

As shown in FIG. 69, the cutter 732 comprises a plurality of supporting portions 760 formed at an edge of a lower surface of the pressing plate 730 with the same gap, a first cutting portion 762 sharply formed at a lower end of the supporting portion 760 and downwardly moved when the pressing plate 730 is pressed for penetrating the sealing member 20, and a second cutting portion 764 formed on at least one side surface of both side surfaces of the supporting portion 760 for cutting the sealing member 20 as a circular shape with being rotated under a contact state to an inner circumferential surface of the vessel inlet 12 when the body 700 is rotated.

The connection portion 736 is formed between an outer circumferential surface of the pressing plate 730 and an inner circumferential surface of the body 700 as a thin film having a dome shape. Also, the connection portion 736 is elastically transformed when the pressing plate 730 is pressed by a force more than a certain degree, thereby guiding the pressing plate 730 to be moved in a lower direction.

The connection portion 736 elastically maintains a current position of the pressing plate 730. That is, when the pressing plate 730 is upwardly protruding, the connection portion 736 has a convex dome shape and maintains the current state of the pressing plate 730. However, when the pressing plate 730 is pressed by a force more than a certain degree, the connection portion 736 is elastically transformed into a concave shape and maintains the pressed state of the pressing plate 730.

An operation of the vessel cap according to the tenth embodiment of the present invention will be explained.

Figure 70:
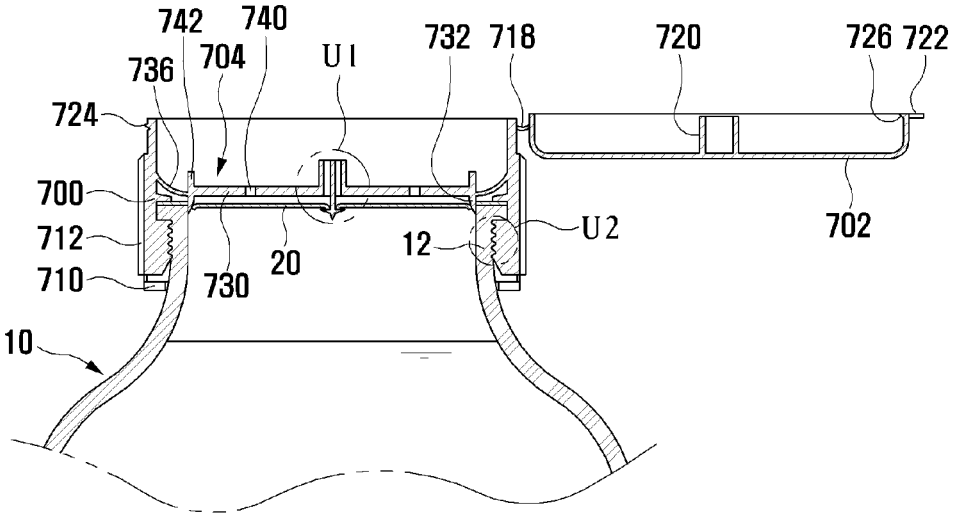
FIGS. 70 and 71 are views showing an operation of the vessel cap according to the tenth embodiment of the present invention.
Figure 70B:
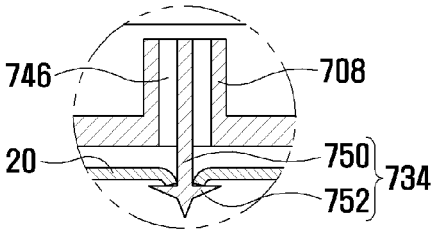
FIG. 70B is an enlarged sectional view of 'U1' part of FIG. 70.
Figure 70C:
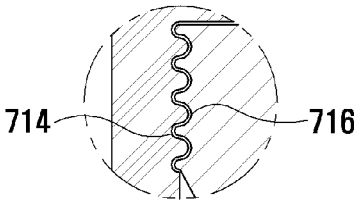
FIG. 70C is an enlarged sectional view of 'U2' part of FIG. 70.
Figure 71:
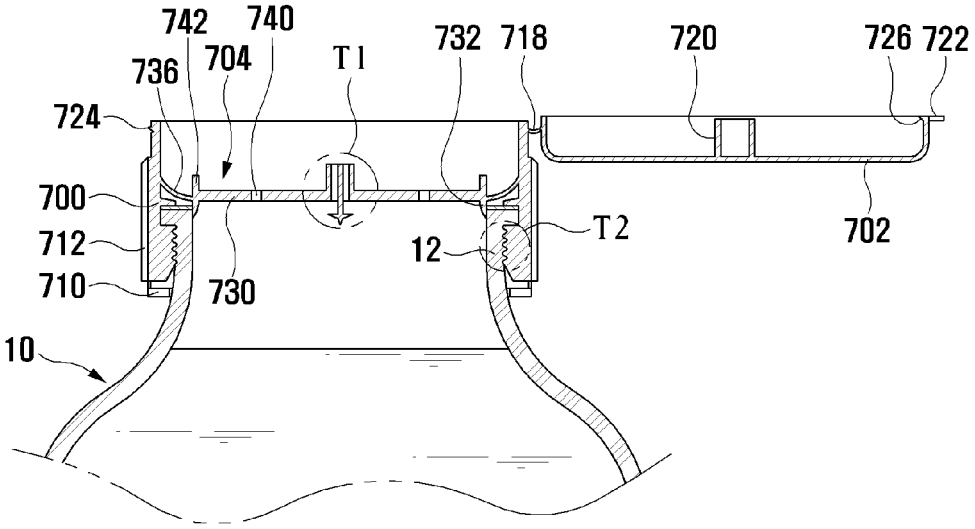
Figure 71B:
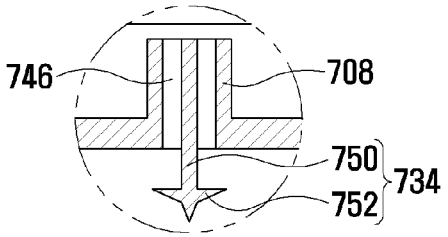
FIG. 71B is an enlarged sectional view of 'T1' part of FIG. 71.
Figure 71C:
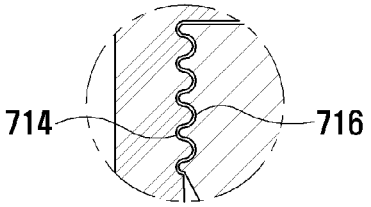
FIG. 71C is an enlarged sectional view of 'T2' part of FIG. 71.

FIGS. 70 and 71 are views showing an operation of the vessel cap according to the tenth embodiment of the present invention.

When the user opens the cover 702 with holding the handgrip 722 and then presses the pressing plate 730 downwardly, the connection portion 736 is elastically transformed and the pressing plate 730 is downwardly moved. Then, the first cutting portion 762 of the cutter 732 formed at a lower surface of the pressing plate 730 penetrates an edge of the sealing member 20, and the supporting rod 750 of the hooking portion 734 penetrates a center of the sealing member 20.

The hooking protrusion 752 of the hooking portion 734 is inserted into a hole formed by the punch portion 754 of the supporting rod 750 with being upwardly bent. After the supporting protrusion 752 is positioned at an inner side of the sealing member 20, it is elastically transformed into the original state thus to be extended and positioned at the inner side of the sealing member 20.

Then, if the body 700 is rotated by the user's hand in a direction that the vessel cap is opened, the cutter 732 is rotated under a contact state to an inner circumferential surface of the vessel inlet 12. Accordingly, the second cutting portion 764 formed at both side surfaces of the supporting portion 760 cuts the sealing member 20 as a circular shape.

Since the sealing member 20 that has been removed from the vessel inlet 12 is locked by the hooking protrusion 752 of the hooking portion 734, it is detached from the vessel inlet 12 together with the body 700 thus to be stored in the body 700.

After detaching the sealing member 20 received in the body 700 from the body 700, the body 700 is mounted at the vessel inlet 12 with being rotated. As the result, the vessel cap is mounted at the vessel inlet 12 under a state that the sealing member 20 has been removed. Also, when the vessel 10 is inclined, the liquid material stored in the vessel 10 is discharged out through the discharge passage 746 of the discharge pipe 708.

The liquid material remaining at an inlet of the discharge pipe 708 and flowing down along an outer circumferential surface of the discharge pipe 708 is collected at an upper surface of the pressing plate 730. The collected liquid material returns into the vessel 10 through the inlet 740 formed at the pressing plate 730.

Figure 72:
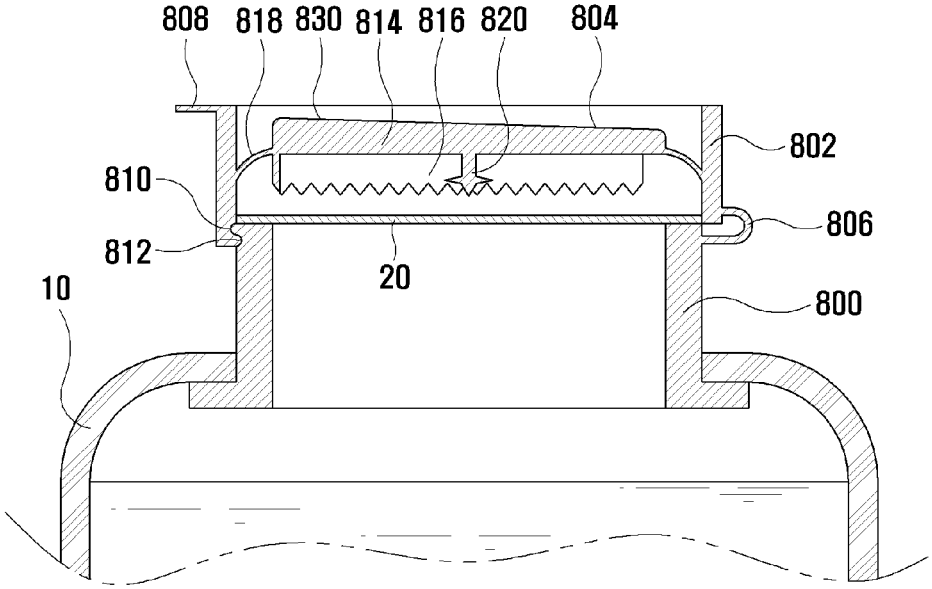
FIG. 72 is a sectional view showing a vessel cap according to the eleventh embodiment of the present invention.
Figure 73:
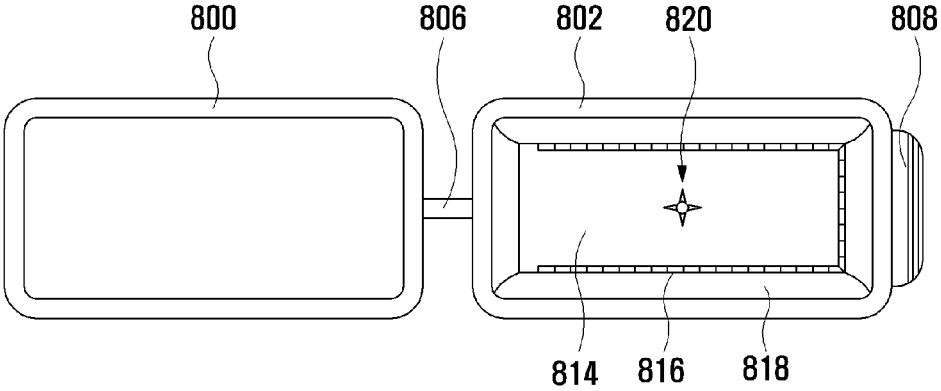
FIG. 73 is a frontal view showing the vessel cap according to the eleventh embodiment of the present invention.

FIG. 72 is a sectional view showing a vessel cap according to the eleventh embodiment of the present invention, and FIG. 73 is a frontal view showing the vessel cap according to the eleventh embodiment of the present invention.

A vessel cap according to the eleventh embodiment of the present invention comprises a body 800 mounted at a vessel 10 and having opened upper and lower surfaces for discharging a liquid material stored in the vessel, a cover 802 openably/closably mounted at an upper end of the body 800 for opening and closing the body 800, and a sealing member removing unit 804 formed in the cover 802 for removing a sealing member 20 attached to the body 800 when the cover 802 is opened from the body 800 and storing the removed sealing member 20 in the body 800.

The body 800 has a rectangular shape, and upper and lower surfaces thereof are opened. The sealing member 20 for protecting the liquid material stored in the vessel is attached to the upper surface of the body 800, and the lower surface of the body 800 is fixed to the vessel 10. The body 800 can have not only the rectangular shape but also various shapes such as a circular shape, a polygonal shape, etc.

The cover 802 is connected to the body 800 by a connection rib 806, and is openably mounted at the body 800. A handgrip 808 held by the user is formed at one side of the cover 802. Also, a hooking jaw 812 hooked by a hooking protrusion 810 protruding from an outer circumferential surface of the body 800 is formed at an inner surface of the cover 802.

The sealing member removing unit 804 comprises a pressing plate 814 disposed in the cover 802 to be movable in upper and lower directions and pressed by the user, a cutter 816 formed at an edge of a lower surface of the pressing plate 814 in a circumferential direction for penetrating a sealing member 20 when the pressing plate 814 is pressed and cutting the sealing member 20 when the body 800 is rotated, a hooking portion 820 downwardly extending from the pressing plate 814 for hooking the sealing member 20 so as to store the sealing member 20 cut by the cutter 816 in the cover 802, and a connection portion 818 connected between an outer circumferential surface of the pressing plate 814 and an inner circumferential surface of the cover 802 for guiding the pressing plate 814 to be moved in upper and lower directions and supporting a moved position of the pressing plate 814 by its elastic force.

The cover 802 has a rectangular shape, and the pressing plate 814 is connected to an inner circumferential surface of the cover 802 by the connection portion 818.

When one side of the pressing plate 814 is pressed, another side of the pressing plate 814 is not pressed due to the rectangular shape thereof. In order to prevent the problem, an inclination surface 830 is formed at an upper surface of the pressing plate 814 and thus each position of the pressing plate 814 is sequentially pressed from a high position to a low position.

Figure 74:
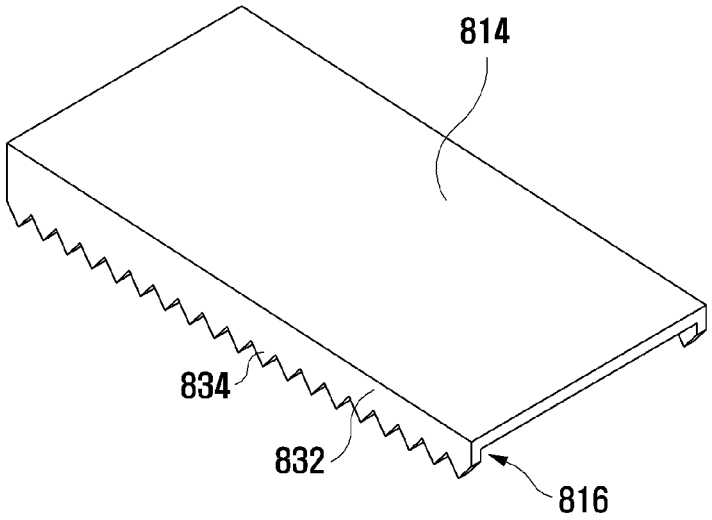
FIG. 74 is a perspective view showing a cutter of the vessel cap according to the eleventh embodiment of the present invention.
Figure 75:
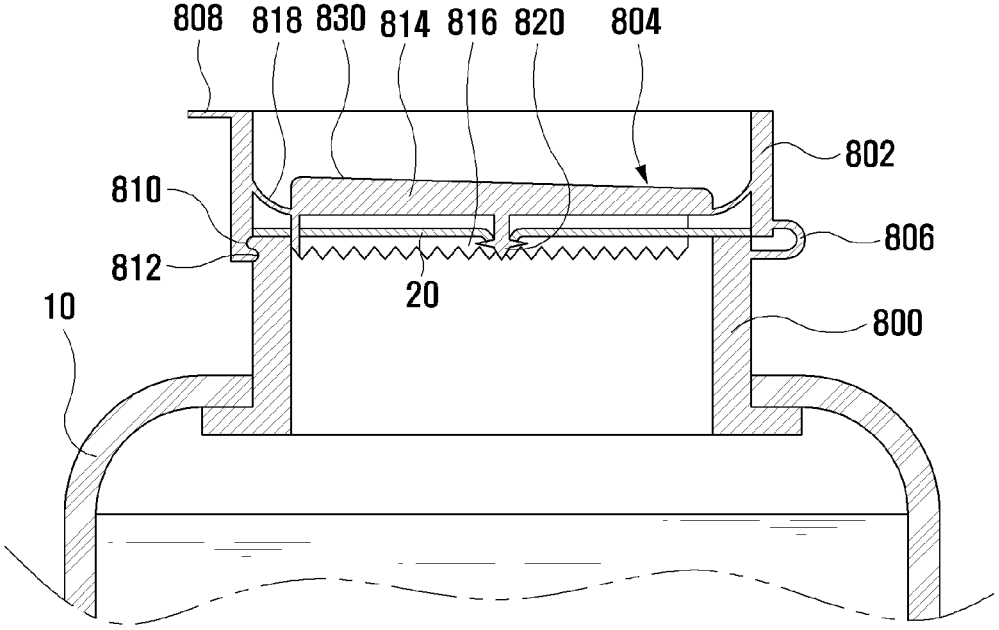
FIGS. 75 and 76 are views showing an operation of the vessel cap according to the eleventh embodiment of the present invention.
Figure 76:
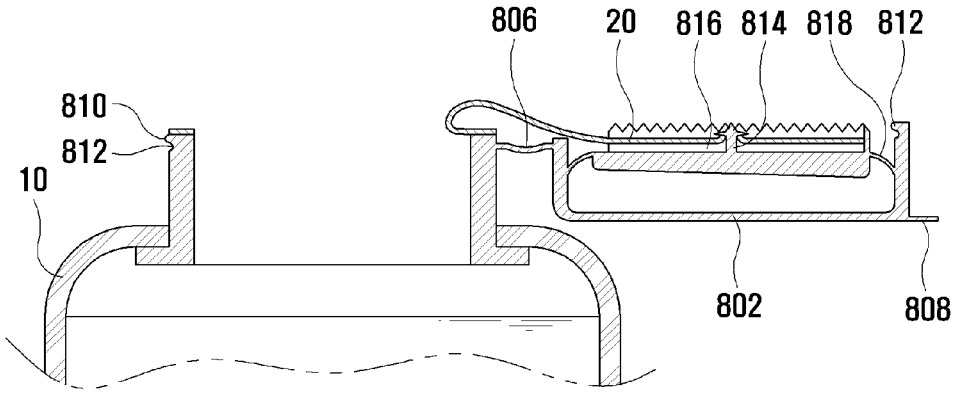
Figure 77:
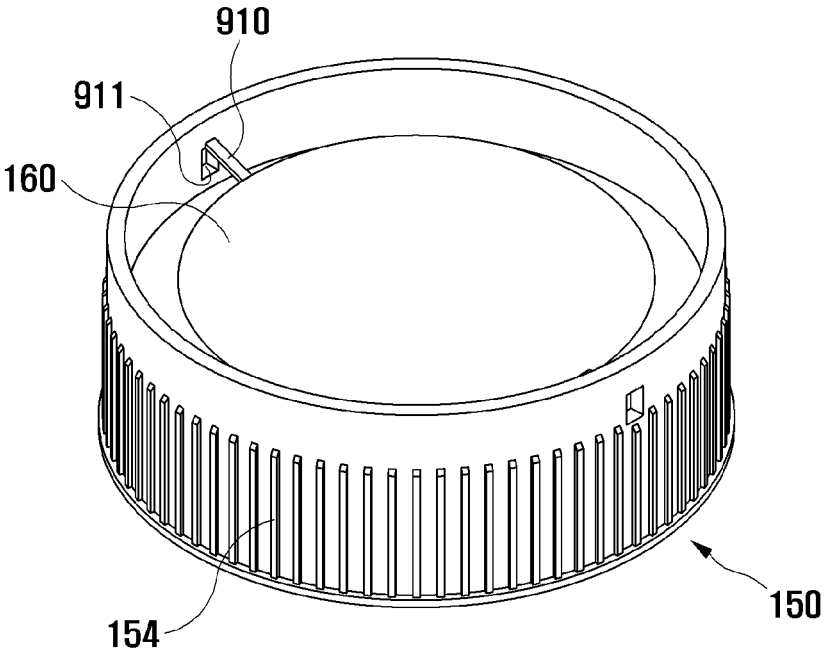
FIG. 77 is a perspective view showing the vessel cap according to the twelfth embodiment of the present invention.
Figure 78:
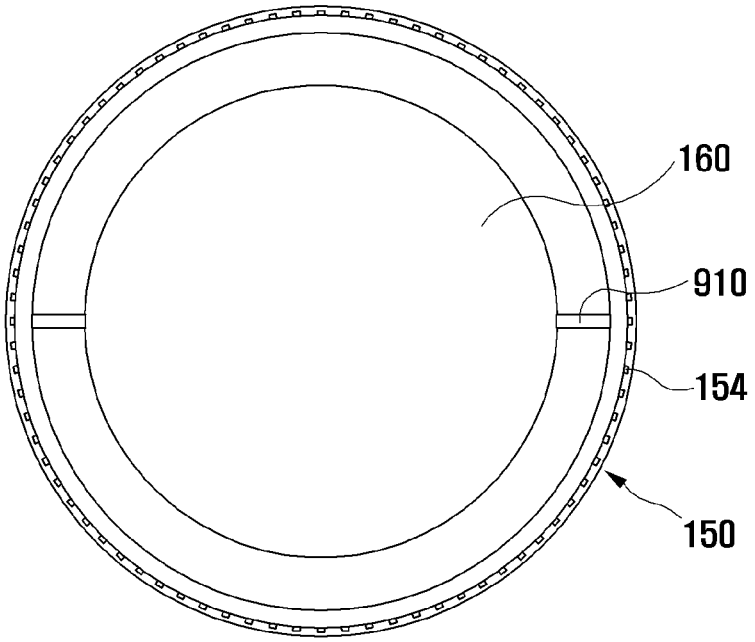
FIG. 78 is a plane view of the vessel cap of FIG. 77.
Figure 79:
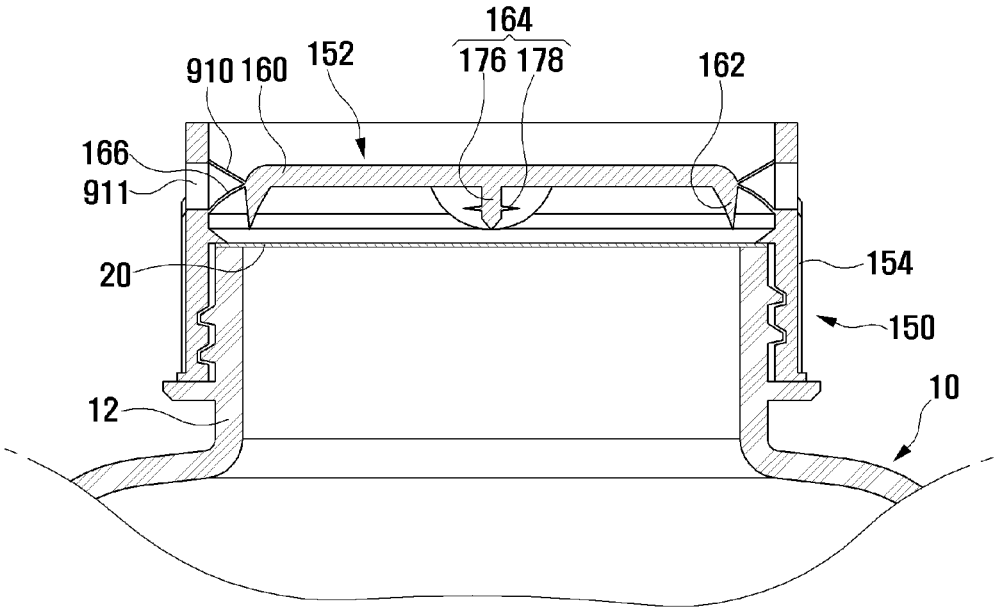
FIG. 79 is a sectional view of the vessel cap of FIG. 77.
Figure 80:
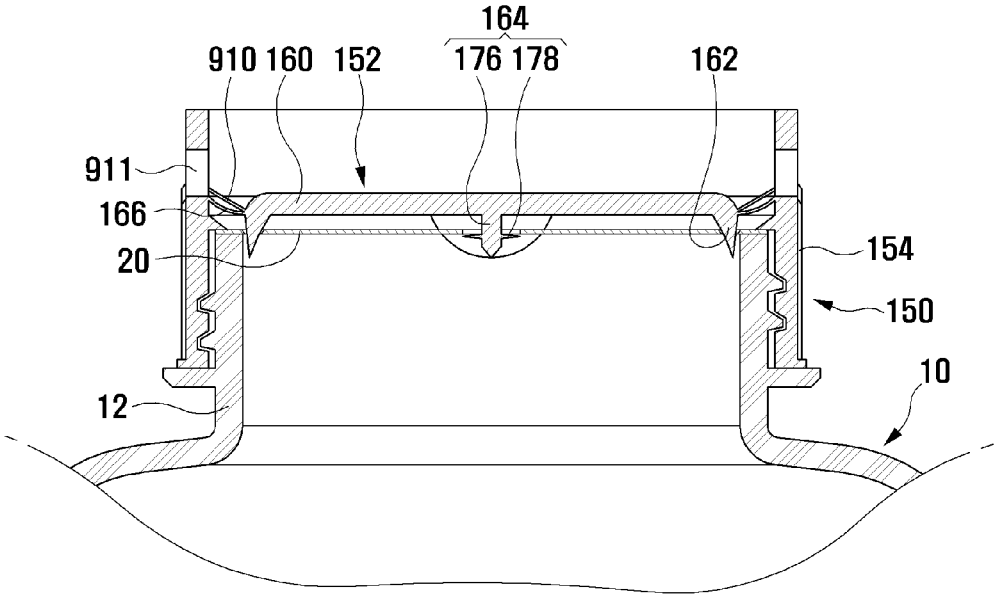
FIG. 80 is a sectional view showing operation of the vessel cap of FIG. 77.
Figure 81:
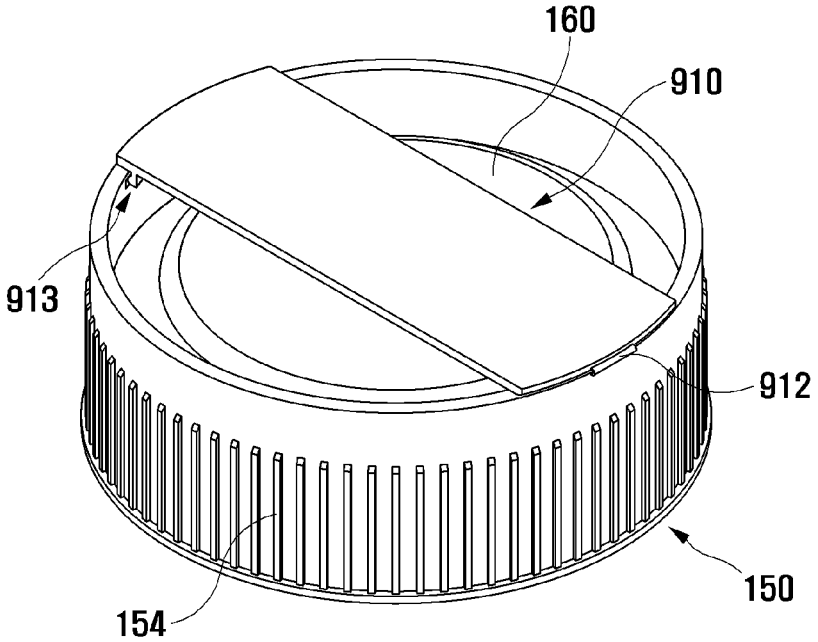
FIG. 81 is a perspective view showing the vessel cap according to the thirteenth embodiment of the present invention.
Figure 82:
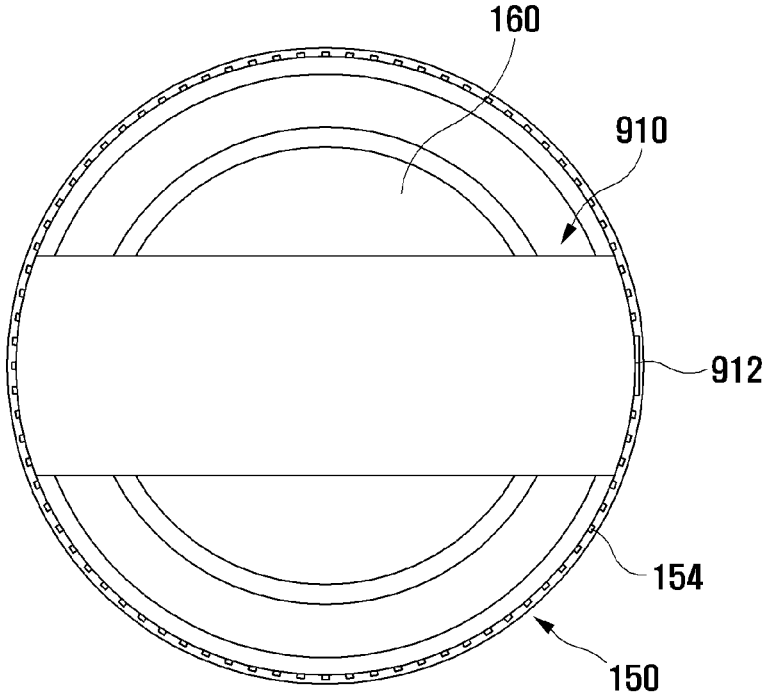
FIG. 82 is a plane view of the vessel cap of FIG. 81.

As shown in FIG. 74, the cutter 816 comprises a supporting portion 832 formed at a lower surface of the pressing plate 814 along an edge of the pressing plate 814 as a 'C' shape, and a cutting portion 834 formed at the end of the supporting portion 832 and having a saw blade for penetrating an edge of the sealing member 20 as a 'C' shape and thus cutting the sealing member 20 as a 'C' shape when the pressing plate 814 is pressed.

When the cutter 816 is downwardly moved to cut the sealing member 20, the supporting portion 832 is formed as a 'C' shape. Therefore, one side among four sides of the sealing member 20, that is, one side connected to the body 800 and the cover 802 is not removed but maintains the connected state to the body 800.

The hooking portion 820 and the connection portion 818 has the same construction and operation as those of the hooking portion and the connection portion of the tenth embodiment, and thus their detail explanation will be omitted.

An operation of the vessel cap according to the eleventh embodiment will be explained as follows.

When the user presses the pressing plate 814, the cutter 816 is lowered thus to penetrate three sides of the sealing member 20 and to cut the three sides. One side of the sealing member 20 is connected to the body 800.

Since the inclination surface 830 is formed at the upper surface of the pressing plate 814, each position of the pressing plate 814 is evenly pressed from a high position to a low position.

When the pressing plate 814 is pressed, the hooking portion 820 is together lowered to penetrate the sealing member 20 and thus the sealing member 20 is locked by the hooking portion 820.

Under the state, when the cover 802 is detached from the body 800 with holding the handgrip 808 of the cover 802, the cover 802 is rotated centering around the connection rib 806 thereby to be opened from the body 800. Since the three sides of the sealing member 20 are in a cut state, they are separated from the body 800 together with the cover 802. Since one side of the sealing member 20 is attached to the body 800, the sealing member 20 is rotated centering around the connected portion to the body thereby to be detached from the body 800.

Meanwhile, since the pressing plate may be unexpectedly pressed and the pressing plate breaks the sealing member, it is necessary to prevent the pressing plate from being unexpectedly pressed, in case of the vessel cap having the pressing plate.

FIGS. 77 to 80 show modified examples of one of the vessel caps of the first to third embodiments, particularly modified example of the vessel cap of FIG. 19.

The vessel cap is further comprised of a safety member 910 for preventing the pressing plate 160 from being pressed, in addition to one of the structures of the vessel caps of the first to third embodiments.

As shown in FIGS. 77 to 80, one end of the safety member 910 is connected to an upper inner portion of the body 150, and the other end of the safety member 910 is connected to the pressing plate 160, and the safety member 910 is broken when the pressing plate 160 is pressed with more than a predetermined value of force. The reference number 911 indicates a through hole formed in the body 150 for molding the safety member 910 by using a die.

The safety member 910 prevents the pressing plate 160 from being unexpectedly pressed until the pressing force exceeds the predetermined value.

Meanwhile, when the user wishes to remove the sealing member 20, the user presses the pressing plate 160 with more than the predetermined force, for breaking the safety member 910, and then removes the sealing member 20.

In addition, the safety member 910 may be a member connected with the body 150 of the vessel cap.

FIGS. 81 to 88 show the vessel cap in accordance with the thirteenth embodiment of the present invention.

The safety member 910, as shown in FIGS. 81 to 84, covers at least partially the pressing plate 160, and one end of the safety member 910 is rotatably connected to an upper portion of the body 150, and the other end of the safety member 910 is separatably coupled with an upper portion of the body 910 by a hooking unit 913.

That is to say, one end of the safety member 910 is connected with the body 150 by the connection unit 912 as one body, and the other end of the safety member 910 is formed with a hooking jaw 913*b* separatably coupled with the hooking groove 913*a* formed in the body 150. Naturally, there may be various constructions besides the hooking unit 913 of the hooking groove 913*a* and the hooking jaw 913*b*.

Meanwhile, the body 150, the connection unit 912 and the safety member 910 may be formed in one body.

Figure 83:
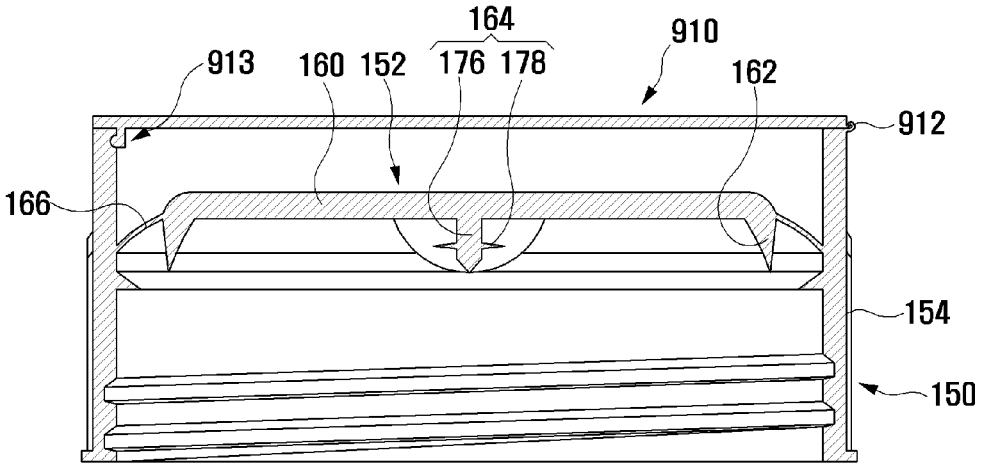
FIG. 83 is a sectional view showing the vessel cap of FIG. 81 connected with the safety member.
Figure 84:
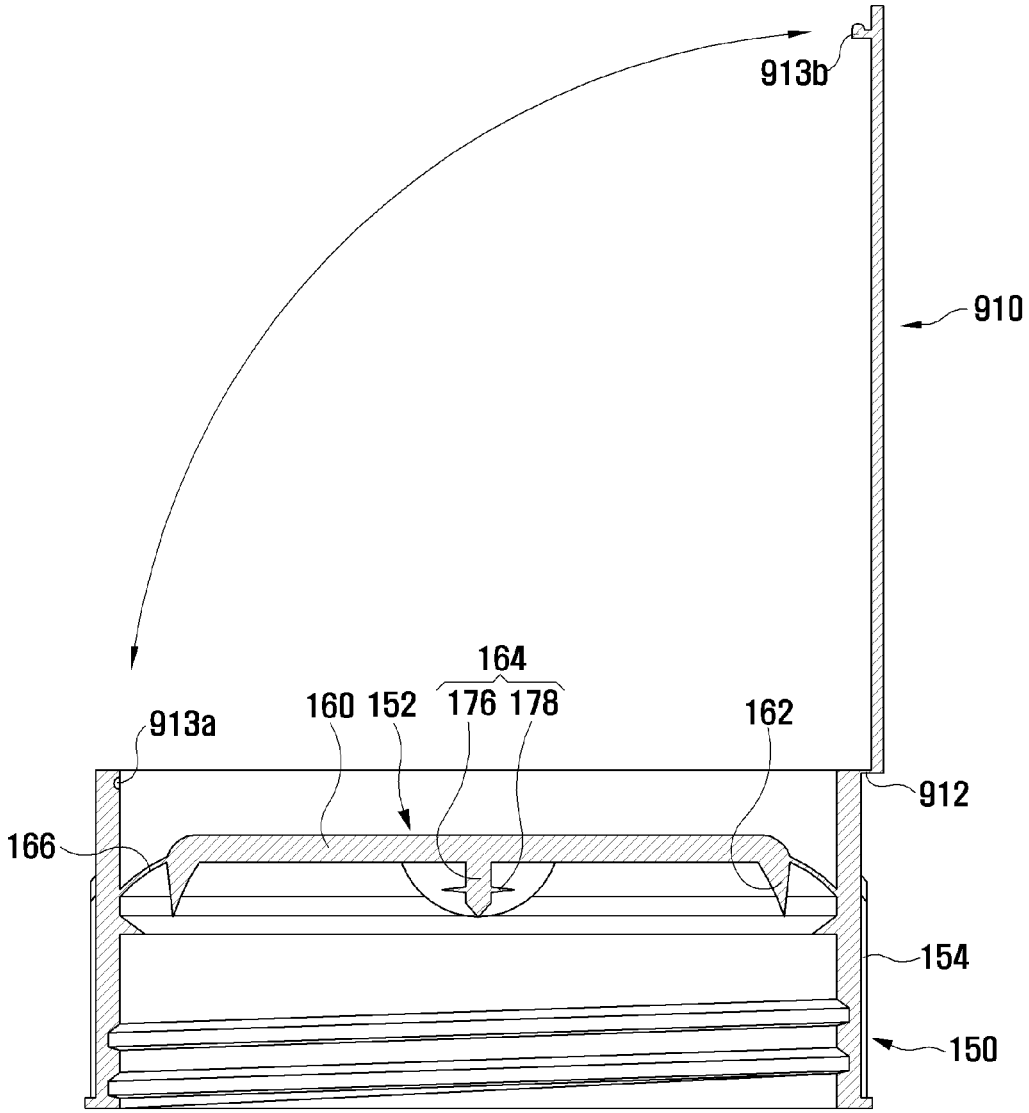
FIG. 84 is a sectional view showing the rotated state of the safety member of the vessel cap of FIG. 81.

The safety member 910 as described in the above, as shown in FIG. 83 prevents the pressing plate 160 from being unexpectedly pressed by maintaining the closed state. Meanwhile, when the user wishes to remove the sealing member 20, the user presses the pressing plate 160 after rotating the safety member 910, as shown in FIG. 84.

Figure 85:
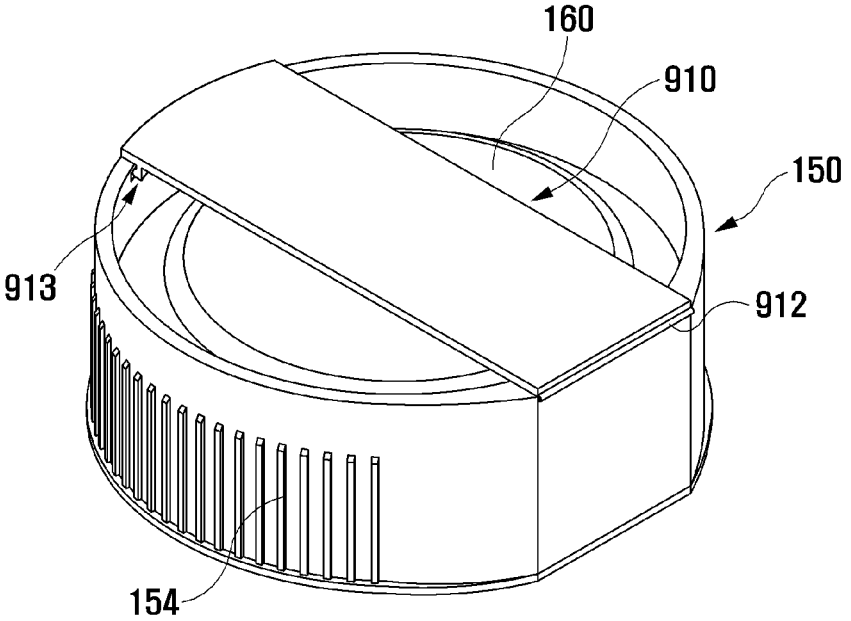
FIG. 85 is a perspective view the modified embodiment of the vessel cap of FIG. 81.
Figure 86:
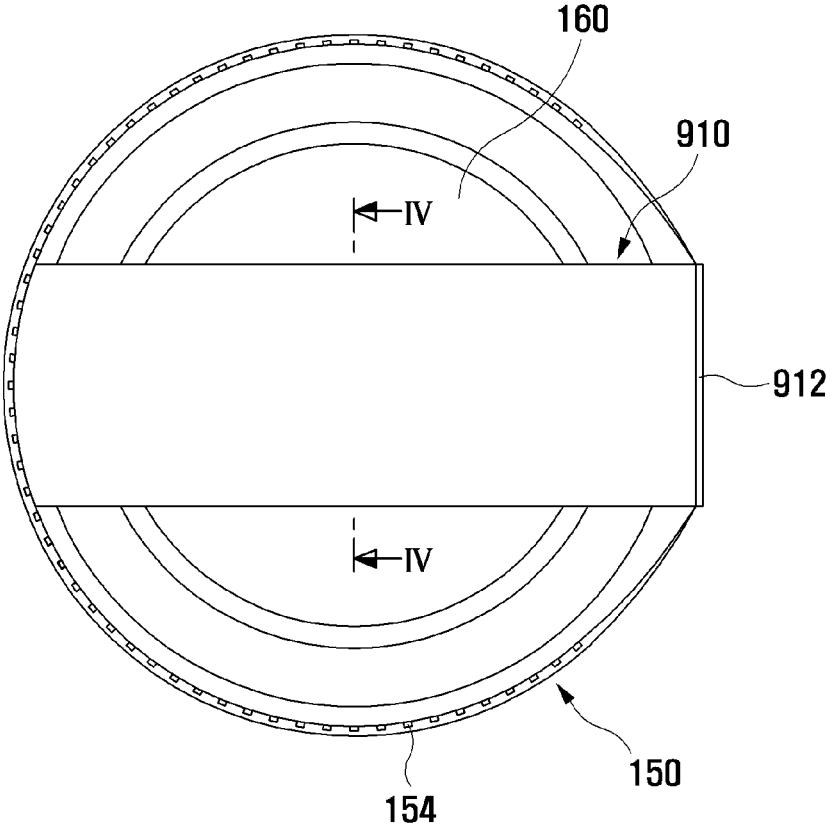
FIG. 86 is a plane view of the vessel cap of FIG. 85.
Figure 87:
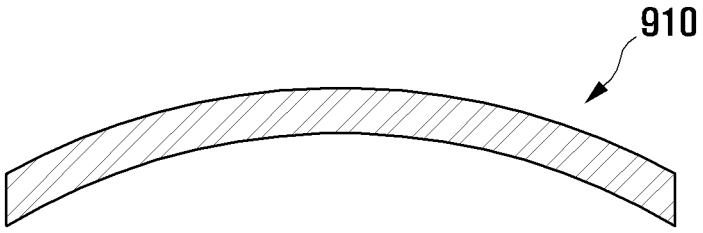
FIG. 87 is a sectional view showing one example of the safety member of the vessel cap of FIG. 81.
Figure 88:
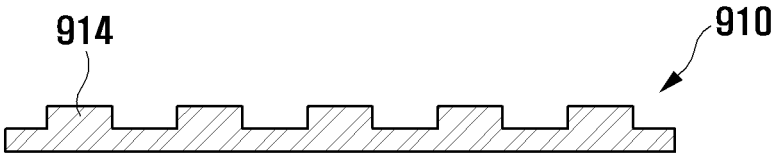
FIG. 88 is a sectional view showing another example of the safety member of the vessel cap of FIG. 81.

Meanwhile, the various shapes of the body of the vessel cap having the safety member 910 may be possible, and the body 150 of the vessel cap may have a flat portion formed with the connection unit 912, as shown in FIGS. 85 and 86. The flat portion formed in the body 150 make the formation of the connection unit 912 performing a hinge of the safety member 910 more easy.

Meanwhile, the safety member 910 prevents the pressing plate 160 from being unexpectedly pressed by external collision, etc, and needs to be structurally reinforced for preventing the safety member 910 from being easily bent. Therefore, the section of the safety member 910 may has a shape of arch, or the safety member 910 may be reinforced by being formed with at least one protrusion in a longitudinal direction of the safety member 910, with various methods for structurally reinforcing the safety member 910.

What is claimed is:

1. A vessel cap, comprising:

a closed body mounted at a vessel inlet through which a liquid material stored in a vessel is discharged outwardly;

an outer cylindrical sidewall surrounding a sealing member, the outer cylindrical sidewall having a mounting portion detachably fixed to a rim of the vessel and seated upon a peripheral edge of the sealing member;

a pressing plate extending radially inward from the outer cylindrical sidewall and substantially overlaying the sealing member, the pressing plate and outer cylindrical sidewall cooperating to enclose the sealing member and the vessel inlet;

one or more cutters protruding from a lower surface of the pressing plate, the cutters penetrating the sealing member when the pressing plate is pressed and cutting the sealing member when the body is rotated after the pressing plate is pressed;

an elastic connection portion formed between an outer circumferential surface of the pressing plate and an inner circumferential surface of the outer cylindrical sidewall, the elastic connection portion allowing the pressing plate to be moved in upper and lower directions; and, a supporting rod downwardly extending from a center of a lower surface of the pressing plate, the supporting rod penetrating the sealing member when the pressing plate is pressed, the supporting rod comprising:

an outer circumferential surface;

a sharp distal end;

a pair of flexible resilient hooking protrusions disposed above the distal free end for retaining the sealing member after the sealing member is cut by the cutters, each hooking protrusion of the pair of hooking protrusions extending from an integral pivoting connection with the outer circumferential surface to an outermost free end, the pair of hooking protrusions having:

a pre-stressed configuration prior to penetration of the sealing member wherein the elongate body extends outward in a substantially radial direction and is spaced above the sealing member;

a stressed configuration upon penetration of the sealing member wherein the sealing member forcibly bends the elongate body in a substantially axial direction;

a post-stressed configuration after penetration of the sealing member wherein the elongate body is below the sealing member and the sealing member is seated upon the elongate body, and the elongate body extends outward in a substantially radial direction.

2. The vessel cap of claim 1, wherein each of the pair of hooking protrusions has a triangular shape and a sharp upper end for hooking the sealing member.

3. The vessel cap of claim 1, wherein each of the hooking protrusions has a conical shape.

4. The vessel cap of claim 1, wherein the pressing plate is formed as a disc shape having a diameter smaller than an inner diameter of the outer cylindrical sidewall, and the pressing plate is disposed at a lower side than an upper surface of the body.

5. The vessel cap of claim 1, wherein the pair of hooking protrusions are define an angle of 180° with the outer circumferential surface of the supporting rod.

6. The vessel cap of claim 1, wherein a plurality of concave-convex protrusions are formed at an outer circumferential surface of the outer cylindrical sidewall.

7. The vessel cap of claim 6, wherein the mounting portion further comprises:

two protrusions protruding from an inner circumferential surface of a lower end of the outer cylindrical sidewall body with a predetermined gap as a belt shape; and a hooking groove formed between the two protrusions for hooking a hooking jaw formed at an outer circumferential surface of the vessel inlet.

8. The vessel cap of claim 1, further comprising a safety member for preventing the pressing plate from being unexpectedly pressed.

9. The vessel cap of claim 8, wherein the safety member is connected to an upper inner portion of the outer cylindrical sidewall, and is connected to the pressing plate; and the safety member is broken when the pressing plate is pressed in order to penetrate and cut the sealing member.

10. The vessel cap of claim 1, wherein the cutters comprise:

a supporting portion formed at an edge of the pressing plate;

a first cutting portion sharply formed at a lower end of the supporting portion for penetrating the sealing member when the pressing plate is pressed; and a second cutting portion formed on at least one side surface of the supporting portion for circumferentially cutting the sealing member when the body is rotated.

11. The vessel cap of claim 10, wherein the supporting portion has a trapezoidal sectional surface, and protrusions sharply protruding from the sectional surface define the second cutting portion.

12. The vessel cap of claim 10, wherein the supporting portion is more inclined towards a center of the body as the supporting portion is closer to a lower end of the supporting portion so as not to come in contact with the vessel inlet.

13. The vessel cap of claim 10, wherein the first cutting portion is inclined towards an inner surface of the supporting portion from an outer surface of the supporting portion.

14. The vessel cap of claim 10, wherein the cutters define a radius of curvature similar to a radius of curvature of an inner circumferential surface of the vessel inlet.

15. The vessel cap of claim 10, wherein the cutters have a triangular sectional surface.

* * * * *